US005256531A

United States Patent [19]

Okada et al.

[11] Patent Number: 5,256,531

[45] Date of Patent: Oct. 26, 1993

[54] PHOTOGRAPHIC PROCESSING COMPOSITION AND PROCESSING METHOD USING THE SAME

[75] Inventors: Hisashi Okada; Shigeru Nakamura, both of Kanagawa, Japan

[73] Assignee: Fuji Photo Film Co., Ltd., Kanagawa, Japan

[21] Appl. No.: 904,326

[22] Filed: Jun. 25, 1992

Related U.S. Application Data

[63] Continuation of Ser. No. 695,658, May 6, 1991.

[30] Foreign Application Priority Data

May 9, 1990 [JP] Japan ..... 2-119250
May 18, 1990 [JP] Japan ..... 2-128588
Jul. 2, 1990 [JP] Japan ..... 2-175026

[51] Int. Cl.[5] ..... G03C 7/42

[52] U.S. Cl. ..... 430/393; 430/430; 430/460; 430/461

[58] Field of Search ..... 430/393, 430, 460, 461

[56] References Cited

U.S. PATENT DOCUMENTS 4,910,125 3/1990 Haruuchi et al. ..... 430/393

FOREIGN PATENT DOCUMENTS 38-047767 2/1963 Japan .
2059091 4/1981 United Kingdom .

OTHER PUBLICATIONS

Patent Abstracts of Japan, vol. 13, No. 475 (p-p950)(3823) 27 Oct. 1989, & JP-A-01 187556 Fuji Photo Film Co., Ltd., 26 Jul. 1989.

*Primary Examiner*—Hoa Van Le
*Attorney, Agent, or Firm*—Sughrue, Mion, Zinn, Macpeak & Seas

[57] ABSTRACT

A photographic processing composition containing at least one compound represented by formula (I)

(I)

wherein R, $R_1$ and $R_2$ each represent a hydrogen atom, an alkyl group or an aryl group; and $L_1$ represents an alkylene group or an arylene group. Also disclosed a processing composition for a silver halide color photographic material containing a metal chelate compound formed from a compound represented by formula (I) and a metal salt selected from salts of Fe(III), Mn(III), Co(III), Rh(II), Rh(III), Au(III), Au(II) and Ce(IV). A method is also disclosed for processing a silver halide photographic material with the processing compositions.

20 Claims, No Drawings

PHOTOGRAPHIC PROCESSING COMPOSITION AND PROCESSING METHOD USING THE SAME

This is a continuation of application No. 07/695,658 filed May 6, 1991, allowed.

FIELD OF THE INVENTION

The present invention relates to a processing composition for processing silver halide photographic materials, and more particularly to a photographic processing composition containing a novel bleaching agent for use in the bleaching step after color development or a photographic processing composition containing a novel chelating agent for sequestering metal ions which are harmful to photographic processing. The present invention also relates to a method for processing silver halide photographic materials using these compositions.

BACKGROUND OF THE INVENTION

Generally, imagewise exposed silver halide black-and-white photographic materials are processed by processing steps such as black-and-white development, fixing, rinse, etc., and imagewise exposed silver halide color photographic materials (hereinafter referred to as color photographic materials) are processed by processing steps such as color development, desilverization, rinse, stabilization, etc. Imagewise exposed silver halide reversal color photographic materials are processed by processing steps such as black-and-white development and reversal development followed by color development, desilverization, rinse, stabilization, etc.

In the color development step, exposed silver halide grains are reduced by color developing agents to form silver and at the same time, the thus formed oxidant of the color developing agent reacts with a coupler to form a dye image.

In the subsequent desilverization step, developed silver formed in the development step is oxidized by bleaching agents having an oxidizing effect into silver salt (bleaching). Unused silver halide is converted by fixing agents into soluble silver salt (fixing). Thus, the developed silver and the unused silver halide is removed from the sensitive layers. Bleaching and fixing can be carried out independently by a bleaching step and a fixing step, respectively. Alternatively, bleaching and fixing can be simultaneously carried out as a bleach-fixing step. The details of these processing steps and the compositions of processing solutions, etc. are described in James, *The Theory of Photographic Process*, fourth edition (1977), *Research Disclosure* No. 17643, pages 28–29, ibid. No. 18716 (page 651 left column to right column) and ibid. No. 307105 (pages 880–881).

In addition to the above-described basic processing steps, various auxiliary steps such as a rinse step, a stabilization step, a hardening step and a stop step are carried out to retain the photographic and physical qualities of the dye image.

The above-described processing steps are generally conducted in automatic processors. Photographic processing is conducted by various laboratores ranging from large-scale laboratories provided with large-size automatic processors to more recent photo shops (called mini-laboratories) using small-size automatic processors in the shop. Thus, there is a possibility that processing performance is adversely affected.

The incorporation of metal ions into the processing solutions is a major cause of reduced processing performance. For example, when processing solutions are prepared, metal ions such as calcium, magnesium and iron contained in water, or metal ions such as calcium dissolved out from photographic materials, are incorporated into the processing solutions. Such metal ions have an adverse effect on processing performance.

For example, in a developer, when calcium ion or magnesium ion is accumulated, these metal ions react with ingredients such as carbonates in the processing solution to form a precipitate or sludge, and the precipitate or the sludge is deposited onto the processed film, whereby staining or the clogging of the filters of the processor results. Transition metal ions, typically iron ion, often greatly reduce the storage property of the processing solution. As a result, a lowering in image density and a lowering in photographic performance such as rise in fog result. In other cases, there is a possibility that metal ions are left behind in the processed films and as a result, image stability is deteriorated.

Further, when a transition metal such as iron ion is mixed into a bleaching solution using hydrogen peroxide or persulfate, the stability of the solution is remarkably lowered and the problems such as bleach inferior arise.

In the case of a fixing solution, on the other hand, the stability is lowered when a transition metal salt is mixed into the conventional thiosulfate-containing fixing solution, and further, turbidity and sludge are formed in the solution. As a result, various problems such as the reduction of the circulating flow rate due to the clogging of filter in automatic developing machine, fixing failure, and processing stain of film arise.

Furthermore, in the case of a stabilizing solution prepared by using a hard water containing a large amount of potassium and magnesium, the solution may have turbidity due to the formation of bacteria therein and cause the stain of film. When a transition metal type ion such as iron ion is mixed into the solution, the preservability of film after processing is deteriorated since the ion remains in the film.

Accordingly, there is a need in the art to solve the problems caused by such metal ions.

As a method for solving the above-described problems, the use of chelating agents for sequestering the metal ions has been proposed. Examples of the chelating agents conventionally used include amino polycarboxylic acids (e.g., ethylenediaminetetraacetic acid, diethylenetriaminepentaacetic acid, etc.) as described in JP-B-48-30496 (the term "JP-B" as used herein means an "examined Japanese patent publication") and JP-B-44-30232, organic phosphonic acids as described in JP-A-56-97347 (the term "JP-A" as used herein means an "unexamined published Japanese patent application"), JP-B-56-39359 and West German Patent 2,227,639, phosphonocarboxylic acids as described in JP-A-52-102726, JP-A-53-42730, JP-A-54-121127, JP-A-55-126241 and JP-A-55-65956, and the compounds described in JP-A-58-195845, JP-A-58-203440 and JP-B-53-40900.

Some of the above described compounds are practically useful, but these compounds are not considered to provide satisfactory performance. For example, when ethylenediaminetetraacetic acid is added to a developing solution, it accelerates the decomposition of the developing agent or preservative in the developing solution in the presence of iron ion. Furthermore, photographic characteristics are deteriorated. For example, a lowering in image density and rise in fog result, even though the acid has a high ability for sequestering calcium ion. Alkylidene-diphosphonic acids do not have such a deteriorating effect in the presence of iron ion, but when these acids are added to a processing solution prepared using hard water containing a relatively large amount of calcium, the solids which are formed result in maintenance and operational difficulties of the automatic processor and other problems.

There is a tendency to increasingly reduce the replenishment rate of photographic processing solutions in light of environmental concerns. Hence, the residence time of the processing solutions in the processors is prolonged such that preservation of the processing solutions is highly desirable. Accordingly, there is a need to develop an excellent novel chelating agent which is free of the problem caused by accumulated metal ions in the developing solution and which effectively sequester metal ions.

The above-described processing steps have been conducted in shops provided with small-size automatic processors (called mini-laboratories) in recent years. Accordingly, rapid processing attention to customers has become increasingly important.

However, the iron(III) complex salt of ethylenediaminetetraacetic acid conventionally used has a fundamental disadvantage in that the oxidizing power thereof is low. Bleaching accelerators (e.g., mercapto compounds described in U.S. Pat. No. 1,138,842) are added to improve the oxidizing power. However, rapid bleaching cannot be achieved.

Red prussiate, iron chloride, bromates, etc. are known as bleaching agents capable of achieving rapid bleaching. However, red prussiate cannot be widely used due to environmental concerns. Iron chloride is inconvenient to handle, because it corrodes metals. Bromate solutions are unstable.

Accordingly, there is a need to provide a bleaching agent which is easy to handle, is free from the problem of the discharge of waste liquor and achieves rapid bleaching.

Iron(III) complex salt of 1,3-diaminopropanetetraacetic acid has been proposed as a bleaching agent meeting the above requirements in recent years.

However, this bleaching agent causes bleach fog. The addition of buffering agents to the bleaching agent has been proposed as a method for reducing the bleach fog (see, JP-A-1-213657). However, the problem is not be sufficiently solved by this method. Particularly, in rapid processing wherein color development is conducted in a short time of within 3 minutes, high-activity developing solutions are used which result in a much greater degree of bleach fog.

Furthermore, when processing solutions having a bleaching ability with iron(III) complex salt of 1,3-diaminopropanetetraacetic acid are used, stain is increased during storage after processing.

Furthermore, when continuous processing is carried out by using the processing solutions having a bleaching ability with iron(III) complex salt of 1,3-diaminopropanetetraacetic acid, desilverization performance is greatly lowered in comparison with that at the early stage of continuous processing and precipitates are formed. Therefore, there is a need to provide a novel processing composition having a bleaching ability which solves the above described problems and a processing method which can be used in place of conventional processing methods.

SUMMARY OF THE INVENTION

Accordingly, a first object of the present invention is to provide a photographic processing composition which does not form a precipitate or sludge even when metal ions are contained therein.

A second object of the present invention is to provide a stable processing composition which does not reduce the effectiveness of the active components in the processing solutions and does not form a component having an adverse effect on photographic characteristics even when metal ions are contained therein.

A third object of the present invention is to provide a processing composition which enhances preservability of the image without the increase of stain despite the presence of metal ions left behind in the processed photographic material, which metal ions are contained in the processing composition, and to provide a processing method using the processing composition.

The above-described objects of the present invention have been achieved by providing a processing composition containing at least one compound represented by the formula (I) and a processing method using the same:

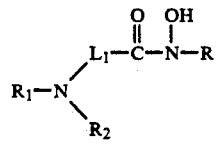

(I)

wherein R, $R_1$ and $R_2$ each represents a hydrogen atom, an alkyl group which may be substituted or an aryl group which may be substituted; and $L_1$ represents an alkylene group which may be substituted or an arylene group which may be substituted.

A fourth object of the present invention is to provide a processing composition which is easy to handle and is free from the problem of environmental pollution caused by waste liquor and to provide a processing method using the same.

A fifth object of the present invention is to provide a processing composition which is excellent in desilverization performance and has a bleaching ability, and to provide a processing method using the same.

A sixth object of the present invention is to provide a processing composition which substantially does not cause bleach fog and has a bleaching ability, and to provide a processing method using the same.

A seventh object of the present invention is to provide a processing composition which does not stain a processed photographic material upon storage and which has a bleaching ability, and to provide a processing method using the same.

An eighth object of the present invention is to provide a processing composition which can stably retain the above-described performance even when continuous processing is conducted, and to provide a processing method using the same.

The above-described objects of the present invention have been achieved by providing a processing composition for use in processing a color photographic material, comprising a metal chelate compound formed from a compound represented by formula (I) and a metal salt selected from the group consisting of the salts of Fe(III), Mn(III), Co(III), Rh(II), Rh(III), Au(III), Au(II) and Ce(IV), and a processing method using the same:

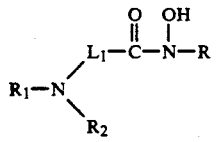

(I)

wherein R, $R_1$ and $R_2$ each represents a hydrogen atom, an alkyl group or an aryl group; and $L_1$ represents an alkylene group or an arylene group.

DETAILED DESCRIPTION OF THE INVENTION

The compounds represented by formula (I) are illustrated in detail below.

In formula (I), R, $R_1$ and $R_2$ independently represent a hydrogen atom, an alkyl group which may be substituted or an aryl group which may be substituted. The alkyl group represented by R, $R_1$ and $R_2$ may be a straight-chain, branched or cyclic alkyl group with an alkyl group having 1 to 10 carbon atoms being preferred. For example, examples of the straight-chain alkyl group include a methyl group and an ethyl group, examples of the branched alkyl group include a tert-butyl group, and examples of the cyclic alkyl group include a cyclohexyl group. More preferred examples of the alkyl group are methyl group and ethyl group. The aryl group represented by R, $R_1$ and $R_2$ preferably has 6 to 10 carbon atoms. Phenyl group is more preferred.

The alkyl group and the aryl group represented by R, $R_1$ and $R_2$ may be substituted. Examples of substituent groups include an alkyl group having preferably 1 to 10 carbon atoms, more preferably 1 to 6 carbon atoms (e.g., methyl, ethyl, i-propyl), an aralkyl group having preferably 7 to 11 carbon atoms (e.g., phenylmethyl), an alkenyl group having preferably 2 to 10 carbon atoms, more preferably 2 to 6 carbon atoms (e.g., allyl), an alkynyl group having preferably 2 to 10 carbon atoms, more preferably 2 to 6 carbon atoms, an alkoxy group having preferably 1 to 10 carbon atoms, more preferably 1 to 6 carbon atoms (e.g., methoxy, ethoxy), an aryl group having preferably 6 to 10 carbon atoms (e.g., phenyl), a substituted amino group (e.g.,

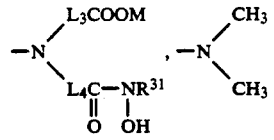

wherein $L_3$, $L_4$ and $R^{31}$ each are defined later), an acylamino group having preferably 1 to 10 carbon atoms, more preferably 1 to 6 carbon atoms (e.g., acetylamino), a sulfonylamino group (e.g., methanesulfonylamino), a ureido group, a urethane group, an aryloxy group having preferably 6 to 10 carbon atoms (e.g., phenoxy), a sulfamoyl group, a carbamoyl group having preferably 1 to 10 carbon atoms, more preferably 1 to 6 carbon atoms, an alkylthio group having preferably 1 to 10 carbon atoms, more preferably 1 to 6 carbon atoms, an arylthio group having preferably 6 to 10 carbon atoms, a sulfonyl group, a sulfinyl group, a hydroxyl group, a halogen atom (e.g., Cl, Br, F), a cyano group, a sulfo group, a carboxyl group, a phosphono group, an aryloxycarbonyl group having preferably 7 to 11 carbon atoms (e.g., phenoxycarbonyl), an acyl group having preferably 2 to 10 carbon atoms, more preferably 2 to 6 carbon atoms (e.g., acetyl, benzoyl), an alkoxycarbonyl group having preferably 2 to 10 carbon atoms, more preferably 2 to 6 carbon atoms (e.g., methoxycarbonyl), an acyloxy group having preferably 2 to 10 carbon atoms, more preferably 2 to 6 carbon atoms (e.g., acetyloxy), a carbonamido group, a sulfonamido group, a nitro group and a group of

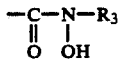

(wherein $R_3$ is hydrogen atom, an alkyl group which may be substituted or an aryl group which may be substituted; examples of substituent groups include those described above in the definition of the substituent groups for R, $R_1$ and $R_2$).

Any two of R, $R_1$ and $R_2$ or all of R, $R_1$ and $R_2$ may be combined together to form a ring such as pyrrolidine, imidazoline, piperidine, piperazine and morpholine.

$L_1$ represents an alkylene group having preferably 1 to 10 carbon atoms, more preferably 1 to 3 carbon atoms or an arylene group having preferably 6 to 10 carbon atoms, and is preferably methylene group or ethylene group or a group having a benzene ring. The alkylene group and the arylene group may be substituted. Examples of substituent groups for $L_1$ include those described above in the definition of the substituent groups for R, $R_1$ and $R_2$.

Among the compounds represented by formula (I), compounds represented by the following formula (II) or are preferred. More preferred are compounds represented by the following formula (III).

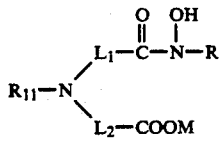

(II)

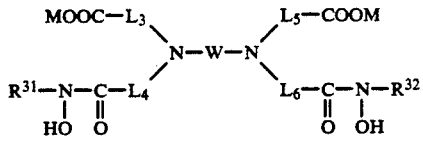

(III)

In the above formulae, R and $L_1$ are as defined above in formula (I); $R_{11}$ has the same meaning as $R_1$ in formula (I) (preferred examples of substituent groups for the alkyl group and the aryl group include a carboxyl group, a group of

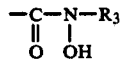

(wherein $R_3$ is as defined above), a hydroxyl group, an alkyl group, an aryl group, a sulfo group and a phosphono group and more preferred examples thereof include a carboxyl group, an alkyl group and

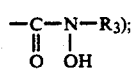

$R_{31}$ and $R_{32}$ have the same meaning as R in formula (I); $L_2$, $L_3$, $L_4$, $L_5$ and $L_6$ each represent an alkylene group having preferably 1 to 10 carbon atoms, more preferably 1 to 3 carbon atoms, which may be substituted or an arylene group having preferably 6 to 10 carbon atoms, more preferably a benzene ring-containing group, which may be substituted (examples of substituent groups include those described above in the definition of the substituent groups for R, $R_1$ and $R_2$), preferably methylene group or ethylene group; M represents a hydrogen atom or a cation (e.g., an alkali metal such as lithium, sodium and potassium or ammonium); and W represents a divalent bonding group connecting to

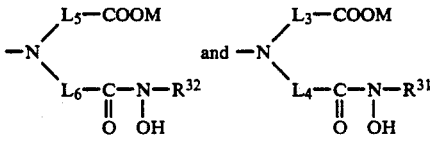

via an alkylene group including a cyclohexylene group or an arylene group, preferably an alkylene group having from 2 to 8 carbon atoms (including a cyclohexylene group), an arylene group having from 6 to 10 carbon atoms, $$\text{-}(W^1\text{-}O)_m W^2\text{-},\ \text{-}(W^1\text{-}S)_m W^2\text{-},\ \text{-}(W^1\text{-}D)_m W^1\text{-}$$

(wherein $W^1$ and $W^2$ each represent an alkylene group having 1 to 8 carbon atoms or an arylene group having 6 to 10 carbon atoms; m represents an integer of 1 to 3; and D represents a 5- to 7-membered divalent heterocyclic group containing at least one atom of N, O and S),

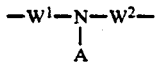

wherein A represents a hydrogen atom, a hydrocarbon, $L_A$—$COOM^1$, —$L_A$—$PO_3M^2M^3$, —$L_A$—OH or —$L_A$—$SO_3M^4$ wherein LA is an alkylene group having 1 to 8 carbon atoms or an arylene group having 6 to 10 carbon atoms; and $M^1$ to $M^4$ each represent a hydrogen atom or a cation such as an alkali metal or ammonium or a group connecting of two or more of them. $R_{11}$ preferably represents a hydrogen atom or an alkyl group which may be substituted, and particularly an alkyl group which may be substituted. D preferably represents a 5- or 6-membered divalent heterocyclic group containing N as a hetero atom. The hydrocarbon represented by A preferably has 1 to 10 carbon atoms. More preferably, the hydrocarbon is an alkyl group having 1 to 6, particularly 1 to 3 carbon atoms. These divalent bonding groups may have one or more substituent groups. Examples of the substituent groups include those already described above in the definition of the substituent groups for the alkyl group and the aryl group represented by R, $R_1$ and $R_2$.

Examples of D include the following groups.

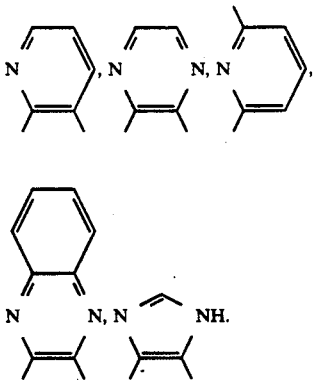

Examples of W include the following groups.

$$\text{-}(CH_2)_2\text{-},\ \text{-}(CH_2)_3\text{-},\ \text{-}(CH_2)_4\text{-},$$

$$\text{-}\underset{}{\overset{CH_3}{\overset{|}{C}}}HCH_2\text{-},\ \text{-}CH_2\underset{OH}{\underset{|}{C}}HCH_2\text{-},$$

$$\text{-}CH_2CH_2OCH_2CH_2\text{-},$$
$$\text{-}CH_2CH_2OCH_2CH_2OCH_2CH_2\text{-},$$
$$\text{-}CH_2CH_2SCH_2CH_2\text{-},$$
$$\text{-}CH_2CH_2SCH_2CH_2SCH_2CH_2\text{-},$$

$$\text{-}CH_2CH_2\underset{CH_2COOH}{\underset{|}{N}}CH_2CH_2\text{-},$$

$$\text{-}CH_2CH_2\underset{CH_2COOH}{\underset{|}{N}}CH_2CH_2\underset{CH_2COOH}{\underset{|}{N}}CH_2CH_2\text{-},$$

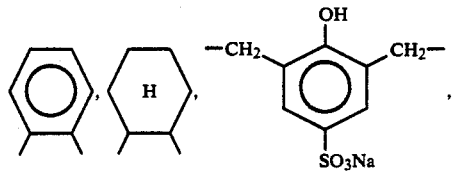

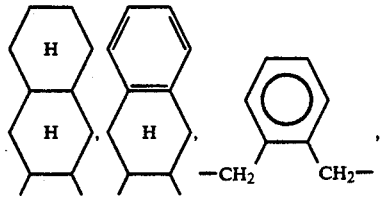

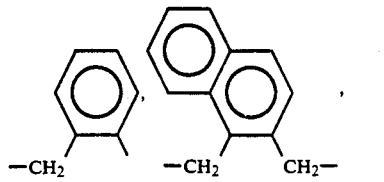

-continued

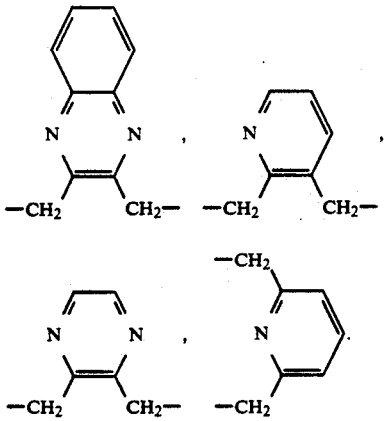

Preferred examples of W include the following groups.

$-(CH_2)_2-$, $-(CH_2)_3-$, $-CH_2CH_2OCH_2CH_2-$, $-CH(CH_3)CH_2-$, $-CH_2CH(OH)CH_2-$, $-CH_2CH_2OCH_2CH_2OCH_2CH_2-$,
$-CH_2CH_2SCH_2CH_2-$,

-continued $-CH_2CH_2SCH_2CH_2SCH_2CH_2-$, $-CH_2CH_2N(CH_2COOH)CH_2CH_2-$, $-CH_2CH_2N(CH_2COOH)CH_2CH_2N(CH_2COOH)CH_2CH_2-$,

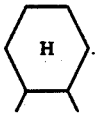

Of these, more preferred groups for W are $-(CH_2)_2-$, $-(CH_2)_3-$, and 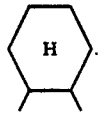 .

The total carbon number of the compounds represented by formula (I) of the present invention is preferably 40 or less, more preferably 30 or less.

Useful examples of the compounds represented by formula (I) include, but are not limited to, the following compounds.

1. 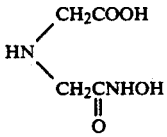

2. 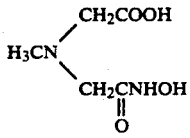

3. 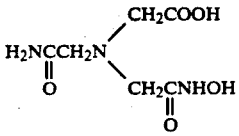

4. 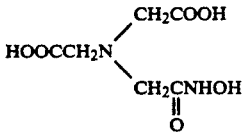

5. 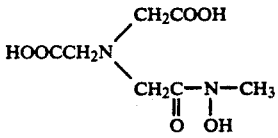

6. 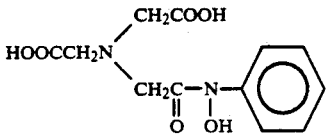

-continued
7.
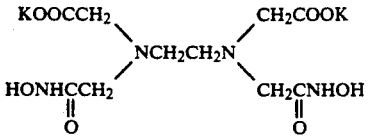
8.
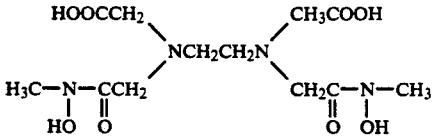
9.
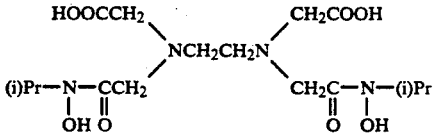
10.
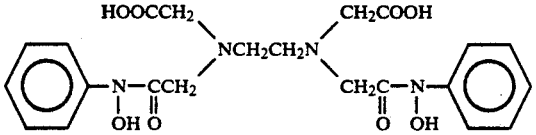
11.
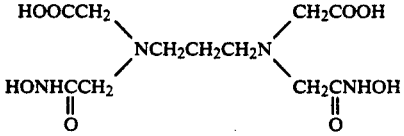
12.
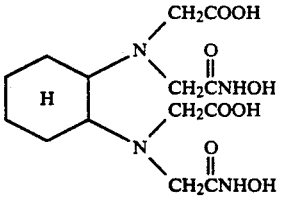
13.
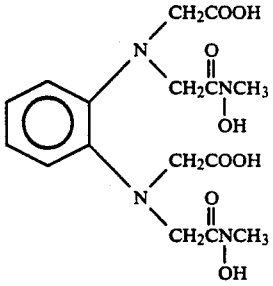
14.
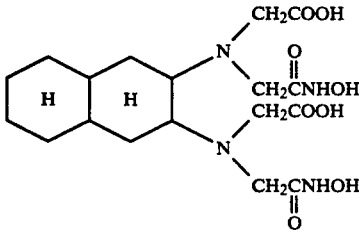
15.
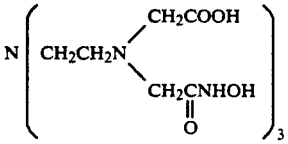

-continued
16.
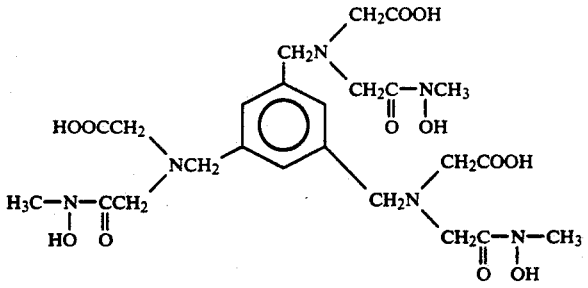
17.
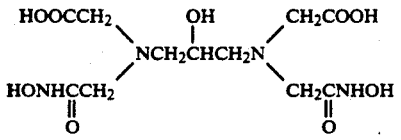
18.
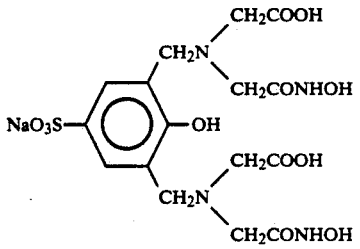
19.
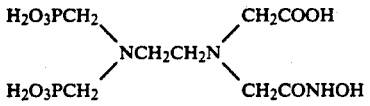
20.
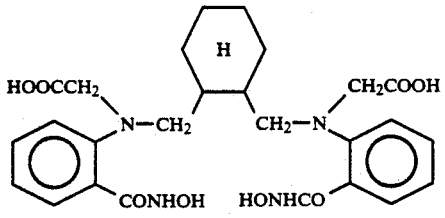
21.
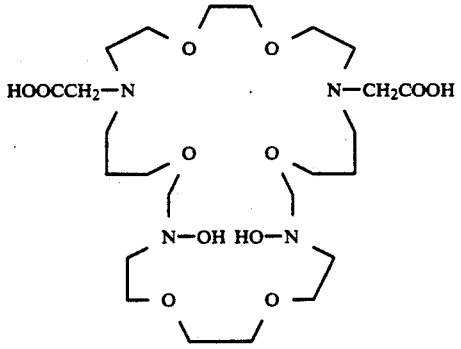
22.
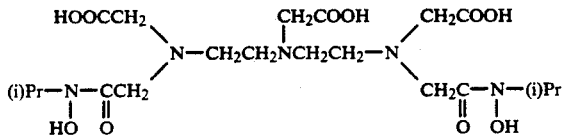

-continued
23.
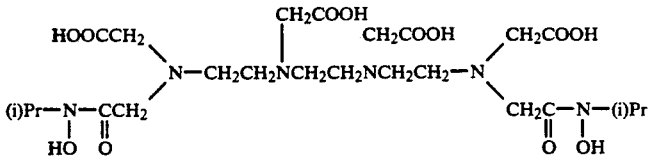
24.
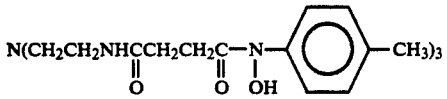
25.
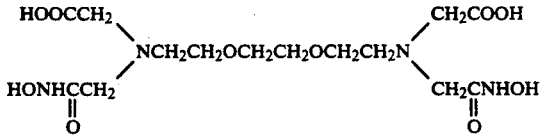
26.
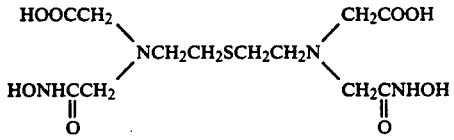
27.
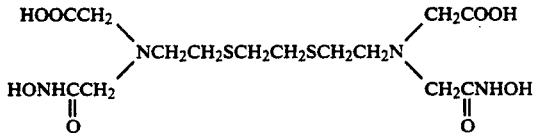
28.
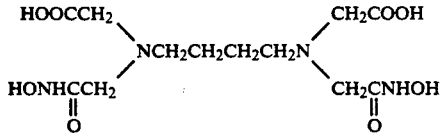
29.
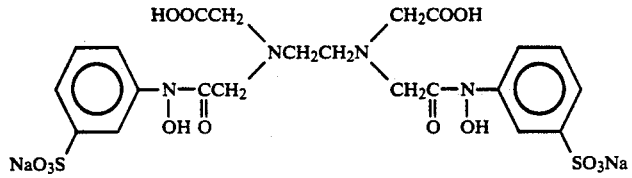
30.
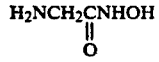
31.
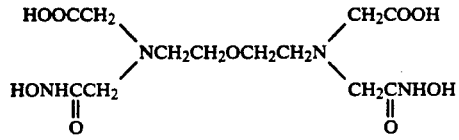
32.
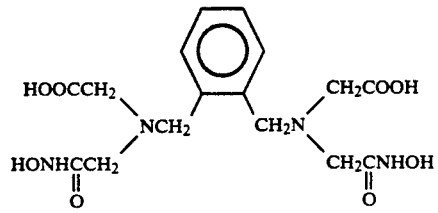

-continued

33.

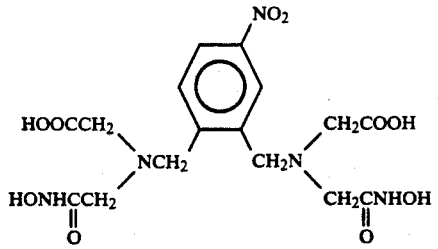

34.

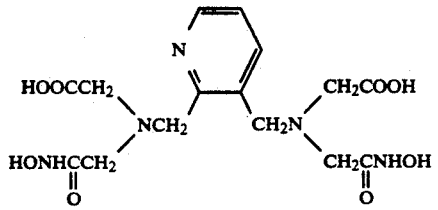

35.

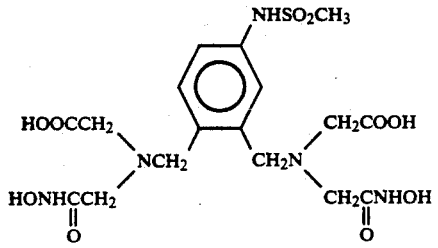

The compounds of the present invention can be synthesized by methods described in *Chelate Chemistry* (5), page 318 (1975) edited by Keihei Ueno (published by Nankodo) or *Inorganic Chemistry*, Vol. 27, 474 (1988).

Synthesis examples are illustrated below.

SYNTHESIS EXAMPLE 1

Synthesis of Compound 7

The compounds was synthesized according to the methods described in *Chelate Chemistry* (5), page 318 (1975) edited by Keihei Ueno (published by Nankodo) (written in Japanese).

5.6 g (80.0 mmol) of hydroxylamine hydrochloride were suspended in 30 ml of methanol, and 30 ml of a methanol solution of 4.5 g of potassium hydroxide was added thereto. The precipitated potassium chloride was recovered by filtration. To the filtrate were added 30 ml of a methanol solution of 4.5 g of potassium hydroxide and 6.7 g (20.0 mmol) of diethyl ethylenediaminetetraacetate (see, synthesis method described in *Chelate Chemistry* (5), page 318 (1975), edited by Keihei Ueno, published by Nankodo). The mixture was reacted at room temperature for 3 days. 20% hydrochloric acid was added thereto, and the thus formed pasty material was taken out and dissolved in a small amount of water. The pH of the resulting solution was adjusted with potassium carbonate to 9. Methanol was added thereto, and the precipitated solid was recovered by filtration and recrystallized from water/methanol to obtain 3.8 g (10.8 mmol) of the desired compound 7 as the monohydrate. Yield: 54%.

SYNTHESIS EXAMPLE 2

Synthesis of Compound 8

5.12 g (20.0 mmol) of ethylenediaminetetraacetic anhydride (see, synthesis method described in French Patent 1,548,885) was suspended in 20 ml of water, and 5.6 ml (40.0 mmol) of triethylamine was added thereto. A solution of 3.67 g (44.0 mmol) of methyl hydroxylamine hydrochloride in 10 ml of water was slowly added thereto at such a rate that the internal temperature was kept at 5° to 10° C. After the reaction was carried out for 4 hours, the precipitated crystal was recovered by filtration and recrystallized from water to obtain 1.88 g (4.87 mmol) of the desired compound 8 as the dihydrate. Yield: 24%. Melting point: 138°-140° C. (decomposition).

SYNTHESIS EXAMPLE 3

Synthesis of Compound 9

The compound was synthesized according to the method described in *Inorganic Chemistry*, Vol. 27, 474 (1988).

29 g (390 mmol) of N-isopropylhydroxylamine and 10 g (39 mmol) of ethylenediaminetetraacetic anhydride were suspended in 250 ml of dimethyl sulfoxide and reacted at room temperature for 4 days. After the solvent was removed by dutillation under reduced pressure, tetrahydrofuran was added. The precipitated solid was recovered by filtration and recrystallized from methanol/diethyl ether to obtain 9.2 g (27 mmol) of the desired compound 57. Yield: 69%. Melting point: 195°-197° C. (decomposition).

Other compounds can be synthesized in the same manner as described above.

The amounts of the compounds of formula (I) to be added to a processing composition varies depending on the type and application of the processing composition to be used, but is generally used in the range of from 10 mg to 50 g per liter of the processing composition.

More specifically, when the compound represented by formula (I) is added to a black-and-white developing solution or a color developing solution, the compound is used in the range of preferably 0.5 to 10 g, particularly preferably 0.5 to 5 g per liter of the processing composition. When the compound represented by formula (I) is added to a bleaching solution (e.g., comprising hydrogen peroxide, persulfate, bromate, etc.), the compound is used in the range of preferably 0.1 to 20 g, particularly preferably 0.1 to 5 g per liter of the bleaching solution. When the compound represented by formula (I) is added to a fixing solution or bleach-fixing solution, the compound is used in the range of preferably 1 to 40 g, particularly preferably 1 to 20 g per liter of the solution. When the compound represented by formula (I) is added to a stabilizing bath, the compound is used in the range of preferably 50 mg to 1 g, particularly preferably 50 to 300 mg, per liter of the bath.

The compounds represented by formula (I) may be used either alone or in a combination of two or more of these compounds.

The compounds represented by formula (I) can generally be applied to all processing compositions for use in processing silver halide light-sensitive materials. Examples of such processing compositions include, but are limited to, general-purpose black-and-white developing solutions, infectious developing solutions for lith films, color developing solutions, bleaching solutions, fixing solutions, bleach-fixing solutions, compensating developers, stop-solutions, hardening solutions, washing solutions, stabilizing solutions, rinsing solutions, fogging solutions and toners.

The compound represented by formula (I) forms a metal complex (a metal chelate compound) with a metal salt selected from the group consisting of the salts of Fe(III), Mn(III), Co(III), Rh(II), Rh(III), Au(II), Au(III) and Ce(IV), and it has excellent characteristics as the bleaching agent for silver halide color photographic materials.

According to one embodiment of a processing composition containing a metal chelate compound of the present invention, the bleaching of developed silver is accomplished very rapidly by treating a silver halide color photographic material with the processing composition containing the metal chelate compound of the present invention after the imagewise exposed silver halide color photographic material is subjected to color development. No bleach fog results which is in sharp contrast the bleach fog resulting from the use of conventional bleaching agents for rapid bleaching. The effect is striking, particularly when rapid color development is carried out in a short time of 3 minutes or less followed by the treatment with the processing composition containing the metal chelate compound of the present invention. Furthermore, image preservability after processing is good, and the processing composition of the present invention is preferred from the viewpoint of handling.

The metal salt which forms the metal chelate compound of the present invention is selected from the group consisting of the salts of Fe(III), Mn(III), Co(III), Rh(II), Rh(III), Au(II), Au(III) and Ce(IV). Among them, the salts of Fe(III), Mn(III) and Ce(IV) are preferred with a salt of Fe(III) being particularly preferred.

Halogen ions (e.g., $Cl^-$, $Br^-$, $I^-$), nitrate ion and sulfate ion are preferably used as counter ions to the metal salts.

The metal chelate compound of the present invention may be isolated as a metal chelate compound for use in the processing composition.

Examples of the metal chelate compound of the present invention include, but are not limited to, the following compounds. A complex of a metal salt and the compound of formula (I) is preferred.

K-1

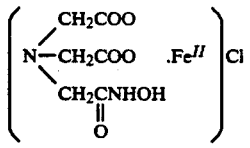

K-2

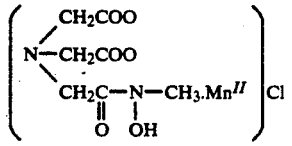

K-3

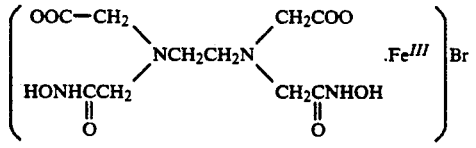

K-4

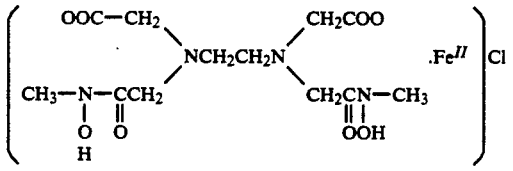

K-5

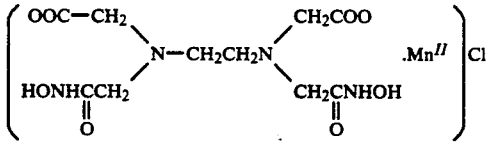

K-6

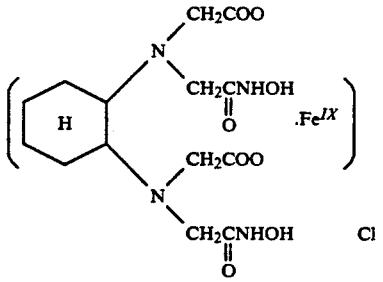

K-7

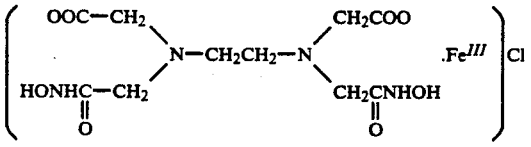

K-8

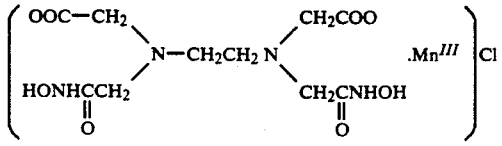

-continued

K-8

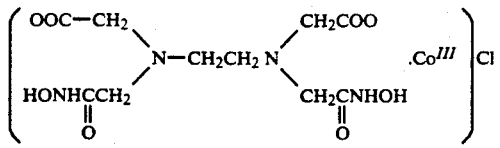

K-10

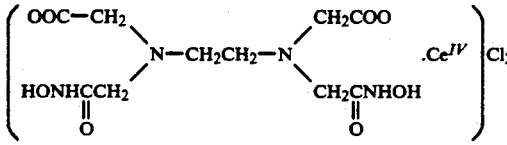

A typical example of a method for synthesizing the metal chelate compound salt of the present invention is illustrated below.

SYNTHESIS EXAMPLE 4

Synthesis of Compound K-4

27.0 g (0.100 mol) of ferric chloride hexahydrate and 40.5 g (0.105 mol) of compound 8 dihydrate were dissolved in 200 ml of water with heating and stirred at 90° C. for 2 hours. The mixture was concentrated under reduced pressure until the internal volume reached about 100 ml. Ethanol was added thereto to precipitate a yellow solid. The resulting crude crystal was recrystallized from water/ethanol and dried at 60° C. under vacuum to obtain 29.9 g (0.0680 mol) of the desired compound K-4. Yield: 68%.

In the present invention, the compound of formula (I) and the above-described metal salt such as ferric sulfate, ferric chloride, ferric nitrate, ammonium ferric sulfate or ferric phosphate are reacted with each other in a solution and may be used as such. The compound of formula (I) is used in a molar ratio of the compound to the metal ion of at least 1.0. A higher ratio is preferable when the stability of the metal chelate compound is low. The ratio is generally in the range of 1 to 30.

A small amount of the metal chelate compound may be incorporated in the fixing solution or an intermediate bath between color development and the desilverization step. When 0.05 to 1 mol of the compound per liter of the processing solution is incorporated in the bleaching solution or the bleach-fixing solution, the compound of the present invention functions effectively as a bleaching agent in the bleaching solution or the bleach-fixing solution.

A preferred embodiment of the processing solution having a bleaching ability (bleaching solution and bleach-fixing solution are generally called processing solution having a bleaching ability herein) is illustrated below.

When 0.05 to 1 mol of the metal chelate compound of the present invention per liter of the processing solution is incorporated in the processing solution having a bleaching ability, the compound functions effectively as a bleaching agent as described above. An amount of the metal chelate compound in the range of 0.1 to 0.5 mol per liter of the processing solution is more preferred.

When the metal chelate compound of the present invention is used as a bleaching agent in a processing solution having a bleaching ability, the compound of the present invention may be used together with other conventional bleaching agents, as long as the effect of the present invention is obtained. Examples of such conventional bleaching agents include Fe(III), Co(III) or Mn(III) chelate type bleaching agents of compounds described below, persulfates (e.g., peroxodisulfate), hydrogen peroxide and bromates.

Examples of the compounds which form the above-described conventional chelate bleaching agents include, but are not limited to, ethylenediaminetetraacetic acid, disodium ethylenediaminetetraacetate, diammonium ethylenediaminetetraacetate, tetra(trimethylammonium) ethylenediaminetetraacetate, tetrapotassium ethylenediaminetetraacetate, tetrasodium ethylenediaminetetraacetate, trisodium ethylenediaminetetraacetate, diethylenetriaminepentaacetic acid, pentasodium diethylenetriaminepentaacetate, ethylenediamine-N-(β-oxyethyl)-N,N',N'-triacetic acid, trisodium ethylenediamine-N-(β-oxyethyl)-N,N',N'-triacetate, triammonium ethylenediamine-N-(β-oxyethyl)-N,N',N'-triacetate, 1,2-diaminopropanetetraacetic acid, disodium 1,2-diaminopropanetetraacetate, 1,3-diaminopropanetetraacetic acid, diammonium 1,3-diaminopropanetetraacetate, nitrilotriacetic acid, trisodium nitrilotriacetate, cyclohexanediaminetetraacetic acid, disodium cyclohexanediaminetetraacetate, iminodiacetic acid, dihydroxyethyl glycine, ethyl ether diaminetetraacetic acid, glycol ether diminetetraacetic acid, ethylenediaminetetrapropionic acid, phenylenedinetetraacetic acid, 1,3-diaminopropanol-N,N,N',N'-tetramethylenephosphonic acid, ethylenediamine-N,N,N',N'-tetramethylenephosphonic acid and 1,3-propylenediamine-N,N,N',N'-tetramethylenephosphonic acid.

It is preferred that the processing solution having a bleaching ability contains a halide such as a chloride, bromide or iodide as a re-halogenating agent for accelerating the oxidation of silver in addition to the metal chelate compound functioning as a bleaching agent. Alternatively, an organic ligand which forms a sparingly soluble silver salt may be added in place of the halide. The halide is added in the form of an alkali metal salt or ammonium salt or a salt of guanidine or an amine. Examples of the halide include sodium bromide, ammonium bromide, potassium chloride and guanidine hydrochloride. Ammonium bromide is preferable. The re-halogenating agent is used in an amount of generally from 0 to 2.0 mol/l, preferably 0.01 to 2.0 mol/l, more preferably 0.1 to 1.5 mol/l, still more preferably 0.3 to 1.0 mol/l in the bleaching solution.

The bleach-fixing solution containing the metal chelate compound of the present invention contains a fixing agent (described hereinafter) and optionally the re-halogenating agent in addition to the metal chelate compound. When the re-halogenating agent is used in the bleach-fixing solution, the re-halogenating agent is used in an amount of from 0.001 to 2.0 mol/l, preferably from 0.01 to 1.0 mol/l.

In the present invention, the bleaching solution or the bleach-fixing solution may optionally contain a bleaching accelerator, a corrosion inhibitor for preventing the processing bath tank from being corroded, a buffering agent for maintaining the desired pH of the solution, a fluorescent brightener, anti-foaming agent, etc.

Examples of the bleaching accelerator include compounds having mercapto group or disulfide group as described in U.S. Pat. No. 3,893,858, German Patent 1,290,812, U.S. Pat. No. 1,138,842, JP-A-53-95630 and *Research Disclosure* No. 17129 (1978); thiazolidine derivatives as described in JP-A-50-140129; thiourea derivatives as described in U.S. Pat. No. 3,706,561; polyethylene oxides as described in German Patent 2,748,430; polyamine compounds as described in JP-B-45-8836; and imidazole compounds as described in JP-A-49-40493. Among them, the mercapto compounds described in U.S. Pat. No. 1,138,842 are preferable.

Preferred examples of the corrosion inhibitor include nitrates such as ammonium nitrate and potassium nitrate. The corrosion inhibitor is used in an amount of from 0.01 to 2.0 mol/l, preferably 0.05 to 0.5 mol/l.

In the present invention, the pH of the bleaching solution or the bleach-fixing solution is in the range of from 2.0 to 8.0, preferably 3.0 to 7.5. When bleaching or bleach-fixing is conducted immediately after color development, it is preferred that the pH of the solution is not higher than 6.0, and preferably not higher than 5.5 to inhibit bleach fog. When the pH is less than 2.0, the metal chelate compound of the present invention is unstable. Therefore, pH is preferably in the range of from 2.0 to 5.5. When color printing materials are used, the pH is preferably in the range of from 3 to 7 to prevent cyan dye from being converted to leuco dye.

The pH buffering agent is not particularly limited as long as the buffering agent is substantially not oxidized by the bleaching agent and provides buffer action in the pH range described above. Examples of useful buffering agents include organic acids such as acetic acid, glycolic acid, lactic acid, propionic acid, butyric acid, malic acid, chloroacetic acid, levulinic acid and ureidopropionic acid and organic bases such as pyridine, dimethylpyrazole, 2-methyl-o-oxazoline and aminoacetonitrile. Organic acids having a pKa of 2.0 to 5.5 are preferred in the present invention. Acetic acid and glycolic acid are particularly preferred. The buffering agent is used in an amount of from 0 to 3.0 mol/l, preferably 0.5 to 2.0 mol/l. The buffering agent may be used either alone or in a combination of two or more buffering agents.

The above-described acids may be used together with an alkali agent (e.g., ammonia water, KOH, NaOH, imidazole, monoethanolamine, diethanolamine) to adjust the pH of the processing solution having a bleaching ability to a value within the range described above. Among them, ammonia water is preferred.

It is preferred that when processing is conducted, the processing solution having a bleaching ability is aerated to oxidize the iron(II) complex salt formed therein, whereby the bleaching agent is reproducable and photographic performance is stable.

The bleaching or bleach-fixing step can be carried out at a temperature of from 30° to 50° C., preferably from 35° to 45° C. The time of the bleaching step and/or the bleach-fixing step is generally 10 seconds to 5 minutes, preferably 10 to 60 seconds in the case of a photographic material for photographing. The time is generally from 5 to 70 seconds, preferably from 5 to 60 seconds, more preferably from 5 to 30 seconds in the case of a print photographic material. Good results can be obtained under these preferred processing conditions under which processing is rapid and staining is not increased.

The fixing solution and the bleach-fixing solution of the present invention can contain a conventional fixing agents. Examples of the fixing agent include thiosulfates, thiocyanates, thioethers, amines, mercapto compounds, thiones, thioureas and iodides. More specifically, examples of the fixing agent include ammonium thiosulfate, sodium thiosulfate, potassium thiosulfate, guanidine thiosulfate, potassium thiocyanate, dihydroxyethyl thioether, 3,6-dithia-1,8-octanediol and imidazole. Among them, thiosulfates, particularly ammonium thiosulfate are preferred when rapid fixing is desired. More rapid fixing can be conducted by using two or more fixing agents in combination. For example, it is preferred that ammonium thiosulfate is used in combination with ammonium thiocyanate, imidazole, thiourea, thioether, etc. In this case, the second fixing agent is used in an amount of preferably 0.01 to 100 mol% based on the amount of ammonium thiosulfate.

The fixing agent is used in an amount of from 0.1 to 3.0 mol, preferably 0.5 to 2.0 mol per liter of the fixing solution or the bleach-fixing solution. The pH of the fixing solution varies depending on the type of fixing agent, but is generally in the range of from 3.0 to 9.0. Particularly, when thiosulfates are used, a pH of from 6.5 to 8.0 is preferred to obtain stable fixing performance.

Preservatives can be added to the fixing solution and/or the bleach-fixing solution to enhance the stability of the solution with time. When the fixing solution or the bleach-fixing solution contains thiosulfates, sulfites and/or bisulfite adducts of hydroxylamine, hydrazine and aldehydes (e.g., bisulfite adduct of acetaldehyde, particularly preferably bisulfite adducts of aromatic aldehydes described in JP-A-1-298935) are effective as preservatives. The sulfinic acid compounds described in JP-A-62-143048 are also preferred.

A buffering agent is preferably added to the fixing solution and/or the bleach-fixing solution to keep the pH of the solution constant. Examples of the buffering agent include phosphates, imidazoles such as imidazole, 1-methyl-imidazole, 2-methyl-imidazole and 1-ethylimidazole, triethanolamine, N-allylmorpholine and N-benzoylpiperazine. When a chelating agent is added to the fixing agent, iron ion carried over from the bleaching solution is sequestered to thereby improve the stability of the solution. Preferred examples of such a chelating agent include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethylenetriaminepentaacetic acid, cyclohexanediaminetetraacetic acid and 1,2-propanediaminetetraacetic acid.

The fixing step is conducted at a temperature of from 30° to 50° C., preferably 35° to 45° C. The time of the fixing step is from 35 seconds to 2 minutes, preferably from 40 to 100 seconds in the case of a photographic material for photographing. The time is from 10 to 70 seconds, preferably from 10 to 30 seconds in the case of a print photographic material.

The desilverization step of the present invention is carried out by a combination of a bleaching step and/or a bleach-fixing step. Typical examples of such combinations include the following.

(1) Bleaching and fixing
(2) Bleaching and bleach-fixing
(3) Bleaching, bleach-fixing, and fixing
(4) Bleaching, washing, and fixing
(5) Bleach-fixing
(6) Fixing and bleach-fixing In the case of a photographic material for photographing, the processing combinations (1), (2), (3) and (4) are preferred with (1), (2) or (3) being more preferred. In the case of a print photographic material, the processing combination (5) is preferred.

The present invention can be applied to the desilverization treatment by means of a stop bath, rinse bath, etc. after color development.

It is preferred that stirring is vigorously carried out as much as possible in the desilverization steps such as the bleaching, bleach-fixing and fixing steps to enhance the effect of the present invention.

Examples of methods for vigorously stirring include a method wherein a jet stream of the processing solution is directed to the emulsion surface of the light-sensitive material as described in JP-A-62-183460 and JP-A-62-183461; a method wherein a stirring effect is improved by using a rotating means as described in JP-A-62-183461; a method wherein the light-sensitive material is transferred while a wire blade provided in the solution is brought into contact with the emulsion surface to cause a turbulent flow on the emulsion surface, whereby stirring is improved; and a method wherein the circulating flow rate of the entire processing solution is increased. Such methods for improving stirring can be effectively applied to any of the bleaching solution, the bleach-fixing solution and the fixing solution. It is considered that the transport of the bleaching agent and the fixing agent into the emulsion layer is expedited by vigorous stirring, and as a result, the desilverization rate is increased.

The above-described vigorous stirring means are more effective when a bleaching accelerator is used. The bleaching accelerating effect is greatly increased by this technique, and the problem of a fixation inhibiting action is solved.

The above-described vigorous stirring can be preferably applied to the color developing solution, the rinsing solution and the stabilizing solution.

When a compound of formula (I) of the present invention is added to a color developing solution and a black-and-white developing solution, precipitation in the processing solution is prevented and the stability of the solution is improved.

The color developing solution of the present invention can contain conventional aromatic primary amine color developing agents. Preferred developing agents are p-phenylenediamine derivatives. Typical examples thereof include, but are not limited to, the following compounds.

D-1 N,N-Diethyl-p-phenylenediamine
D-2 2-Amino-5-diethylaminotoluene
D-3 2-Amino-5-(N-ethyl-N-laurylamino)toluene
D-4 4-[N-Ethyl-N-(β-hydroxyethyl)amino]aniline
D-5 2-Methyl-4-[N-ethyl-N-(β-hydroxyethyl-)amino]aniline
D-6 4-Amino-3-methyl-N-ethyl-N-[β-(methanesulfonamido)ethyl]aniline
D-7 N-(2-Amino-5-diethylaminophenylethyl)methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline
D-12 2-Methoxy-4-[N-ethyl-N-(β-hydroxyethyl-)amino]aniline Among the above-described p-phenylenediamine derivatives, D-5, D-6 and D-12 are preferable.

It is preferred that these p-phenylenediamine derivatives are used in the form of a salt such as a sulfate, hydrochloride, sulfite or p-toluenesulfonate. The aromatic primary amine color developing agent is used in an amount of preferably from 0.005 to 0.1 mol, more preferably from 0.01 to 0.06 mol per liter of the color developing solution.

The color developing solution may contain a sulfite such as sodium sulfite, potassium sulfite, sodium bisulfite, potassium bisulfite, sodium metabisulfite and potassium metabisulfite and carbonyl sulfite adducts as a preservative.

Further, it is preferred that the hydroxyl amines (e.g., those described in JP-A-63-5341 and JP-A-63-106655, preferably the compounds having a sulfo group or a carboxyl group), hydroxamic acids described in JP-A-63-43138, hydrazines and hydrazides described in JP-A-63-146041, phenols described in JP-A-63-44657 and JP-A-63-58443, α-hydroxyketones and α-aminoketones described in JP-A-63-44656 and/or various saccharide described in JP-A-63-36244 are directly added to the aromatic primary amine color developing agent.

In combination with the above-described compounds are preferably used the monoamines described in JP-A-63-4235, JP-A-63-24254, JP-A-63-21647, JP-A-63-146040, JP-A-63-27841 and JP-A-63-25654, the diamines described in JP-A-63-30845, JP-A-63-14640 and JP-A-63-43139, the polyamines described in JP-A-63-21647, JP-A-63-26655 and JP-A-63-44655, the nitroxy radicals described in JP-A-63-53551, the alcohols described in JP-A-63-43140 and JP-A-63-53549, the oximes described in JP-A-63-56654 and the tertiary, amines described in JP-A-63-239447.

Examples of other preservatives which may be contained in the developing solution of the present invention include various metals as described in JP-A-57-44148 and JP-A-57-53749, salicylic acids as described in JP-A-59-180588, alkanolamines as described in JP-A-54-3582, polyethyleneimines as described in JP-A-56-94349 and aromatic polyhydroxy compounds as described in U.S. Pat. No. 3,746,544. Among then, aromatic polyhydroxy compounds are preferable.

The preservative is used in an amount of from 0.005 to 0.2 mol, preferably from 0.01 to 0.05 mol per liter of the developing solution.

The pH of the color developing solution of the present invention is in the range of from 9 to 12, preferably from 9.5 to 11.5. The color developing solution may contain other compounds conventionally employed in a color developing solution.

A buffering agent is preferably used in the color developing solution of the present invention to maintain the pH in the range described above.

Examples of useful buffering agents include, but are not limited to, sodium carbonate, potassium carbonate, sodium bicarbonate, potassium bicarbonate, sodium tertiary phosphate, potassium tertiary phosphate, disodium hydrogenphosphate, dipotassium hydrogenphosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The buffering agent is preferably used in an amount of from at least 0.1 mol, particularly preferably 0.1 to 0.4 mol per liter of the color developing solution.

In the present invention, various chelating agents can be added to the color developing solution in such an amount that the chelating agents do not diminish the effect of the present invention, or otherwise interfere with the compounds of the present invention.

Organic acid compounds are preferred as chelating agents. Examples thereof include aminopolycarboxylic acids, organic phosphonic acids and phosphonocarboxylic acids. More specifically, examples of these acids include, but are not limited to, nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, hydroxyethyliminodiacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid.

These chelating agents may be used either alone or in a combination of two or more of the chelating agents.

The chelating agent is used in an amount sufficient to sequester metal ions in the color developing solution. For example, the chelating agent is used in an amount of from 0.001 to 0.05 mol/l, preferably from 0.003 to 0.02 mol/l.

The color developing solution of the present invention may contain a development accelerator.

Examples of the development accelerator include the thioether compounds described in JP-B-37-16088, JP-B-37-5987, JP-B-38-7826, JP-B-44-12380, JP-B-45-9019, U.S. Pat. No. 3,818,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883 and U.S. Pat. No. 3,532,501; and imidazoles such as 2-methylimidazole and imidazole.

It is preferred that a 1-phenyl-3-pyrazolidone as an auxiliary developing agent is added to conduct rapid development. Examples thereof include the following compounds.

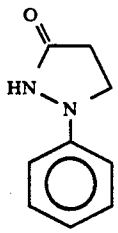
AD-1

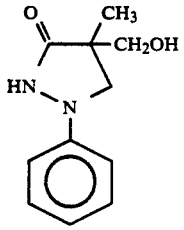
AD-2

-continued

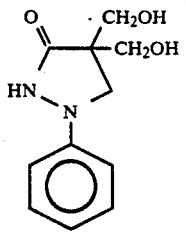
AD-3

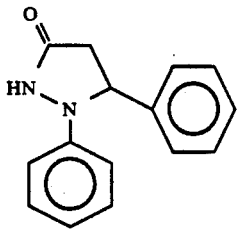
AD-4

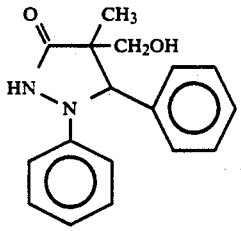
AD-5

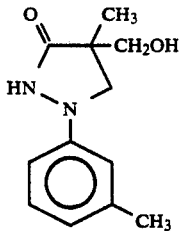
AD-6

These auxiliary developing agent is used in an amount of from 0.0005 to 0.03 mol, preferably from 0.001 to 0.01 mol per liter of the color developing solution.

If desired, the color developing solution of the present invention may contain an anti-fogging agent. Examples of the anti-fogging agent include alkali metal halides such as sodium chloride, potassium bromide and potassium iodide and organic anti-fogging agents. Typical examples of the organic anti-fogging agents include nitrogen-containing heterocyclic compounds such as benztriazole, 6-nitrobenzimidazole, 5-nitroisoindazole, 5-methylbenztriazole, 5-nitrobenztriazole, 5-chlorobenztriazole, 2-thiazolylbenzimidazole, 2-thiazolyl-methyl-benzimidazole, indazole, hydroxyazaindolizine and adenine.

The color developing solution of the present invention may contain a fluorescent brightener. Preferred examples of the fluorescent brightener include 4,4'-diamino-2,2'-disulfostilbene compounds. The compound is used in an amount of from 0 to 5 g/l, preferably from 0.1 to 4 g/l.

If desired, various surfactants such as alkylsulfonic acids, arylsulfonic acids, aliphatic carboxylic acids and aromatic carboxylic acids may be added to the color developer solution.

The processing temperature using the color developing solution of the present invention is in the range of from 20° to 55° C., preferably 33° to 55° C.

The processing time is from 20 seconds to 5 minutes, preferably from 30 seconds to 3 minutes and 20 seconds, more preferably from 1 to 2 minutes and 30 seconds in the case of a color photographic material for photographing. The time is from 10 to 80 seconds, preferably from 20 to 60 seconds in the case of a print photographic material.

Black-and-white developing solutions which are first used in reversal color processing and contain a compound of the present invention and black-and-white developing solutions which are used for processing black-and-white silver halide photographic materials which contain a compound of the present invention can contain various additives conventionally used in such developing solutions.

Typical examples of the additives include developing agents such as 1-phenyl-3-pyrazolidone, Metol and hydroquinone, preservatives such as sulfites, accelerators comprising alkalis such as sodium hydroxide, sodium carbonate and potassium carbonate, inorganic or organic inhibitors such as potassium bromide, 2-methylbenzimidazole and methylbenzthiazole, hard water softeners such as polyphosphates and development restrainers comprising a very small amount of an iodide or a mercapto compound.

The effect of the present invention can also be obtained by adding a compound of formula (I) of the present invention to a rinsing water or stabilizing solution.

The processing method of the present invention comprises basically the aforesaid color development step and the subsequent desilverization step. A rinsing step and/or a stabilization step subsequent to these steps is preferably carried out.

Rinsing water for use in the rinsing step may contain various surfactants to prevent unevenness caused by water droplets during the drying step of the photographic material after processing. Examples of useful surfactants include polyethylene glycol type nonionic surfactants, polyhydric alcohol type nonionic surfactants, alkylbenzenesulfonate type anionic surfactants, higher alcohol sulfuric ester salt type anionic surfactants, alkylnaphthalenesulfonate type anionic surfactants, quaternary ammonium salt type cationic surfactants, amine salt type cationic surfactants, amino acid type ampholytic surfactants and betaine type ampholytic surfactants. When ionic surfactants are used, there is a possibility that the surfactant becomes bonded to various ions introduced by processing to form precipitates. Accordingly, the use of nonionic surfactants is preferable. Particularly, alkylphenol ethylene oxide adducts are preferred. Octylphenol, nonylphenol, dodecylphenol and dinonylphenol are particularly preferred as the alkylphenol. The addition of ethylene oxide is preferably 8 to 14 moles. Further, silicone surfactants having a high anti-foaming effect are preferably used.

The rinsing water may contain various anti-bacterial agents and antifungal agents to prevent bacteria from proliferating or to prevent mold from being grown on the processed photographic material. Examples of useful anti-bacterial agents and antifungal agents include the thiazolylbenzimidazole compounds described in JP-A-57-157244 and JP-A-58-105145, the isothiazolone compounds described in JP-A-54-27424 and JP-A-57-8542, chlorophenol compounds such as trichlorophenol, bromophenol compounds, organotin compounds, organozinc compounds, thiocyanic acid or isothiocyanic acid compounds, acid amide compounds, diamine compounds, triazine compounds, thiourea compounds, benztriazole alkylguanidine compounds, quaternary ammonium salts such as benzammonium chloride, antibiotics such as penicillin and the general-purpose antifungal agents described in *J. Antibact. Antifung. Agents*, Vol. 1, No. 5, pp. 207–223 (1983). These agents may be used either alone or in combination thereof.

Furthermore, the various germicides described in JP-A-48-83820 can be used.

Chelating agents can be added to the rinsing water in such an amount that they do not interfere with the effect of the compound of formula (I) of the present invention.

Preferred examples of the chelating agents include aminopolycarboxylic acids such as ethylenediaminetetraacetic acid and diethylenetriaminepentaacetic acid, organic phosphonic acids such as 1-hydroxyethylidene-1,1-diphosphonic acid and ethylenediamine-N,N,N',N'-tetramethylenephosphonic acid and hydrolyzates of maleic anhydride polymers described in European Patent 345172A1.

The same preservatives contained in the fixing solution and the bleach-fixing solution are also preferably contained in the rinsing water.

A processing solution used to stabilize a dye image is used as a stabilizing solution in the stabilization step. Examples of the stabilizing solution include a solution containing an organic acid, solutions having a buffer ability at a pH of 3 to 6 and solutions containing aldehydes (e.g., formalin, glutaraldehyde). The stabilizing solution may also contain any of compounds which can be added to the rinsing water. In addition thereto, ammonium compounds such as ammonium chloride and ammonium sulfite, compounds of metals such as Bi and Al, fluorescent brighteners, various dye stabilizers such as N-methylol compounds and stabilizing method using the same as described in JP-A-2-153350, JP-A-2-153348 and U.S. Pat. No. 4,859,574, hardening agents and alkanolamines described in U.S. Pat. No. 4,786,583 may be used.

Multi-stage countercurrent systems are preferred in the rinsing step and the stabilization step. The number of stages is preferably 2 to 4. Replenishment rate per unit area is 1 to 50 times, preferably 2 to 30 times, more preferably 2 to 15 times the amount carried over from the prebath.

Tap water can be used as the water in the rinsing step and the stabilization step. Ion-exchanged (deionized) water is preferably used having a Ca and Mg concentration each of 5 mg/l or less by treating water with an ion exchange resin, and water which is sterilized by a halogen or ultraviolet sterilization lamp is also preferably used.

Tap water may be used to compensate for water lost by evaporation. However, deionized water or sterilized water which is preferably used in the rinsing step and the stabilization step is preferable.

In the present invention, an appropriate amount of water or replenisher is fed to the bleaching solution and the bleach-fixing solution as well as other the processing solutions to correct concentration caused by evaporation.

Overflow from the rinsing step and the stabilization step can be directed to a bath having a fixing ability which is a prebath, whereby the amount of waste solution is reduced.

The stirring of each processing solution of the present invention is preferably enhanced as much as possible. Examples of methods for enhancing stirring include a method wherein a jet stream of the processing solution is directed to the emulsion surface of the photographic material as described in JP-A-62-183460; a method wherein a stirring effect is improved by using a rotating means as described in JP-A-62-18346; a method wherein the photographic material is transferred while the emulsion surface is brought into contact with a wire blade or squeeze roller provided in the solution to provide turbulent flow on the emulsion surface, whereby a stirring effect is improved; and a method wherein the circulating flow rate of the entire processing solution is increased.

The processing method of the present invention is preferably carried out using an automatic processor. Conveying methods for an automatic processor are described in JP-A-60-191257, JP-A-60-191258 and JP-A-60-191259. It is desirable that cross-over time between processing baths in the automatic processor is short to carry out rapid processing with the processing composition of the present invention. An automatic processor wherein cross-over time is not longer than 10 seconds is described in JP-A-1-319038.

When processing is continuously carried out according to the processing method of the present invention by using an automatic processor, the replenisher is preferably added in an amount depending on the amount of the photographic material processed to supplement the consumed ingredients in the processing solution and to inhibit the accumulation of undesirable components in the processing solution. The undesirable components are generally dissolved out from the photographic material. Each processing step may comprise two or more processing bath tanks. In this case, a countercurrent system wherein the replenisher is allowed to flow from the rear bath into the prebath is preferred. A cascade having 2 to 4 stages is preferred for the rinsing step and the stabilization step in particular.

The amount of the replenisher is preferably reduced, so long as a change in the composition of each processing solution does not lower photographic performance or cause staining.

The amount of replenisher of the color developing solution is from 100 to 1500 ml, preferably from 100 to 1000 ml per $m^2$ of the photographic material in the case of a color photographic material for photographing. The amount of the replenisher is from 20 to 500 ml, preferably from 20 to 220 ml, more preferably from 30 to 200 ml, most preferably from 30 to 160 ml in the case of a color print material.

The amount of the replenisher of the bleaching solution is from 10 to 500 ml, preferably from 10 to 160 ml per $m^2$ of the photographic material in the case of a photographic material for photographing. The amount of the replenisher is from 20 to 300 ml, preferably from 50 to 150 ml in the case of a print material.

The amount of the replenisher of the bleach-fixing solution is from 100 to 3000 ml, preferably from 200 to 1300 ml per m2 of a photographic material for photographing. The amount of the replenisher is from 20 to 300 ml, preferably from 50 to 200 ml in the case of a photographic print material. The replenishment of the bleach-fixing solution may be made by a single solution, or by dividing the solution into a bleaching composition and a fixing composition. If desired, the replenisher of the bleach-fixing solution may be provided by mixing overflow from the bleaching bath and/or the fixing bath.

The amount of the replenisher of the fixing solution is from 300 to 3000 ml, preferably, from 300 to 1000 ml per $m^2$ of the photographic material in the case of a photographic material for photographing. The amount of the replenisher is from 20 to 300 ml, preferably from 50 to 200 ml in the case of a photographic print material.

The replenishment rate of rinsing water or the stabilizing solution per unit area is 1 to 50 times, preferably 2 to 30 times, more preferably 2 to 15 times the amount carried over from the prebath.

In view of environmental concerns, the amount of the replenisher is further reduced by combining various regeneration methods. Regeneration may be carried out while the processing solution is circulated in the automatic processor. Alternatively, regeneration may be carried out in such a manner that after the processing solution used is removed from the processing tank, the solution is subjected to an appropriate regeneration treatment and the regenerated solution as a replenisher is again returned to the processing tank.

The developing solution can be regenerated by an ion exchange treatment with an anion exchange resin, the removal of accumulated materials with electrodialysis treatment and/or the addition of a regenerant. The regeneration ratio is preferably at least 50%, more preferably at least 70%. Commercially available anion exchange resins can be used, but an ion exchanger having high selectivity described in JP-A-63-11005 is preferred.

The metal chelate bleaching agent in the bleaching solution and/or the bleach-fixing solution is brought into a reduced state with the bleaching treatment. When the metal chelate in the reduced state is accumulated, bleaching performance is lowered. Furthermore, the dye of the dye image can be converted to a leuco dye to result in a lowering of the image density. Accordingly, it is desirable that the bleaching solution and/or the bleach-fixing solution is continuously subjected to a regeneration treatment in during processing. For example, air can be blown into the bleaching solution and/or the bleach-fixing solution by means of an air pump to re-oxidize, i.e., aerate the metal chelate in the reduced state with oxygen. The bleaching solution and/or the bleach-fixing solution can be regenerated by adding an oxidizing agent such as hydrogen peroxide, persulfate or bromate.

The regeneration of the fixing solution and the bleach-fixing solution can be achieved by electrolytically reducing accumulated silver ion. It is also preferred for retaining fixing performance that accumulated halogen ion be removed using an anion exchange resin.

Ion exchange or ultrafiltration can be used to reduce the amount of rinsing water. Ultrafiltration is particularly preferred.

Examples of the photographic materials which can be processed with the processing composition of the present invention include general-purpose black-and-white silver halide photographic materials (e.g., black-and-white photographic materials for photographing, X-ray black and white photographic materials, black-and-white photographic materials for printing), general-purpose multi-layer silver halide color photographic materials (e.g., color negative film, reversal color films, color positive films, movie color negative films, color photographic paper, reversal color photographic paper, direct positive color photographic paper), infrared light-sensitive photographic materials for laser scanner and diffusion transfer photographic materials (e.g., silver diffusion transfer photographic materials, color diffusion transfer photographic materials).

The photographic materials for processing in accordance with the present invention may have various layer structures (e.g., red-sensitive, green-sensitive and blue-sensitive silver halide emulsion layers, undercoat layer, antihalation layer, filter layer, interlayer, surface protective layer) on one side or both sides of the support according to the intended purpose. The arrangement of the layers is not particularly limited.

There are no particular limitations with regard to the support for the photographic material for processing in accordance with the present invention; coating methods; the types of silver halide (e.g., silver iodobromide, silver iodochlorobromide, silver bromide, silver chlorobromide, silver chloride) used in the silver halide emulsion layers and the surface protective layer, the shape of the grains (e.g., cube, tabular form, sphere), grain size, coefficient of variation, crystal structure e.g., core/shell structure, polyphase structure, uniform phase structure), method for preparing the grains (e.g., single jet process, double jet process), binders (e.g., gelatin), hardening agents, anti-fogging agents, metal doping agents, solvents for silver halide, thickeners, emulsion precipitants, dimensional stabilizers, adhesion inhibitors, stabilizers, stain inhibitors, dye image stabilizers, anti-staining agents, chemical sensitizing agents, spectral sensitizing agents, sensitivity increasers, supersensitizing agents, nucleating agents, couplers (e.g., pivaloyl acetanilide type and benzoylacetanilide type yellow couplers, 5-pyrazolone type and pyrazoloazole type magenta couplers, phenol type and naphthol type cyan couplers, DIR couplers, bleaching accelerator-releasing type couplers, competitive couplers, colored couplers), coupler dispersion methods (e.g., oil-in-water dispersion methods using high-boiling solvents), plasticizers, antistatic agents, lubricants, coating aids, surfactants, brighteners, formalin scavengers, light scattering agents, matting agents, light absorbers, filter dyes, irradiation preventing dyes, development improvers, delustering agents, antiseptic agents (e.g., 2-phenoxyethanol), antifungal agents, etc. in the present invention. Those described in *Product Licensing*, Vol. 92, pp. 107–110 (December, 1971), *Research Disclosure* (hereinafter referred to as RD) No. 17643 (December, 1978), RD No. 18716 (November 1979), and RD No. 307105 (November, 1989) can be applied to the photographic material for processing in accordance with the present invention.

The photographic material suited for the processing in accordance with the present invention may comprise a support having thereon at least one silver halide emulsion layer comprising a blue-sensitive layer, a green-sensitive layer and a red-sensitive layer. There is no particular limitation with regard to the number of layers of silver halide emulsion layers and light-insensitive layers and the order of the layers. A typical example of the photographic material is a silver halide photographic material comprising a support having thereon a light-sensitive layer comprising a plurality of silver halide emulsion layers having substantially the same color sensitivity and different light sensitivity. Such a light-sensitive layer is a unit light-sensitive layer having a color sensitivity to any one of blue light, green light and red light. In a multi-layer silver halide color photographic material, the unit light-sensitive layer is generally arranged in the order of a red-sensitive layer, a green-sensitive layer and then a blue-sensitive layer on the support. However, this arrangement may be in the reverse order to that described above according to the intended purpose. Furthermore, the arrangement may be such that a layer having a different color sensitivity is interposed between layers having the same color sensitivity.

A light-insensitive layer such as an interlayer may be provided between the silver halide light-sensitive layers or as the uppermost layer and the lowermost layer.

The interlayer may contain a coupler and DIR compound as described in JP-A-61-43748, JP-A-59-113438, JP-A-59-113440, JP-A-61-20037 and JP-A-61-20038 and may further contain conventional color mixing inhibitors, ultraviolet light absorbers and anti-staining agents.

A plurality of silver halide emulsion layers which constitute each unit light-sensitive layer preferably have a two layer structure consisting of a high-snsitivity emulsion layer and a low-sensitivity emulsion layer as described in West German Patent 1,121,470 and U.K. Patent 923,045. Generally, it is preferred that the emulsion layers are arranged such that light sensitivity decreases in order toward the support. A light-insensitive layer may be provided between the silver halide emulsion layers. Alternatively, a low-sensitivity emulsion layer may be provided farther from the support than the high-sensitivity emulsion layer, and a high-sensitivity emulsion layer may be provided nearer the support as described in JP-A-57-112751, JP-A-62-200350, JP-A-62-206541 and JP-A-62-206543.

For example, a low-sensitivity blue-sensitive layer (BL)-high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer can be provided in this order from the side which is farthest away from the support. If desired, the layers can be arranged in order of BH/BL/GL/GH/RH/RL or BH/BL/GH/GL/RL/RH.

Furthermore, a blue-sensitive layer/GH/RH/GL/RL can be arranged in this order from the side which is farthest away from the support as described in JP-B-55-34932. A blue-sensitive layer/GL/RL/GH/RH in this order can be arranged from the side which is farthest away from the support as described in JP-A-56-25738 and JP-A-62-63936.

Furthermore, a three layer structure can be used comprising three layers having different light sensitivity. The light sensitivity is decreased in order toward the support. The upper layer is a silver halide emulsion layer having the highest light sensitivity, the intermediate layer is a silver halide emulsion layer having a lower light sensitivity than that of the upper layer, and the lower layer is a silver halide emulsion layer having a lower light sensitivity than that of the intermediate layer as described in JP-B-49-15495. Even when the emulsion layers have such a three layer structure, medium-sensitivity emulsion layer/high-sensitivity emulsion layer/low-sensitivity emulsion layer in this order may be arranged in the same color sensitivity layer from the side which is farther away from the support as described in JP-A-59-202464.

Various layer structure and arrangements can be selected according to the intended purpose of the photographic material.

Any of the above described layer arrangements can be used in the color photographic material for processing in accordance with the present invention. It is preferred for achieving the objects of the present invention that the dry thickness of the entire constituent layers of the color photographic material for processing in accordance with the present invention is 20.0 μm or less excluding the support and the undercoat and back layer of the support. More preferably, the dry thickness is 18.0 μm or less.

In the preferred dry thickness, the formation of bleach fog caused by the remaining color developing agent in the photographic material and stain formed during the storage of the image after processing are inhibited.

The layer thickness is desirably reduced to the extent that the performance of the photographic material is not deteriorated. The lower limit of the dry thickness of the entire constituent layers of the photographic material is 12.0 μm excluding the support and the undercoat layer of the support. The lower limit of the entire dry thickness of a constituent layer provided between the undercoat layer of the support and the light-sensitive layer nearest the support is 1.0 μm.

The reduction of the layer thickness may be accomplished by any of the light-sensitive layer and the light-insensitive layer.

The layer thickness of a multi-layer color photographic material for processing in accordance with the present invention is measured in the following manner.

The photographic material to be measured is stored at 25° C. and 50% RH for 7 days after the preparation thereof. The overall thickness of the photographic material is first measured. The coated layers on the support are removed and the thickness of the residue is again measured. A difference therebetween is the thickness of the entire coated layers excluding the support of the photographic material. The measurement of the thickness is made, for example, by using a layer thickness measuring device (Anritsu Electric Co., Ltd., K-402B Stand.) using a contact type piezo-electric transducing element. The coated layers on the support can be removed by using an aqueous solution of sodium hypochlorite.

Subsequently, a photograph of the cross section of the photograph is taken (preferably at least 3,000× magnification) using a scanning type electron micrograph. The overall thickness of the layers on the support and the thickness of each layer are measured and compared with the measured value (the absolute value of actual measurement) of the overall thickness measured by using the above layer thickness measuring device, whereby the thickness of each layer is calculated.

The swelling ratio [(equilibrium swelling layer thickness in $H_2O$ at 25° C.—overall dry layer thickness at 25° C. and 55% RH)/overall dry layer thickness at 25° C. and 55% RH×100] of the photographic material for processing in accordance with the present invention is preferably 50 to 200%, more preferably 70 to 150%. When the swelling ratio is outside the range described above, the amount of the color developing agent remaining after processing is increased and photographic performance, image quality (e.g., desilverization degree) and layer physical properties such as layer strength are adversely affected.

The swelling rate $T_{\frac{1}{2}}$ of the photographic material of the present invention is preferably 15 seconds or shorter wherein the swelling rate $T_{\frac{1}{2}}$ is defined by the time which has elapsed until the layer thickness reaches ½ of the saturated swelling layer thickness, 90% of the maximum swelling layer thickness in color developing solution (30° C., 3 minutes and 15 sec) being referred to as the saturated swelling layer thickness. More preferably, $T_{\frac{1}{2}}$ is 9 seconds or less.

The silver halide to be contained in the photographic emulsion layers of the color photographic material for processing in accordance with the present invention may have any silver halide composition. Namely, any of silver chloride, silver bromide, silver chlorobromide, silver iodobromide, silver iodochloride and silver iodochlorobromide can be used.

When color photographic materials for photographing and reversal color photographic materials (e.g., color negative films, reversal films, reversal color paper) are to be prepared, silver iodobromide, silver iodochloride or silver iodochlorobromide is preferred, each having a silver iodide content of 0.1 to 30 mol %. When direct positive color photographic materials are to be prepared, silver bromide or silver chlorobromide is preferred. When photographic materials for paper are to be prepared, silver chloride or silver chlorobromide is preferred.

Silver halide grains in the photographic emulsions may have a regular crystal form such as a cube, octahedron or tetradecahedron, an irregular crystal form such as a sphere or tabular form, a crystal form having defect such as twin plane or a composite form thereof.

With regard to grain size, silver halide grains may range from fine grains having a grain size of not larger than about 0.2 μm to large-size grains having a grain size of about 10 μm in terms of the diameter of a sphere having an area equal to the projected area of the grain. Any of a polydisperse emulsion and monodisperse emulsion can be used.

Photographic silver halide emulsions for use in a photographic material for processing in accordance with the present invention can be prepared, for example, by the methods described in *Research Disclosure* (RD), No. 17643 (December, 1978), pp. 22–23; ibid. No. 307105 (November, 1989), pp. 863–865, "I. Emulsion Preparation and Types"; ibid. No. 18716 (November, 1979) page 648; P. Glafkides, *Chimie et Physique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964).

Monodisperse emulsions described in U.S. Pat. Nos. 3,574,628 and 3,655,394 and U.K. Patent 1,413,748 are preferred.

Tabular grains having an aspect ratio of not lower than about 5 can be used in the photographic material for processing in accordance with the present invention. The tabular grains can be easily prepared by methods described in Gutoff, *Photographic Science and Engineering*, Vol. 14, pp. 248–257 (1970), U.S. Pat. Nos. 4,434,226, 4,414,310, 4,433,048 and 4,439,520 and U.K. Patent 2,112,157.

The crystal structure may be uniform or constitute a phase structure where the interior of the grain is different in halogen composition from the surface layer thereof. Silver halide grains having different compositions may be joined by epitaxial growth. Grains may be joined to a compound such as silver rhodanine or lead oxide other than a silver halide.

If desired, mixtures of grains having various crystal forms may be used.

The silver halide emulsions are usually subjected to physical ripening, chemical ripening and spectral sensitization and used. Additives used in these stages are described in *Research Disclosure* No. 17643, ibid. No. 18716 and ibid. No. 307105 and indicated in the following Table.

Conventional photographic additives which can be used in a photographic material for processing in accordance with the present invention are also described in the above three *Research Disclosures* and indicated in the following Table.

| Type of additive | RD17643 [Dec. '78] | RD18716 [Nov. '79] | RD307105 [Nov. '89] |
|---|---|---|---|
| 1. Chemical sensitizing agent | p. 23 | p. 643 right column (RC) | p. 866 |
| 2. Sensitivity increaser | | p. 643 right column (RC) | |
| 3. Spectral sensitizer and supersensitizer | pp. 23–24 | p. 648 RC–p. 649 RC | pp. 866–868 |
| 4. Brightening agent | p. 24 | p. 647 RC | p. 868 |
| 5. Antifoggant and stabilizer | pp. 24–25 | p. 649 RC | pp. 868–870 |
| 6. Light absorbent, filter dye, and ultraviolet absorbent | pp. 25–26 | p. 649 RC–p. 650 left column (LC) | p. 873 |
| 7. Stain inhibitor | p. 25 RC | p. 650 LC–RC | p. 872 |
| 8. Dye image stabilizer | p. 25 | p. 650 LC | p. 872 |
| 9. Hardening agent | p. 26 | p. 651 LC | pp. 874–875 |
| 10. Binder | p. 26 | p. 651 LC | pp. 873–874 |
| 11. Plasticizer and lubricant | p. 27 | p. 650 RC | p. 876 |
| 12. Coating aid and surface active agent | pp. 26–27 | p. 650 RC | pp. 875–876 |
| 13. Antistatic agent | p. 27 | p. 650 RC | pp. 876–877 |
| 14 Matting agent | | | pp. 878–879 |

Various color couplers can be used in the photographic material for processing in accordance with the present invention. Useful examples of the color couplers are described in the patent specifications cited in the aforesaid RD No. 17643, VII-C-G and ibid. No. 307105, VII-C-G and JP-A-62-215272.

Preferred examples of yellow couplers include those described in U.S. Pat. Nos. 3,933,501, 4,022,620, 4,326,024, 4,401,752 and 4,248,961, JP-B-58-10739, U.K. Patents 1,425,020 and 1,476,760, U.S. Pat. Nos. 3,973,968, 4,314,023 and 4,511,649 and European Patent 249,473A.

Preferred examples of magenta couplers include 5-pyrazolone compounds and pyrazoloazole compounds. Magenta couplers described in European Patent 73,636, U.S. Pat. Nos. 4,310,619, 4,351,897, 3,061,432, 3,725,064, 4,500,630, 4,540,654 and 4,556,630, *Research Disclosure* (RD) No. 24220 (June, 1984), RD No. 24230 (June, 1984), JP-A-60-33552, JP-A-60-43659, JP-A-61-72238, JP-A-60-35730, JP-A-55-118034, JP-A-60-185951 and WO(PCT) 88/04795 are particularly preferred. The present invention is particularly effective in solving the problem of bleach fog and stain caused by pyrazoloazole couplers.

Examples of useful cyan couplers include phenol couplers and naphthol couplers. Cyan couplers described in U.S. Pat. Nos. 4,052,212, 4,146,396, 4,228,233, 4,296,200, 2,369,939, 2,801,171, 2,772,162, 2,895,826, 3,772,002, 3,758,308, 4,334,011 and 4,327,173, West German Patent Application (OLS) No. 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199 and JP-A-61-42658 are preferred.

Preferred examples of colored couplers for correcting unnecessary absorption of developed dyes include those described in *Research Disclosure* (RD) No. 17643, item VII-G, U.S. Pat. No. 4,163,670, JP-B-57-39413, U.S. Pat. Nos. 4,004,929 and 4,138,258 and U.K. Patent 1,146,368. It is preferred to use couplers for correcting unnecessary absorption of developed dyes by fluorescent dyes released during coupling as described in U.S. Pat. No. 4,774,181 and couplers having, as an eliminable group, a dye precursor group which reacts with a developing agent to form a dye as described in U.S. Pat. No. 4,777,120.

Preferred examples of couplers which provide a developed dye having a proper diffusibility include those described in U.S. Pat. No. 4,366,237, U.K. Patent 2,125,570, European Patent 96,570 and West German Patent Application (OLS) No. 3,234,533.

Typical examples of dye forming polymer couplers include those described in U.S. Pat. Nos. 3,451,820, 4,080,211, 4,367,282, 4,409,320 and 4,576,910 and U.K. Patent 2,102,179.

Couplers which release a photographically useful residue upon coupling are preferably used in a photographic material for processing in accordance with the present invention. Preferred examples of DIR couplers which release a development restrainer include those described in the patent specifications cited in *Research Disclosure* (RD) No. 17643, item VII-F, JP-A-57-151944, JP-A-57-154234, JP-A-60-184248, JP-A-63-37346, U.S. Pat. Nos. 4,248,962 and 4,782,012.

Preferred examples of couplers which imagewise release a nucleating agent or a development accelerator include those described in U.K. Patents 2,097,140 and 2,131,188, JP-A-59-157638 and JP-A-59-170840.

Examples of other couplers which can be used in a photographic material for processing in accordance with the present invention include competitive couplers described in U.S. Pat. No. 4,130,427; polyequivalent type couplers described in U.S. Pat. Nos. 4,283,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers which release a dye which restores its original color after elimination as described in European Patent 173,302A; bleaching accelerator-releasing couplers described in *Research Disclosure* (RD) No. 11449, ibid No. 24241 and JP-A-61-201247; ligand releasing couplers described in U.S. Pat. No. 4,553,477; leuco dye-releasing couplers described in JP-A-63-75747; and fluorescent dye-releasing couplers described in U.S. Pat. No. 4,774,181.

The couplers for use in a photographic material for processing in accordance with the present invention can be introduced into the photographic material by various conventional dispersion methods.

Examples of high-boiling solvents which are used for oil-in-water dispersion methods are described in U.S. Pat. No. 2,322,027, etc. Useful examples of high-boiling organic solvents which have a boiling point of not lower than 175° C. under atmospheric pressure and are used in the oil-in-water dispersion methods include phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl)phthalate, etc.); phosphoric esters and phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexyl phenyl phosphate, etc.); benzoic esters (e.g., 2-ethylhexyl benzoate, dodecyl benzoate, 2-ethylhexyl p-hydroxybenzoate, etc.); amides (e.g., N,N-diethyldodecaneamide, N,N-diethylaurylamide, N-tetradecylpyrrolidone, etc.); alcohols and phenols (e.g., isostearyl alcohol, 2,4-di-t-amylphenol, etc.); aliphatic carboxylic acid esters (e.g., bis(2-ethylhexyl) sebacate, dioctyl azelate, glycerol tributyrate, isostearyl lactate, trioctyl citrate, etc.); aniline derivatives (e.g., N,N-dibutyl-2-butoxy-5-t-octylaniline, etc.); and hydrocarbons (e.g., paraffin, dodecylbenzene, diisopropylnaphthalene, etc.). Organic solvents having a boiling point of not lower than about 30° C., preferably not lower than 50° C., but not higher than about 160° C. can be used as co-solvents. Typical examples of the co-solvents include ethyl acetate, butyl acetate, ethyl propionate, methyl ethyl ketone, cyclohexanone, 2-ethoxyethyl acetate and dimethylformamide.

Examples of the stages and effects of latex dispersion methods and impregnating latexes are described in U.S. Pat. No. 4,199,363 and West German Patent Application (OLS) Nos. 2,541,274 and 2,541,230.

The couplers are impregnated with loadable latex polymer (e.g., described in U.S. Pat. No. 4,203,716) in the presence or absence of the above noted high-boiling organic solvent or dissolved in a water-insoluble, organic solvent-soluble polymer to be dispersed in an aqueous solution of a hydrophilic colloid.

Preferably, the homopolymers or copolymers described in WO(PCT) 88/00723 (pages 12–30) are used. Acrylamide polymers are particularly preferred for stabilization of the dye image.

The photographic material for processing in accordance with the present invention may contain a developing agent. Examples of the developing agent which can be contained in the photographic material are described in RD No. 17643 (Developing Agents of page 29). Hydroquinones and pyrazolidones are particularly preferred.

Examples of supports for use in a photographic material for processing in accordance with the present invention are described in RD No. 17643 (page 28) and ibid. No. 18716 (page 647 right column to page 648 left column).

The present invention is now illustrated in greater detail by reference to the following examples which, however, are not to be construed as limiting the invention in any way.

EXAMPLE I-1

An undercoated cellulose triacetate film support was coated with the following layers having the following compositions to prepare a multi-layer color photographic material s sample 101.

Composition of Light-Sensitive Layer

Each layer had the following composition. Numerals represent coating weight (g/m$^2$). The amounts of silver halide emulsions and colloidal silver are coating weights (g/m$^2$) in terms of silver. The amounts of sensitizing dyes are represented by moles per one mole of silver halide in the same layer.

| | |
|---|---|
| First Layer: Antihalation Layer | |
| Black colloidal silver | 0.2 (as silver) |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Second Layer: Interlayer | |
| Fine silver bromide grains (grain size: 0.07 μm in terms of a diameter of a sphere) | 0.15 (as silver) |
| Gelatin | 1.0 |
| Cpd-2 | 0.2 |
| Third Layer: First Red-Sensitive Emulsion Layer | |
| Silver iodobromide emulsion (AgI content 10.0 mol %, internal high AgI type, grain size: 0.7 μm (in terms of a diameter of a sphere), a coefficient of variation in grain size (in terms of a diameter of a sphere): 14%, tetradecahedral grains) | 0.26 (as silver) |
| Silver iodobromide emulsion (AgI content 4.0 mol %, internal high AgI type, grain size: 0.4 μm (in terms of a diameter of a sphere), a coefficient of variation in grain size (in terms of a diameter of a sphere): 22%, tetradecahedral grains) | 0.2 (as silver) |
| Gelatin | 1.0 |
| ExS-1 | $4.5 \times 10^{-4}$ |
| ExS-2 | $1.5 \times 10^{-4}$ |
| ExS-3 | $0.4 \times 10^{-4}$ |
| ExS-4 | $0.3 \times 10^{-4}$ |
| ExC-1 | 0.15 |
| ExC-7 | 0.15 |
| ExC-2 | 0.009 |
| ExC-3 | 0.023 |
| ExC-6 | 0.14 |
| Fourth Layer: Second Red-Sensitive Emulsion Layer | |
| Silver iodobromide emulsion (AgI content: 16 mol %, internal high AgI type, grain size: 1.0 μm (in terms of a diameter of a sphere), a coefficient of variation in grain size (in terms of a diameter of a sphere): 25%, tabular grains, ratio of diameter/thickness: 4.0) | 0.55 (as silver) |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExC-4 | $0.3 \times 10^{-4}$ |
| ExC-3 | 0.05 |
| ExC-4 | 0.10 |
| ExC-6 | 0.08 |
| Fifth Layer: Third Red-Sensitive Emulsion Layer | |
| Silver iodobromide emulsion (AgI content: 10.0 mol %, internal high AgI type. grain size: 1.2 um (in terms of a diameter of a sphere), a coefficient of variation in grain size (in terms of a diameter of a sphere): 28%, tabular grains, ratio of diameter/thickness: 6) | 0.9 (as silver) |
| Gelatin | 0.6 |
| ExS-1 | $2 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| Sixth Layer: Interlayer | |
| Gelatin | 1.0 |

-continued

| | |
|---|---|
| Cpd-4 | 0.1 |
| Seventh Layer: First Green-Sensitive Emulsion Layer | |
| Silver iodobromide emulsion (AgI content 10.0 mol %, internal high AgI type, grain size: 0.7 μm (in terms of a diameter of a sphere), a coefficient of variation in grain size (in terms of a diameter of a sphere): 14%, tetradecahedral grains) | 0.2 (as silver) |
| Silver iodobromide emulsion (AgI content 14.0 mol %, internal high AgI type, grain size: 0.4 μm (in terms of a diameter of a sphere), a coefficient of variation in grain size (in terms of a diameter of a sphere): 22%, tetradecahedral grains) | 0.1 (as silver) |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.20 |
| ExM-6 | 0.25 |
| ExM-2 | 0.10 |
| ExM-5 | 0.03 |
| Solv-1 | 0.40 |
| Solv-4 | 0.03 |
| Eighth Layer: Second Green-Sensitive Emulsion Layer | |
| Silver iodobromide emulsion (AgI content: 10 mol %, internal high AgI type, grain size: 1.0 μm (in terms of a diameter of a sphere), a coefficient of variation in grain size (in terms of a diameter of a sphere): 25%, tabular grains, ratio of diameter/thickness: 3.0) | 0.4 (as silver) |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |
| Solv-4 | 0.03 |
| Ninth Layer: Interlayer | |
| Gelatin | 0.5 |
| Tenth Layer: Third Green-Sensitive Emulsion Layer | |
| Silver iodobromide emulsion (AgI content: 10.0 mol %, internal high AgI type, grain size: 1.2 μm (in terms of a diameter of a sphere), a coefficient of variation in grain size (in terms of a diameter of a sphere): 28%, tabular grains, ratio of diameter/thickness: 6.0) | 1.0 (as silver) |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| ExC-4 | 0.005 |
| Solv-1 | 0.2 |
| Eleventh Layer: Yellow Filer Layer | |
| Cpd-3 | 0.05 |
| Gelatin | 0.5 |
| Solv-1 | 0.1 |
| Twelfth Layer: Interlayer | |
| Gelatin | 0.5 |
| Cpd-2 | 0.1 |

-continued

| | |
|---|---|
| Thirteenth Layer: First Blue-Sensitive Emulsion Layer | |
| Silver iodobromide emulsion (AgI content 10 mol %, internal high AGI type, grain size: 0.7 μm (in terms of a diameter of a sphere), a coefficient of variation in grain size (in terms of a diameter of a sphere): 14%, tetradecahedral grains) | 0.1 (as silver) |
| Silver iodobromide emulsion (AgI content 4.0 mol %, internal high AgI type, grain size: 0.4 μm (in terms of a diameter of a sphere), a coefficient of variation in grain size (in terms of a diameter of a sphere): 22%, tetradecahedral grains) | 0.05 (as silver) |
| Gelatin | 1.0 |
| ExS-8 | $3 \times 10^{-4}$ |
| ExY-1 | 0.25 |
| ExY-3 | 0.32 |
| ExY-2 | 0.02 |
| Solv-1 | 0.20 |
| Fourteenth Layer: Second Blue-Sensitive Emulsion Layer | |
| Silver iodobromide emulsion (AgI content 19.0 mol %, internal high AgI type, grain size: 1.0 μm (in terms of a diameter of a sphere), a coefficient of variation in grain size (in terms of a diameter of a sphere): 16%, tetradecahedral grains) | 0.19 (as silver) |
| Gelatin | 0.3 |
| ExS-8 | $2 \times 10^{-4}$ |
| ExY-1 | 0.22 |
| Solv-1 | 0.07 |
| Fifteenth Layer: Interlayer | |
| Fine silver iodobromide grains (AgI content: 2 mol %, uniform type, grain size: 0.13 μm in terms of a diameter of a sphere) | 0.2 (as silver) |
| Gelatin | 0.36 |
| Sixteenth Layer: Third Blue-Sensitive Emulsion Layer | |
| Silver iodobromide emulsion (AgI content: 14.0 mol %, internal high AgI type, grain size: 1.5 μm (in terms of a diameter of a sphere), a coefficient of variation in grain size (in terms of a diameter of a sphere): 28%, tabular grains, ratio of diameter/thickness: 5.0) | 1.0 (as silver) |
| Gelatin | 0.5 |
| ExS-8 | $1.5 \times 10^{-4}$ |
| ExY-1 | 0.2 |
| Solv-1 | 0.07 |
| Seventeenth Layer: First Protective Layer | |
| Gelatin | 1.8 |
| UV-1 | 0.1 |
| UV-2 | 0.2 |
| Solv-1 | 0.01 |
| Solv-2 | 0.01 |
| Eighteenth Layer: Second Protective Layer | |
| Fine silver iodobromide grains (grain size: 0.07 μm in terms of a diameter of a sphere) | 0.18 (as silver) |
| Gelatin | 0.7 |
| Polymethyl methacrylate particles (particle diameter: 1.5 μm) | 0.2 |
| W-1 | 0.02 |
| H-1 | 0.4 |
| Cpd-5 | 1.0 |

UV-1
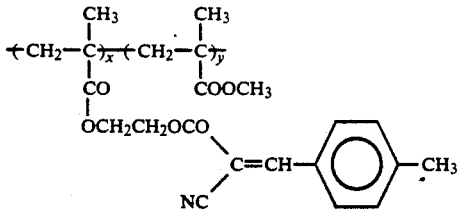
x/y=7/3 (by weight)
UV-2
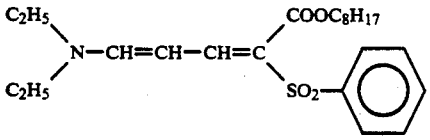
ExM-3
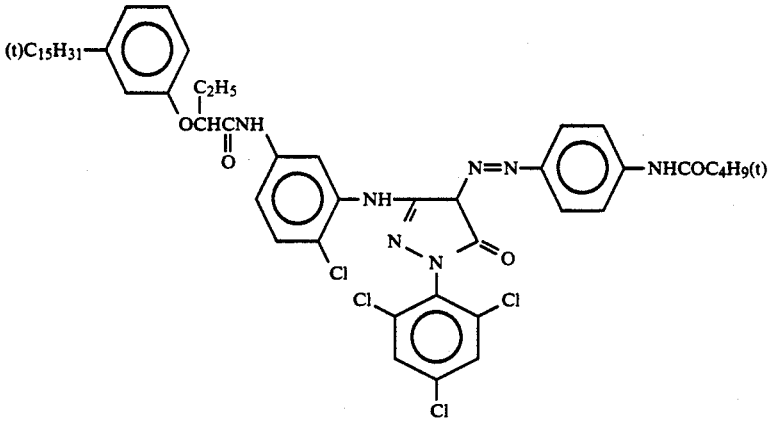
ExC-1
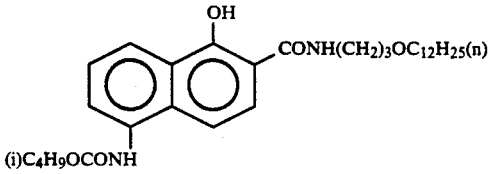
ExC-2
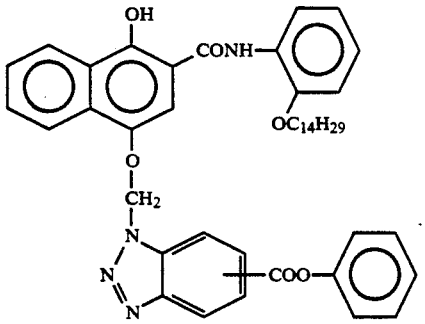
ExC-3
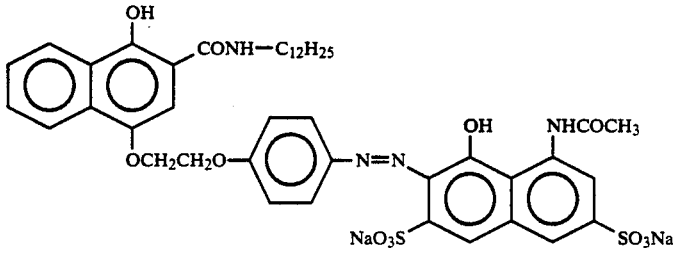

-continued
ExC-6
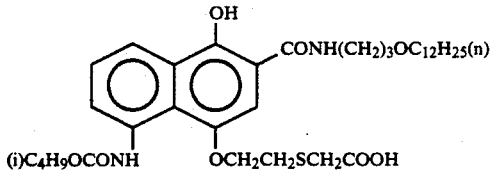
ExC-7
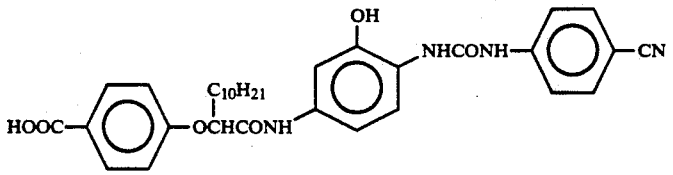
ExC-4
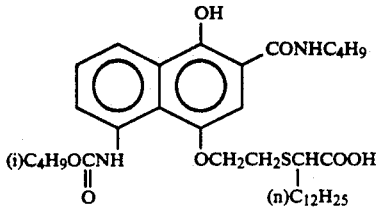
ExC-5
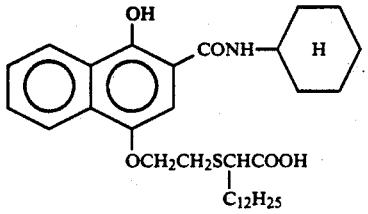
ExM-1
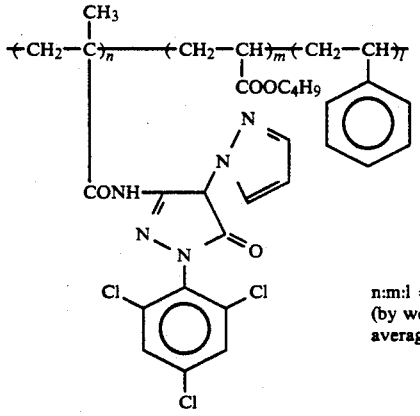
n:m:l = 2:1:1
(by weight)
average MW 40,000
ExM-2
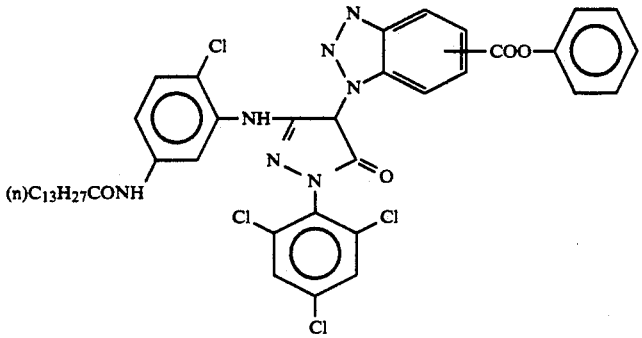

-continued
ExM-3
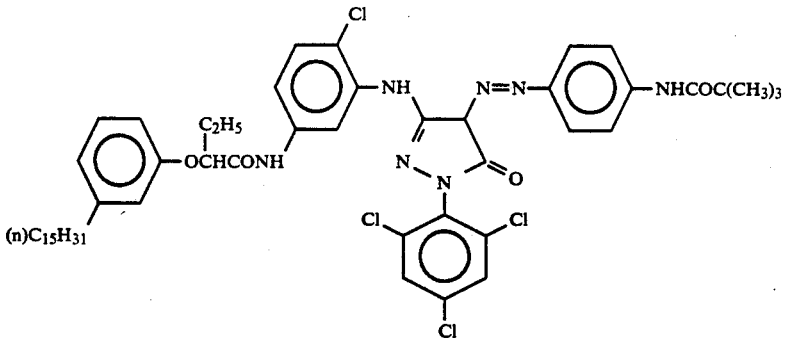
ExM-4
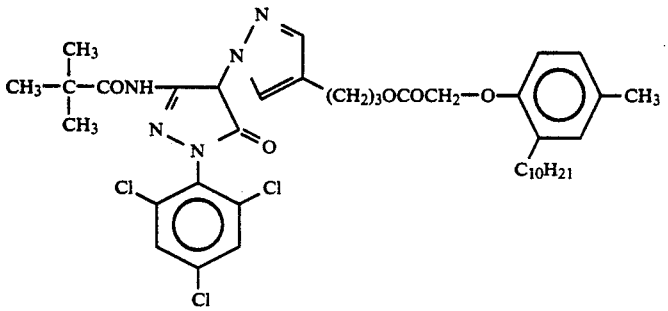
ExM-5
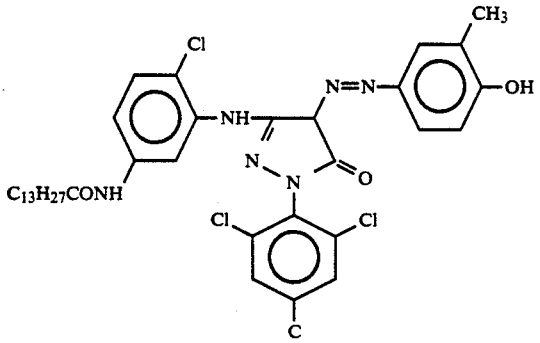
ExM-6
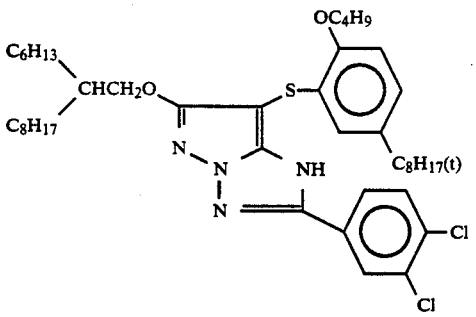
ExY-1
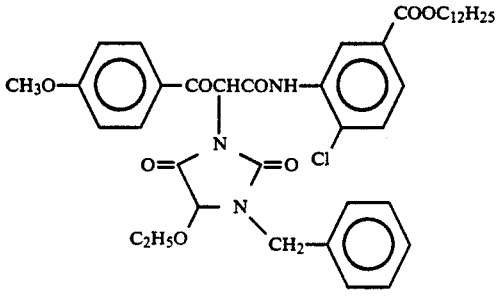

-continued
ExY-2
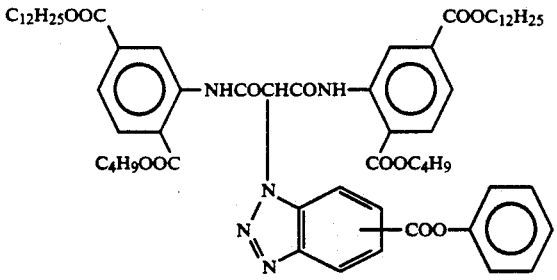
ExY-3
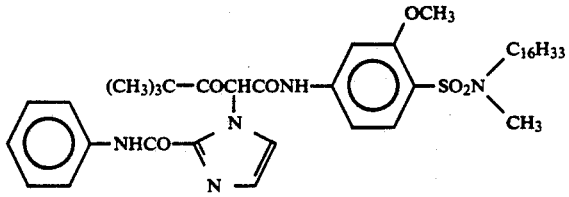
ExS-1
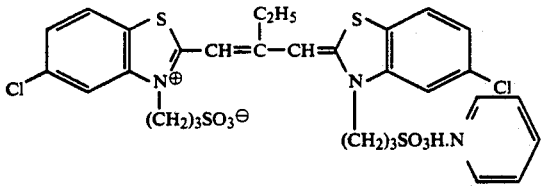
ExS-2
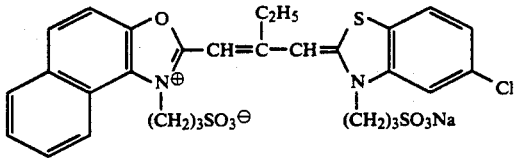
ExS-3
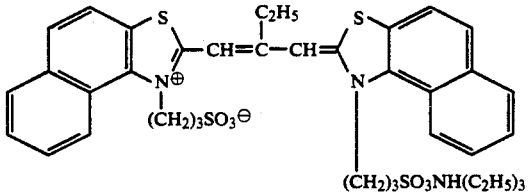
ExS-4
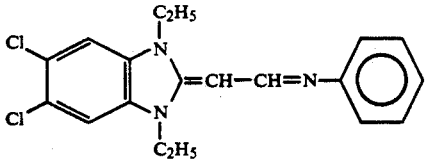
ExS-5
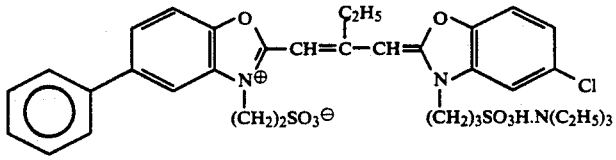
ExS-6
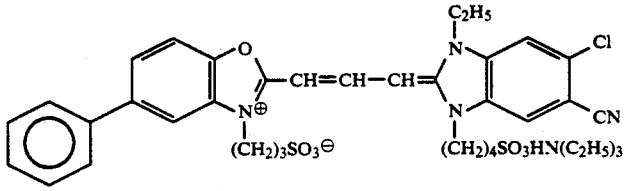

-continued
ExS-8
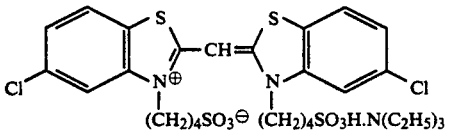
ExS-7
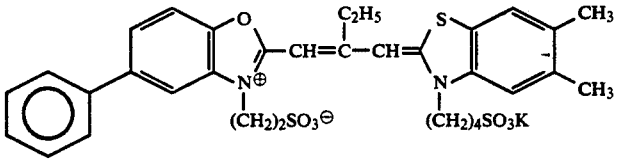
Solv-1
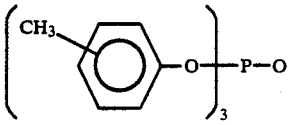
Solv-2
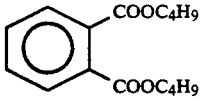
Solv-3
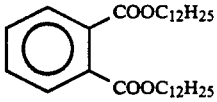
Solv-4
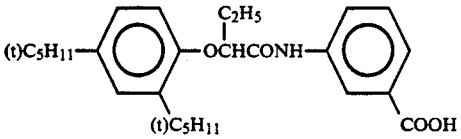
Cpd-1
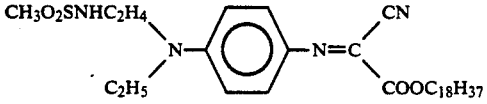
Cpd-2
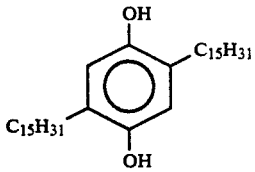
Cpd-3
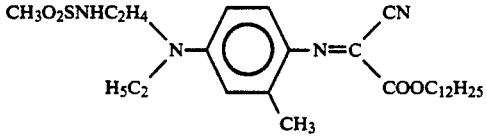
Cpd-4
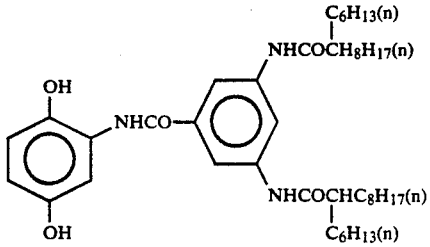

-continued

Cpd-5

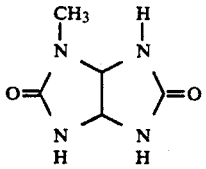

$C_8H_{17}SO_2NHCH_2CH_2CH_2OCH_2CH_2N^{\ominus}(CH_3)_3$

W-1

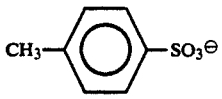

H-1

$CH_3{=}CHSO_2CH_2CONH{-}CH_2$
$CH_3{=}CHSO_2CH_2CONH{-}CH_2$

The thus prepared sample was cut to form pieces having a width of 35 mm, exposed to white light (color temperature of light source: 4800° K.) through a wedge and processed in the following processing steps by using a processing machine for motion picture film (FP-350, manufactured by Fuji Photo Film Co., Ltd.). The sample selected for evaluation of performance was only processed until after the accumulated replenishment of the color developing solution reached three times the tank capacity of the mother solution.

The bleaching solution was aerated at a rate of 200 ml/min through a pipe having many pores of 0.2 mmϕ provided at the bottom of the bleaching solution tank. Processing was carried out while carrying out the aeration under the above conditions.

Processing Sequence

| Step | Processing Time | Processing Temperature | Replenishment Rate* | Tank Capacity |
|---|---|---|---|---|
| Color Development | 3 min 15 sec | 37.8° C. | 23 ml | 10 l |
| Bleaching | 50 sec | 38.0° C. | 5 ml | 5 l |
| Fixing | 1 min 40 sec | 38.0° C. | 30 ml | 10 l |
| Rinse (1) | 30 sec | 38.0° C. | — | 5 l |
| Rinse (2) | 20 sec | 38.0° C. | 30 ml | 5 l |
| Stabilization | 20 sec | 38.0° C. | 20 ml | 5 l |
| Drying | 1 min | 55° C. | | |

*Replenishment rate per 35 mm wide by 1 m long strip of the photographic material. The rinse constituted a countercurrent system of from (2) to (1).

The amount of the developing solution carried into the bleaching step and the amount of the fixing solution carried into the rinsing step were 2.5 ml and 2.0 ml, respectively, each amount being per 35 mm wide by 1 m long strip of the photographic material .

Cross-over time was 5 seconds from both color development to bleaching and from bleaching to fixing. The time was included in the processing time of the previous step.

Each processing solution had the following composition.

| | Mother Solution (g) | Replenisher (g) |
|---|---|---|
| Diethylenetriaminepentaacetic acid | 1.0 | 1.1 |

-continued

| | Mother Solution (g) | Replenisher (g) |
|---|---|---|
| 1-Hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | — |
| Potassium iodide | 1.5 mg | — |
| Hydroxylamine sulfate | 2.4 | 3.6 |
| 4-(N-Ethyl-N-β-hydroxyethylamino)-2-methylaniline sulfate | 4.5 | 6.4 |
| Add water to make | 1 l | 1 l |
| pH | 10.05 | 10.10 |

Bleaching Solution

| | Mother Solution | Replenisher |
|---|---|---|
| Iron nitrate | 0.35 mol | 0.53 mol |
| Chelate compound indicated in Table I-1 | 0.55 mol | 0.83 mol |
| Ammonium bromide | 100 g | 150 g |
| Ammonium nitrate | 20 g | 30 g |
| Glycolic acid | 55 g | 83 g |
| Add water to make | 1.0 l | 1.0 l |
| pH | 5.0 | 5.0 |

The term "chelate compound" as used herein refers to organic acids capable of forming iron(III) ammonium salts of organic acids used as bleaching agents.

Fixing Solution

The mother solution and replenisher had the same composition.

| | |
|---|---|
| Iron(III) ammonium salt of ethylenediaminetetraacetic acid | 1.7 g |
| Ammonium sulfite | 14.0 g |
| Aqueous solution of ammonium thiosulfate (700 g/l) | 260.0 ml |
| Add water to make | 1.0 l |
| pH | 7.0 |

Rinsing Water

The mother solution and the replenisher were the same.

Tap water was passed through a mixed bed column packed with an H type strongly acidic cation exchange resin (Amberlite IR-120B, a product of Rohm & Haas Co.) and an OH type strongly acidic anion exchange resin (Amberlite IRA-400) to reduce the concentration of each of calcium ion and magnesium ion to not more than 3 mg/l. Subsequently, sodium dichloroisocyanurate (20 mg/l) and sodium sulfate (150 mg/l) were added thereto. The pH of the solution was in the range of 6.5 to 7.5.

Stabilizing Solution

The mother solution and replenisher had the same composition.

| | |
|---|---|
| Formalin (37 wt %) | 1.2 ml |
| Surfactant $[C_{10}H_{21}—O—(CH_2CH_2O)_{10}—H]$ | 0.4 g |
| Ethylene glycol | 1.0 g |
| Add water to make | 1.0 l |
| pH | 5.0–7.0 |

The amount of residual silver in the maximum developed color density part of each photographic material processed as described above was measured by X-ray fluorometry. The results are shown in Table I-1.

Furthermore, the density of the thus processed sample was measured, and the Dmin value measured with green light (G light) was read from the characteristic curve.

Processing was carried out in the same manner as described above except that the following processing solution was used as a standard bleaching solution which caused no bleach fog. The bleaching time was 390 seconds, the processing temperature was 38° C. and the replenishment rate was 25 ml per 35 mm wide by 1 m long strip of the sample.

Standard Bleaching Solution

-continued

| | Mother Solution (g) | Replenisher (g) |
|---|---|---|
| ethylenediaminetetraacetic acid (trihydrate) | | |
| Disodium ethylenediaminetetraacetate | 10.0 | 11.0 |
| Ammonium bromide | 100 | 120 |
| Ammonium nitrate | 30.0 | 35.0 |
| Ammonia water (27 wt %) | 6.5 ml | 4.0 ml |
| Add water to make | 1.0 l | 1.0 l |
| pH | 6.0 | 5.7 |

The density of the processed sample obtained by using the above standard bleaching solution was measured in the same manner as described above, and the $D_{min}$ value was also read from the characteristic curve.

The Dmin value obtained by using the above standard bleaching solution is referred to as the standard. A difference ΔDmin between the samples was determined from the Dmin values obtained from the standard. The Dmin value obtained by using the standard bleaching solution was 0.60.

Bleach fog (ΔDmin)=(Dmin of each sample)−(Dmin of standard bleaching solution)

The results are shown in Table I-1.

The above samples were stored under the following conditions, and an increase in stain during the storage of the samples after processing was determined from a density change in Dmin of the undeveloped part before and after storage.

Dark moist heat conditions: 60° C., 70% RH, 4 weeks

Increase in stain (ΔD)=(Dmin after storage)−(Dmin before storage)

The results are shown in Table I-1.

TABLE I-1

| No. | Chelate Compound | Amount of Residual Silver (μg/cm²) | Bleach Fog ΔDmin (G) | Increase of Stain ΔD (G) | Remarks |
|---|---|---|---|---|---|
| 101 | Comparative Compound A | 15.0 | 0.00 | 0.36 | Comparative Example |
| 102 | Comparative Compound B | 4.2 | 0.24 | 0.17 | Comparative Example |
| 103 | Comparative Compound C | 29.0 | 0.00 | 0.20 | Comparative Example |
| 104 | Comparative Compound D | 63.0 | 0.00 | 0.08 | Comparative Example |
| 105 | Exemplary 4 Compound | 5.1 | 0.00 | 0.04 | Invention |
| 106 | Exemplary 5 Compound | 5.7 | 0.00 | 0.04 | " |
| 107 | Exemplary 7 Compound | 4.5 | 0.00 | 0.03 | " |
| 108 | Exemplary 8 Compound | 4.8 | 0.00 | 0.03 | " |
| 109 | Exemplary 9 Compound | 4.9 | 0.00 | 0.03 | " |
| 110 | Exemplary 11 Compound | 4.4 | 0.00 | 0.03 | " |
| 111 | Exemplary 12 Compound | 4.5 | 0.00 | 0.03 | " |

| | Mother Solution (g) | Replenisher (g) |
|---|---|---|
| Iron(III) sodium salt of | 100.0 | 120.0 |

Comparative Compound A

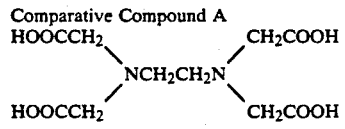

-continued

Comparative Compound B

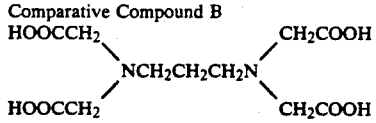

Comparative Compound C

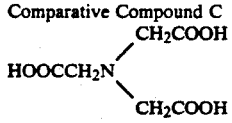

Comparative Compound D

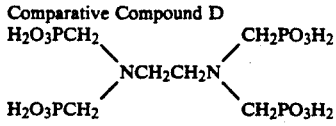

It is clearly seen from the results of Table I-1 that the compounds of the present invention reduce the amount of residual silver in comparison with the comparative compounds and at the same time, the compounds of the present invention have an excellent effect of improving properties with regard to bleach fog and stain upon storage of dye image after processing.

EXAMPLE I-2

The sample 311 described in JP-A-2-28637 (a silver iodobromide type multilayer color photographic material for photography) was processed in the following steps.

Processing Sequence

| Step | Processing Time | Processing Temperature | Replenishment Rate* | Tank Capacity |
|---|---|---|---|---|
| Color Development | 1 min 45 sec | 43° C. | 25 ml | 10 l |
| Bleaching | 20 sec | 40° C. | 5 ml | 4 l |
| Bleach-Fixing | 20 sec | 40° C. | — | 4 l |
| Fixing | 20 sec | 40° C. | 16 ml | 4 l |
| Rinse (1) | 20 sec | 40° C. | — | 2 l |
| Rinse (2) | 10 sec | 40° C. | 30 ml | 2 l |
| Stabilization | 10 sec | 40° C. | 20 ml | 2 l |
| Drying | 1 min | 60° C. | | |

*Replenishment rate was per 35 mm wide by 1 m long strip of the photographic material.

The rinse step was a countercurrent system of from (2) to (1). All overflow of the bleaching solution was introduced into the bleach-fixing bath.

All overflow of rinse (1) was allowed to overflow into the fixing bath, and all overflow of the fixing bath was allowed to overflow into the bleach-fixing bath.

The amount of fixing solution carried into the rinsing step in the above processing was 2 ml per 35 mm wide by 1 mm long strip of the photographic material.

Color Developing Solution

| | Mother Solution (g) | Replenisher (g) |
|---|---|---|
| Diethylenetriaminepentaacetic acid | 2.0 | 2.0 |
| 1-Hydroxyethylidene-1,1-diphosphonic acid | 3.0 | 3.2 |
| Sodium sulfite | 4.0 | 5.8 |
| Potassium carbonate | 40.0 | 40.0 |
| Potassium bromide | 1.3 | — |
| Potassium iodide | 1.5 mg | — |
| Hydroxylamine sulfate | 2.4 | 3.6 |
| 2-Methyl-4-[N-ethyl-N-(β-hydroxyethyl)amino]aniline sulfate | 9.2 | 13.4 |
| Add water to make | 1.0 l | 1.0 l |
| pH was adjusted with potassium hydroxide (50 wt %) | 10.20 | 10.35 |

Bleaching Solution

| | Mother Solution | Replenisher |
|---|---|---|
| Chelate compound indicated in Table I-2 | 0.5 mol | 0.70 mol |
| Iron nitrate | 0.45 mol | 0.63 mol |
| Ammonium bromide | 100 g | 140 g |
| Ammonium nitrate | 17.5 g | 25.0 g |
| Add water to make | 1.0 l | 1.0 l |
| pH | 4.5 | 4.5 |

Fixing Solution

| | Mother Solution | Replenisher |
|---|---|---|
| Aqueous solution of ammonium thiosulfate (700 g/l) | 280 ml | 840 ml |
| Ethylenediaminetetraacetic acid | 12.6 g | 38 g |
| Ammonium sulfite | 27.5 g | 82.5 g |
| Imidazole | 28 g | 84 g |
| Add water to make | 1.0 l | 1.0 l |
| pH | 7.8 | 8.0 |

Bleaching-Fixing Solution

A mixture of bleaching solution: fixing solution: rinsing solution=5:16:30 (by volume)

Rinsing Solution

The same rinsing solution as that of Example I-1.

Stabilizing Solution

The mother solution and replenisher had the same composition.

| | |
|---|---|
| Formalin (37 wt %) | 2.0 ml |
| Polyoxyethylene p-monononylphenyl ether (average degree of polymerization: 10) | 0.3 g |
| Disodium ethylenediaminetetraacetate | 0.05 g |
| Add water to make | 1.0 l |
| pH | 5.0–8.0 |

The density of the processed sample was measured, and the Dmin value measured with green light was read from the characteristic curve.

The sample 311 described in JP-A-2-28637 was processed with the standard bleaching solution used in Example I-1. In the same manner as in Example I-1, bleach fog ΔDmin value was calculated on the basis of the Dmin value obtained on the standard bleaching solution. The Dmin value obtained by using the standard bleaching solution was 0.57. The results are shown in Table I-2.

The above processed sample was tested under the same conditions as in Example I-1 to determine the increase in stain upon storage of the image after processing. Evaluation of stain was carried out. The results are shown in Table I-2.

Furthermore, samples were uniformly exposed to provide a gray density of 1.5, and the exposed samples were processed in the same manner as described above. The amount of silver left behind in these samples was determined by X-ray fluorometry. The results are also shown in Table I-2.

TABLE I-2

| No. | Chelate Compound | Amount of Residual Silver ($\mu g/cm^2$) | Bleach Fog ΔDmin (G) | Increase of Stain ΔD (G) | Remarks |
|---|---|---|---|---|---|
| 201 | Comparative Compound A | 21.0 | 0.05 | 0.38 | Comparative Example |
| 202 | Comparative Compound B | 3.5 | 0.43 | 0.26 | Comparative Example |
| 203 | Comparative Compound C | 31.2 | 0.06 | 0.21 | Comparative Example |
| 204 | Comparative Compound D | 76.1 | 0.00 | 0.07 | Comparative Example |
| 205 | Examplary 4 Compound | 3.8 | 0.00 | 0.02 | Invention |
| 206 | Examplary 5 Compound | 3.9 | 0.00 | 0.03 | " |
| 207 | Examplary 7 Compound | 3.2 | 0.00 | 0.03 | " |
| 208 | Examplary 8 Compound | 3.5 | 0.00 | 0.03 | " |
| 209 | Examplary 9 Compound | 3.7 | 0.00 | 0.01 | " |
| 210 | Examplary 11 Compound | 3.0 | 0.00 | 0.02 | " |
| 211 | Examplary 12 Compound | 3.1 | 0.00 | 0.02 | " |

The comparative compounds, A, B, C and D are the same compounds as those used in Example I-1. It is clearly seen from the results of Table I-2 that the compounds of the present invention reduce the amount of residual silver and have an excellent effect of improving properties with regard to bleach fog and stain upon storage of the dye image after processing in comparison with the comparative compounds.

EXAMPLE I-3

Both sides of a paper support were laminated with polyethylene. The surface of the polyethylene-laminated paper support was treated with corona discharge and coated with a gelatin undercoat layer containing sodium dodecylbenzenesulfonate and then with the following photographic constituent layers to prepare a multi-layer color photographic paper having the following layer structure. Coating solutions were prepared in the following manner.

Preparation of Coating Solution for First Layer 19.1 g of yellow coupler (ExY), 4.4 g of dye image stabilizer (Cpd-1) and 0.7 g of dye image stabilizer (Cpd-7) were dissolved in 27.2 cc of ethyl acetate, 4.1 g of solvent (Solv-3) and 4.1 g of solvent (Solv-7). The resulting solution was emulsified and dispersed in 185 cc of a 10 wt % aqueous gelatin solution containing 8 cc of 10 wt % sodium dodecylbenzenesulfonate to prepare an emulsified dispersion A. Separately, a silver chlorobromide emulsion A (cubic, a 3:7 (by silver molar ratio) mixture of a larger-sizze emulsion A having an average grain size of 0.88 μm and a smaller-size emulsion A having an average grain size of 0.70 μm, a coefficient of variation in grain size distribution: 0.08 and 0.10, respectively, 0.3 mol % of silver bromide being localized on a part of the surface of the grain in each emulsion) was prepared. The following blue-sensitive sensitizing dyes A and B were added to the emulsion in such an amount that $2.0\times10^{-4}$ mol of each of the dyes A and B was added to the larger-size emulsion A and $2.5\times10^{-4}$ mol of each of the dyes A and B was added to the smaller-size emulsion A, each amount being per mol of silver. The chemical ripening of the emulsion was carried out by adding a sulfur sensitizing agent and a gold sensitizing agent. The above emulsified dispersion A and the silver chlorobromide emulsion A were mixed and dissolved. A coating solution for the first layer was prepared to provide the following composition.

Coating solutions for the second layer through the seventh layer were prepared in the same manner as the coating solution for the first layer. Sodium salt of 1-oxy-3,5-dichloro-s-triazine was used as the hardening agent for gelatin in each layer.

Cpd-10 and Cpd-11 were added to each layer in an amount of 25.0 mg/m² and 50.0 mg/m² in total, respectively.

The following spectral sensitizing dyes were used in the silver chlorobromide emulsion for the following light-sensitive emulsion layers.

Sensitizing Dye A for Blue-sensitive Emulsion Layer

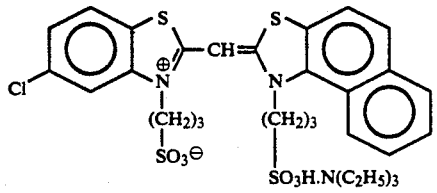

Sensitizing Dye B for Blue-sensitive Emulsion Layer

-continued

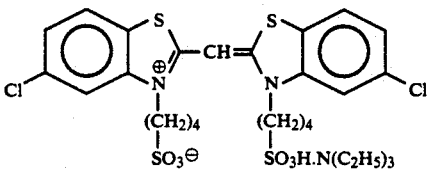

($2.0\times10^{-4}$ mol of each of the dyes being added to the larger-size emulsion A, and $2.5\times10^{-4}$ mol of each of the dyes being added to the smaller-size emulsion A, each amount being per mol of silver halide)

Sensitizing Dye C for Green-sensitive Emulsion Layer

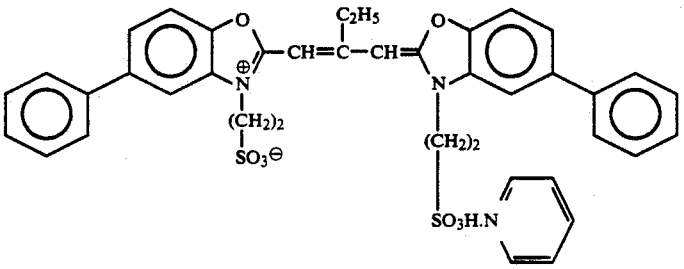

($4.0\times10^{-4}$ mol being added to the larger-size emulsion B and $5.6\times10^{-4}$ mol being added to the smaller-size emulsion B, each amount being per mol of silver halide) and Sensitizing Dye D for Green-sensitive Emulsion Layer

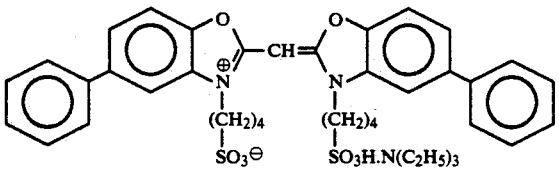

($7.0\times10^{-5}$ mol being added to the larger-size emulsion B and $1.0\times10^{-5}$ mol being added to the smaller-size emulsion B, each amount being per mol of silver halide).

Sensitizing Dye E for Red-sensitive Emulsion Layer

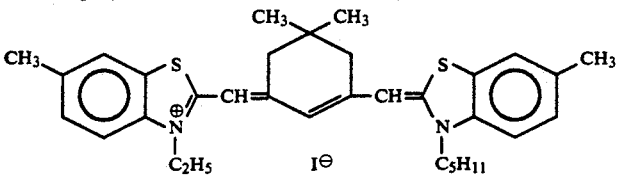

($0.9\times10^{-4}$ mol being added to the larger-size emulsion C and $1.1\times10^{-4}$ mol being added to the smaller-size emulsion C, each amount being per mol of silver halide).

$2.6\times10^{-3}$ mol of the following compound per mol of silver halide was added to the red-sensitive emulsion layer.

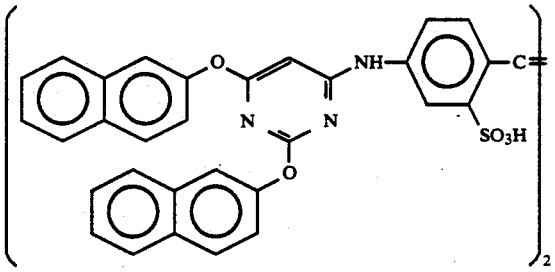

$8.5\times10^{-5}$ mol, $7.7\times10^{-4}$ mol and $2.5\times10^{-4}$ mol of 1-(5-methylureidophenyl)-5-mercaptotetrazole were added to the blue-sensitive emulsion layer, the green-sensitive emulsion layer and the red-sensitive emulsion layer, respectively, each amount being per mol of silver halide.

$1\times10^{-4}$ mol and $2\times10^{-4}$ mol of 4-hydroxy-6-methyl-1,3,3a,7-tetraazaindene were added to the blue-sensitive emulsion layer and the green-sensitive emulsion layer, respectively, each amount being per mol of silver halide.

The following dyes (parenthesized numerals being coating weights) were added to the emulsion layers to prevent irradiation.

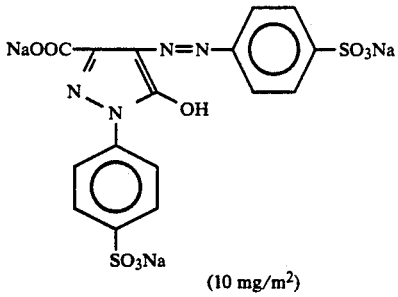

(10 mg/m²)

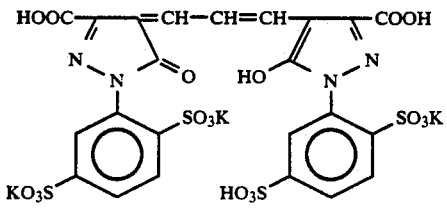

(10 mg/m²)

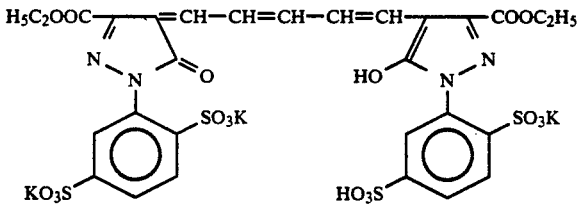

(40 mg/m²)

and

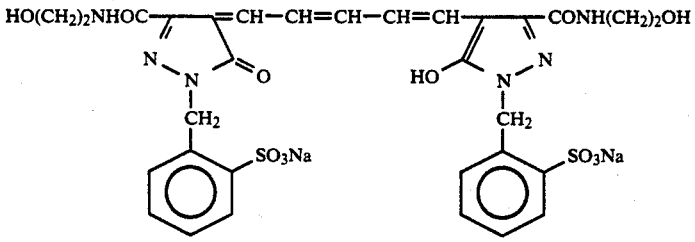

(20 mg/m²)

Layer Structure

Each layer had the following composition. Numerals represent coating weight (g/m²). The amounts of silver halide emulsions are represented by coating weight in terms of silver.

Support

Polyethylene-laminated paper

[Polyethylene on the first layer contains white pigment ($TiO_2$) and bluish dye (ultramarine)]

| | |
|---|---|
| First Layer: Blue-Sensitive Emulsion Layer | |
| The above-described silver chlorobromide emulsion A | 0.30 |
| Gelatin | 1.86 |
| Yellow coupler (ExY) | 0.82 |
| Dye image stabilizer (Cpd-1) | 0.19 |
| Solvent (Solv-3) | 0.18 |
| Solvent (Solv-7) | 0.18 |
| Dye image stabilizer (Cpd-7) | 0.06 |
| Second Layer: Color Mixing Inhibiting Layer | |

-continued

| | |
|---|---|
| Gelatin | 0.99 |
| Color mixing inhibitor (Cpd-5) | 0.08 |
| Solvent (Solv-1) | 0.16 |
| Solvent (Solv-4) | 0.08 |
| Third Layer: Green-Sensitive Emulsion Layer | |
| Silver chlorobromide emulsion (cubic, a 1:3 (by Ag molar ratio) mixture of a larger-size emulsion B having an average grain size of 0.55 μm and a smaller-size emulsion B having an average grain size of 0.39 μm, a coefficient of variation in grain size distribution: 0.10 and 0.08, 0.8 mol % of AgBr being localized on a part of the surface of the grain in each emulsion) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| Fourth Layer: Ultraviolet Light Absorbing Layer | |

-continued

| | |
|---|---|
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth Layer: Red-Sensitive Emulsion Layer | |
| Silver chlorobromide emulsion (cubic, a 1:4 (by Ag molar ratio) mixture of a larger-size emulsion C having an average grain size of 0.58 μm and a smaller-size emulsion C having an average grain size of 0.45 μm, a coefficient of variation in grain size distribution: 0.09 and 0.11, 0.6 mol % of AgBr being localized on a part of the surface of the grain in each emulsion) | 0.23 |
| Gelatin | 1.34 |
| Cyan coupler (ExC) | 0.32 |

-continued

| | |
|---|---|
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| Sixth Layer: Ultraviolet Light Absorbing Layer | |
| Gelatin | 0.53 |
| Ultraviolet Light Absorber (UV-1) | 0.16 |
| Color mixing inhibitor (Cpd-5) | 0.02 |
| Solvent (Solv-5) | 0.08 |
| Seventh Layer: Protective Layer | |
| Gelatin | 1.33 |
| Acrylic-modified copolymer of polyvinyl alcohol (a degree of modification: 17%) | 0.17 |
| Liquid paraffin | 0.03 |

(ExY) Yellow Coupler:

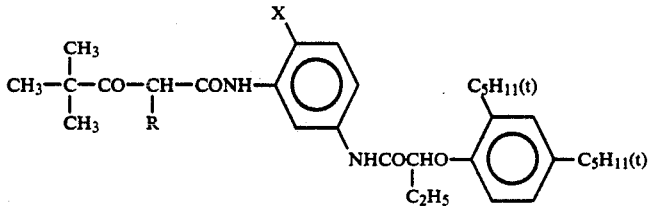

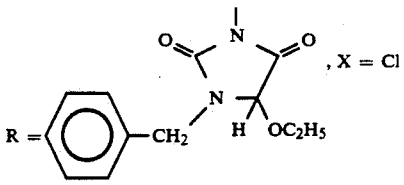

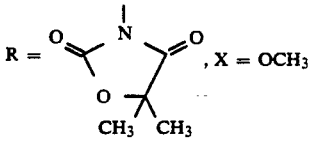

1:1 mixture (by mol)

(ExM) Magenta Coupler

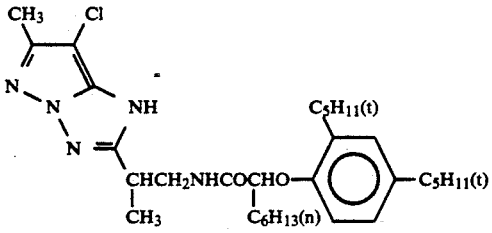

(ExC) Cyan Coupler:

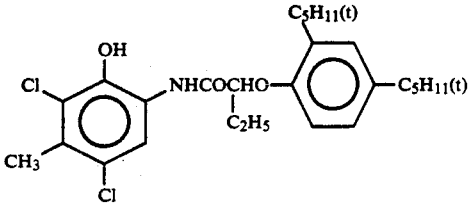

-continued
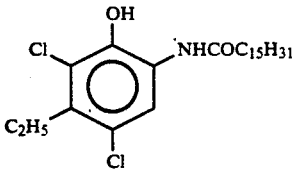
1:1 mixture (by mol)
(Cpd-1) Dye Image Stabilizer:
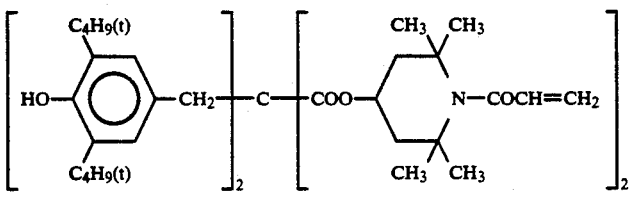
(Cpd-2) Dye Image Stabilizer:
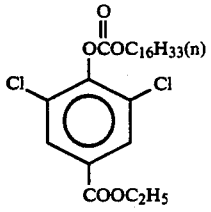
(Cpd-3) Dye Image Stabilizer:
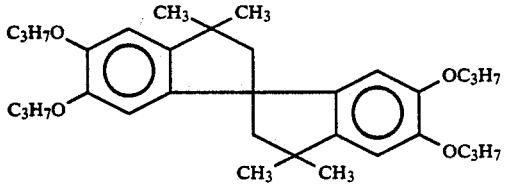
(Cpd-4) Dye Image Stabilizer
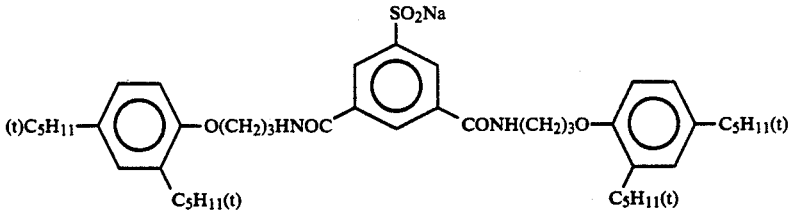
(Cpd-5) Color Mixing Inhibitor
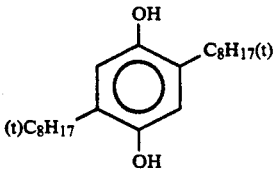
(Cpd-6) Dye Image Stabilizer
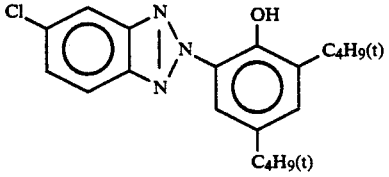

-continued
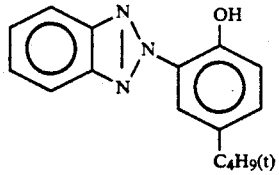
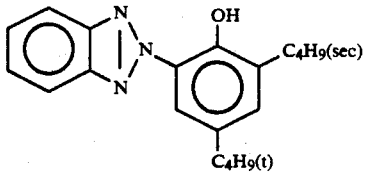
2:2:4 mixture (by weight)
(Cpd-7) Dye Image Stabilizer
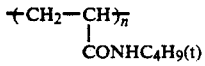
(Average molecular weight 60,000)
(Cpd-8) Dye Image Stabilizer:
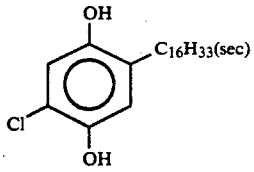
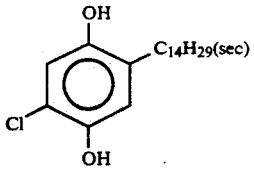
1:1 mixture (by weight)
(Cpd-9) Dye Image Stabilizer:
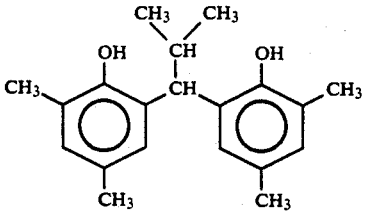
(Cpd-10) Antiseptic Agent
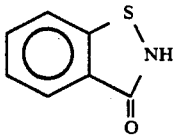
(Cpd-11) Antiseptic Agent
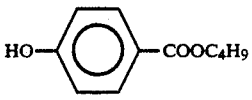
(UV-1) Ultraviolet Light Absorbent
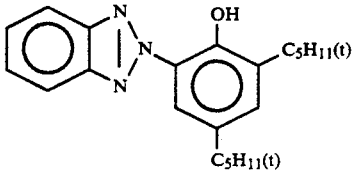

-continued
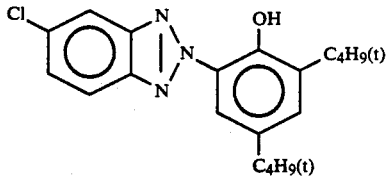
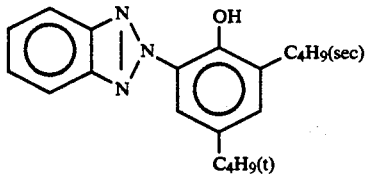
4:2:4 mixture (by weight)
(Solv-1) Solvent:
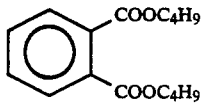
(Solv-2) Solvent
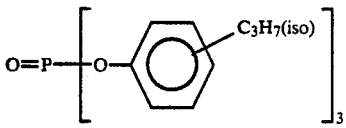
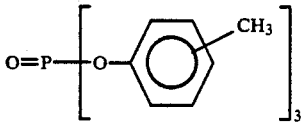
1:1 mixture (by volume)
(Solv-3) Solvent
$O{=}P{+}O{-}C_9H_{19}(iso)]_3$
(Solv-4) Solvent
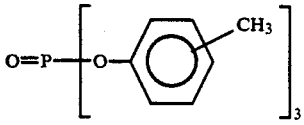
(Solv-5) Solvent
$$\begin{array}{l} COOC_8H_{17} \\ | \\ (CH_2)_8 \\ | \\ COOC_8H_{17} \end{array}$$
(Solv-6) Solvent
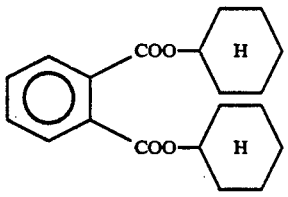
$$C_8H_{17}\underset{\diagdown O \diagup}{CHCH}(CH_2)_7COOC_8H_{17}$$
80:20 mixture (by volume)
(Solv-7) Solvent -continued $C_8H_{17}CHCH(CH_2)_7COOC_8H_{17}$
$\backslash\ /$
O The following processing solutions were prepared. Each processing solution had the following composition.

Color Developing Solution

| | |
|---|---|
| Water | 600 ml |
| Ethylenediamine-N,N,N',N'-tetramethylenephosphonic acid | 2.0 g |
| Potassium bromide | 0.015 g |
| Potassium chloride | 3.1 g |
| Triethanolamine | 10.0 g |
| Potassium carbonate | 27 g |
| Fluorescent brightener (WHITEX 4B, a product of Sumitomo Chemical Co., Ltd.) | 1.0 g |
| Diethylhydroxylamine | 42. g |
| N-Ethyl-N-(β-methanesulfonamidoethyl)-3-methyl-4-aminoaniline sulfate | 5.0 g |
| Add water to make | 1000 ml |
| pH (25° C.) | 10.05 |

Bleach-Fixing Solution

| | |
|---|---|
| Water | 400 ml |
| Ammonium thiosulfate (70 wt %) | 100 ml |
| Sodium sulfite | 17 g |
| Iron chloride | 0.50 mol |
| Chelate compound indicated in Table I-3 | 0.55 mol |
| Ammonium bromide | 40 g |
| Add water to make | 1000 ml |
| pH (25° C.) | 6.8 |

Rinsing Water

Ion-exchanged water (the concentration of each of calcium ion and magnesium ion being not higher than 3 ppm)

The above-described photographic material was processed by the following processing steps.

| Processing Sequence | Temperature | Time |
|---|---|---|
| Color development | 38° C. | 45 sec |
| Bleach-fixing | 35° C. | 25 sec |
| Rinse (1) | 35° C. | 20 sec |
| Rinse (2) | 35° C. | 20 sec |
| Rinse (3) | 35° C. | 20 sec |
| Drying | 80° C. | 60 sec |

Furthermore, samples were uniformly exposed so as to provide a gray density of 1.5, and the exposed samples were processed in the same manner as described above. The amount of silver remaining in the maximum density part of these samples was determined by X-ray fluorometry. The results are shown in Table I-3.

TABLE I-3

| No. | Chelate Compound | Amount of Residual Silver (μg/m²) | Remarks |
|---|---|---|---|
| 301 | Comparative Compound A | 14.0 | Comparative Example |
| 302 | Exemplary 4 Compound | 2.7 | Invention |
| 303 | Exemplary 5 Compound | 3.0 | " |

TABLE I-3-continued

| No. | Chelate Compound | Amount of Residual Silver (μg/m²) | Remarks |
|---|---|---|---|
| 304 | Exemplary 7 Compound | 2.4 | " |
| 305 | Exemplary 8 Compound | 2.4 | " |
| 306 | Exemplary 9 Compound | 2.6 | " |
| 307 | Exemplary 11 Compound | 2.1 | " |
| 308 | Exemplary 12 Compound | 2.2 | " |

Comparative Compound A $HOOCCH_2$ $CH_2COOH$
$\backslash$ $/$
$NCH_2CH_2N$
$/$ $\backslash$
$HOOCCH_2$ $CH_2COOH$ It is clearly seen from the above results that when the compounds of the present invention are used, the amount of residual silver is reduced in comparison with the comparative compound A.

EXAMPLE I-4

The same photographic material as that of Example I-1 was exposed to white light (color temperature of 4800° K.) through a wedge and processed in the following processing steps.

| Processing Step | | | | |
|---|---|---|---|---|
| Step | Processing Time | Processing Temperature | Replenishment Rate* | Tank Capacity |
| Color Development | 1 min | 48° C. | 10 ml | 2 l |
| Bleaching | 20 sec | 48° C. | 10 ml | 1 l |
| Fixing | 40 sec | 48° C. | 30 ml | 1 l |
| Rinse | 20 sec | 40° C. | 30 ml | 1 l |
| Drying | 40 sec | 60° C. | | |

*Replenishment rate being per 35 mm wide by 1 m long strip of the photographic material.

Color Developing Solution

| | Mother Solution | Replenisher |
|---|---|---|
| Diethylenetriaminepentaacetic acid | 2.2 g | 2.2 g |
| 1-Hydroxyethylidene-1,1-diphosphonic acid | 3.0 g | 3.2 g |
| Sodium sulfite | 4.1 g | 4.9 g |
| Potassium carbonate | 40 g | 40 g |
| Potassium bromide | 1.4 g | 0.4 g |
| Potasium iodide | 1.3 mg | — |
| 2-Methoxy-4-[N-ethyl-N-(β-hydroxyethyl)amino]aniline sulfate | 6.9 g | 9.2 g |
| Add water to make | 1 liter | 1 liter |
| pH (adjusted with 50 wt % KOH) | 10.05 | 10.25 |

Bleaching Solution

| | Mother Solution | Replenisher |
|---|---|---|
| Metal chelate compound indicated in Table I-4 | 0.3 mol | 0.43 mol |
| Ammonium bromide | 80 g | 114 g |
| Ammonium nitrate | 15 g | 21.4 g |
| Acetic acid (90 wt %) | 42 g | 60 g |
| Add water to make | 1 l | 1 l |
| pH | 4.3 | 3.8 |

Fixing Solution

Mother solution and replenisher being the same.

| | |
|---|---|
| Aqueous ammonium thiosulfate solution (70 wt %) | 280 ml |
| 1-Hydroxyethylidene-1,1-diphosphonic acid | 10 g |
| Ammonium sulfite | 28 g |
| Add water to make | 1 l |
| pH | 7.8 |

Processing was carried out until the accumulated replenishment rate reached twice the tank capacity of the mother solution. At this point, the processing was evaluated.

The processing was evaluated by measurement of the amount of residual silver in the maximum developed color density part, the measurement of bleach fog and the measurement of the increase in stain under dark moist heat storage conditions as in Example I-1. The results are shown in Table I-4.

TABLE I-4

| No. | Metal Chelate Compound | Amount of Residual Silver ($\mu g/cm^2$) | Bleach Fog ΔDmin (G) | Increase of Stain after Processing ΔD (G) | Remarks |
|---|---|---|---|---|---|
| 401 | Comparative Compound A | 30.0 | 0.02 | 0.33 | Comparative Example |
| 402 | Comparative Compound B | 7.1 | 0.35 | 0.28 | Comparative Example |
| 403 | Comparative Compound C | 50.0 | 0.05 | 0.19 | Comparative Example |
| 404 | Comparative Compound D | 100.0 | 0.00 | 0.05 | Comparative Example |
| 405 | Exemplary K-1 Compound | 5.1 | 0.02 | 0.14 | Invention |
| 406 | Exemplary K-2 Compound | 3.1 | 0.03 | 0.26 | " |
| 407 | Exemplary K-3 Compound | 4.2 | 0.02 | 0.11 | " |
| 408 | Exemplary K-4 Compound | 5.0 | 0.02 | 0.09 | " |
| 409 | Exemplary K-5 Compound | 2.2 | 0.03 | 0.15 | " |
| 410 | Exemplary K-6 Compound | 4.8 | 0.01 | 0.12 | " |
| 411 | Exemplary K-7 Compound | 2.0 | 0.01 | 0.10 | " |
| 412 | Exemplary K-8 Compound | 3.2 | 0.02 | 0.19 | " |
| 413 | Exemplary K-9 Compound | 6.1 | 0.00 | 0.19 | " |
| 414 | Exemplary K-10 Compound | 4.8 | 0.04 | 0.12 | " |

Comparative Compound A

-continued

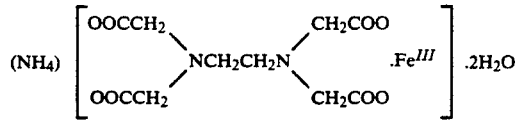

Comparative Compound B

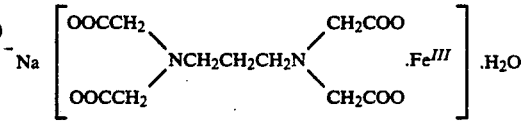

Comparative Compound C

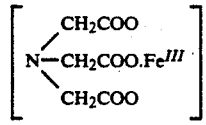

Comparative Compound D

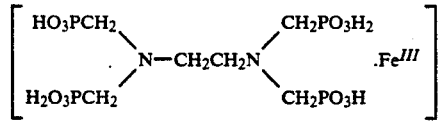

It is clearly seen from Table I-4 that the bleaching solutions containing the compounds of the present invention as bleaching agents provide superior desilverization, prevention of bleach fog and stain after processing as compared to the comparative bleaching solution.

EXAMPLE I-5

An undercoated cellulose triacetate film support was coated with the following layers having the following compositions to prepare a multi-layer color photographic material as sample 501.

Composition of Sensitive Layer

The amounts of silver halide and colloidal silver are represented by coating weight in g/m² in terms of silver. The amounts of couplers, additives and gelatin are represented by coating weight in g/m². The amounts of sensitizing dyes are represented by moles per one mole of silver halide in the same layer.

| | |
|---|---|
| **First Layer: Antihalation Layer** | |
| Black colloidal silver | 0.20 (as silver) |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| **Second Layer: Interlayer** | |
| Fine silver iodobromide grains (AgI content: 1.0 mol %, grain size: 0.07 μm in terms of a diameter of a sphere) | 0.15 (as silver) |
| Gelatin | 1.00 |
| ExC-4 | $6.0 \times 10^{-2}$ |
| Cpd-3 | $2.0 \times 10^{-2}$ |
| **Third Layer: First Red-Sensitive Emulsion Layer** | |
| Silver iodobromide emulsion (AgI content: 5.0 mol %, surface high AgI type, grain size: 0.9 μm (in terms of a diameter of a sphere), a coefficient of variation in grain size (in terms of a diameter of a sphere): 21%, tabular grains, ratio of diameter/thickness: 7.5) | 0.42 (as silver) |
| Silver iodobromide emulsion (AgI content: 4.0 mol %, internal high AgI type, grain size: 0.4 μm (in terms of a diameter of a sphere), a coefficient of variation in grain size (in terms of a diameter of a sphere): 18%, tetradecahedral grains) | 0.40 (as silver) |
| Gelatin | 1.90 |
| ExS-1 | $4.5 \times 10^{-4}$ |
| ExS-2 | $1.5 \times 10^{-4}$ |
| ExS-3 | $4.0 \times 10^{-5}$ |
| ExC-1 | 0.65 |
| ExC-3 | $1.0 \times 10^{-2}$ |
| ExC-4 | $2.3 \times 10^{-2}$ |
| Solv-1 | 0.32 |
| **Fourth Layer: Second Red-Sensitive Emulsion Layer** | |
| Silver iodobromide emulsion (AgI content: 8.5 mol %, internal high AgI type, grain size: 1.0 μm (in terms of a diameter of a sphere), a coefficient of variation in grain size (in terms of a diameter of a sphere): 25%, plate shaped grains, ratio of diameter/thickness: 3.0) | 0.85 (as silver) |
| Gelatin | 0.91 |
| ExS-1 | $3.0 \times 10^{-4}$ |
| ExS-2 | $1.0 \times 10^{-4}$ |
| ExS-3 | $3.0 \times 10^{-4}$ |
| ExC-1 | 0.13 |
| ExC-2 | $6.2 \times 10^{-2}$ |
| ExC-4 | $4.0 \times 10^{-2}$ |
| Solv-1 | 0.10 |
| **Fifth Layer: Third Red-Sensitive Emulsion Layer** | |
| Silver iodobromide emulsion (AgI content: 11.3 mol %, internal high AgI type, grain size: 1.4 μm (in terms of a diameter of a sphere), a coefficient of variation in grain size (in terms of a diameter of a sphere): 28%, plate shaped grains, ratio of diameter/thickness: 6.0) | 1.50 (as silver) |
| Gelatin | 1.20 |
| ExS-1 | $2.0 \times 10^{-4}$ |
| ExS-2 | $6.0 \times 10^{-5}$ |
| ExS-3 | $2.0 \times 10^{-5}$ |
| ExC-2 | $8.5 \times 10^{-2}$ |
| ExC-5 | $7.3 \times 10^{-2}$ |
| Solv-1 | 0.12 |
| Solv-2 | 0.12 |
| **Sixth Layer: Interlayer** | |
| Gelatin | 1.00 |
| Cpd-4 | $8.0 \times 10^{-2}$ |
| Solv-1 | $8.0 \times 10^{-2}$ |
| **Seventh Layer: First Green-Sensitive Emulsion Layer** | |
| Silver iodobromide emulsion (AgI content: 5.0 mol %, surface high AgI type, grain size: 0.9 μm (in terms of a diameter of a sphere), a coefficient of variation in grain size (in terms of a diameter of a sphere): 21%, tabular grains, ratio of diameter/thickness: 7.0) | 0.28 (as silver) |
| Silver iodobromide emulsion (AgI content: 4.0 mol %, internal high AgI type, grain size: 0.4 μm (in terms of a diameter of a sphere), a coefficient of variation in grain size (in terms of a diameter of a sphere): 18%, tetradecahedral grains) | 0.16 (as silver) |
| Gelatin | 1.20 |
| ExS-4 | $5.0 \times 10^{-4}$ |
| ExS-5 | $2.0 \times 10^{-4}$ |
| ExS-6 | $1.0 \times 10^{-4}$ |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| **Eighth Layer: Second Green-Sensitive Emulsion Layer** | |
| Silver iodobromide emulsion (AgI content: 8.5 mol %, internal high AgI type, grain size: 1.0 μm (in terms of a diameter of a sphere), a coefficient of variation in grain size (in terms of a diameter of a sphere): 25%, plate shaped grains, ratio of diameter/thickness: 3.0) | 0.57 (as silver) |
| Gelatin | 0.45 |
| ExS-4 | $3.5 \times 10^{-4}$ |
| ExS-5 | $1.4 \times 10^{-4}$ |
| ExS-6 | $7.0 \times 10^{-5}$ |
| ExM-1 | 0.12 |
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| **Ninth Layer: Interlayer** | |
| Gelatin | 0.50 |
| Solv-1 | $2.0 \times 10^{-2}$ |
| **Tenth Layer: Third Green-Sensitive Emulsion Layer** | |
| Silver iodobromide emulsion (AgI content: 11.3 mol %, internal high AgI type, grain size: 1.4 μm (in terms of a diameter of a sphere), a coefficient of variation in grain size (in terms of a diameter of a sphere): 28%, plate shaped grains, ratio of diameter/thickness: 6.0) | 1.30 (as silver) |
| Gelatin | 1.20 |

-continued

| | |
|---|---|
| ExS-4 | $2.0 \times 10^{-4}$ |
| ExS-5 | $8.0 \times 10^{-5}$ |
| ExS-6 | $8.0 \times 10^{-5}$ |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| **Eleventh Layer: Yellow Filter Layer** | |
| Gelatin | 0.50 |
| Cpd-6 | $5.2 \times 10^{-2}$ |
| Solv-1 | 0.12 |
| **Twelfth Layer: Interlayer** | |
| Gelatin | 0.45 |
| Cpd-3 | 0.10 |
| **Thirteenth Layer: First Blue-Sensitive Emulsion Layer** | |
| Silver iodobromide emulsion (AgI content: 2 mol %, uniform AgI type, grain size: 0.55 μm (in terms of a diameter of a sphere), a coefficient of variation in grain size (in terms of a diameter of a sphere): 25%, tabular grains, ratio of diameter/thickness: 7.0) | 0.20 (as silver) |
| Gelatin | 1.00 |
| ExS-7 | $3.0 \times 10^{-4}$ |
| ExY-1 | 0.60 |
| ExY-2 | $2.3 \times 10^{-2}$ |
| Solv-1 | 0.15 |
| **Fourteenth Layer: Second Blue-Sensitive Emulsion Layer** | |
| Silver iodobromide emulsion (AgI content: 19.0 mol %, internal high AgI type, grain size: 1.0 μm (in terms of a diameter of a sphere), a coefficient of variation in grain size (in terms of a diameter of a sphere): 16%, octahedral grains) | 0.19 (as silver) |
| Gelatin | 0.35 |
| ExS-7 | $2.0 \times 10^{-4}$ |
| ExY-1 | 0.22 |
| Solv-1 | $7.0 \times 10^{-2}$ |
| **Fifteenth Layer: Interlayer** | |
| Fine silver iodobromide grains (in terms of silver) (AgI content: 2 mol %, uniform AgI type, grain size: 0.13 μm in terms of a diameter of a sphere | 0.20 (as silver) |
| Gelatin | 0.36 |
| **Sixteenth Layer: Third Blue-Sensitive Emulsion Layer** | |
| Silver iodobromide emulsion (in terms of silver) (AgI content: 14.0 mol %, internal high AgI type, grain size: 1.7 μm (in terms of a diameter of a sphere), a coefficient of variation in grain size (in terms of a diameter of a sphere): 28%, plate shaped grains, ratio of diameter/thickness: 5.0) | 1.55 (as silver) |
| Gelatin | 1.00 |
| ExS-8 | $1.5 \times 10^{-4}$ |
| ExY-1 | 0.21 |
| Solv-1 | $7.0 \times 10^{-2}$ |
| **Seventeenth Layer: First Protective Layer** | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| **Eighteenth Layer: Second Protective Layer** | |
| Fine silver iodobromide grains (grain size: 0.07 μm in terms of a diameter of a sphere) | 0.36 (as silver) |
| Gelatin | 0.70 |
| B-1 (diameter 1.5 μm) | $2.0 \times 10^{-2}$ |
| B-2 (diameter 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

To this sample were added 1,2-benzisothiazoline-3-one (about 200 ppm), n-butyl p-hydroxybenzoate (about 1,000 ppm) and 2-phenoxyethanol (about 10,000 ppm), each amount being based on the amount of gelatin. Furthermore, B-4, B-5, W-2, W-3, F-1, F-2, F-3, F-4, F-5, F-6, F-7, F-8, F-9, F-10, F-11, F-12, and F-13 were contained in hydrophilic colloid layers, and iron salt, lead salt, gold salt, platinum salt, iridium salt and rhodium salt were contained in silver halide emulsion layers.

UV-1

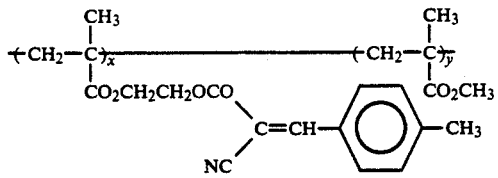

x/y=7/3 (by weight)

UV-2

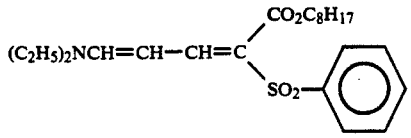

ExC-1

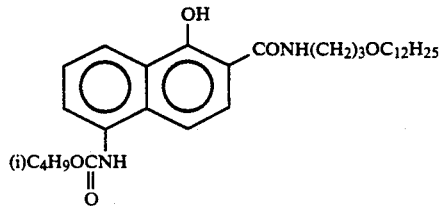

-continued
ExC-2
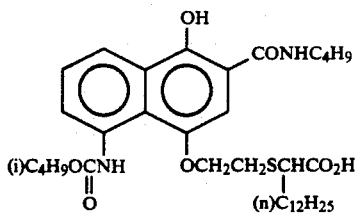
ExC-3
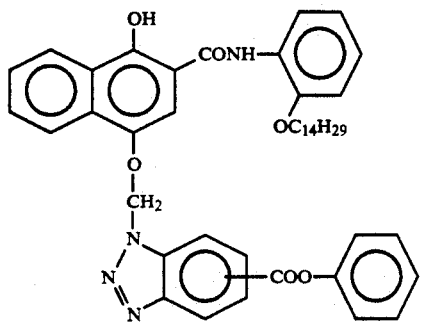
ExC-4
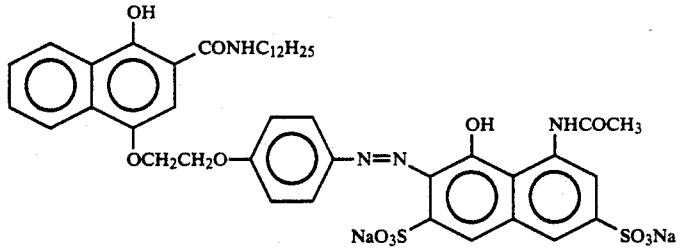
ExC-5
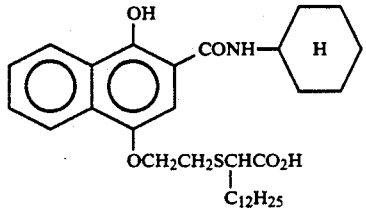
ExM-1
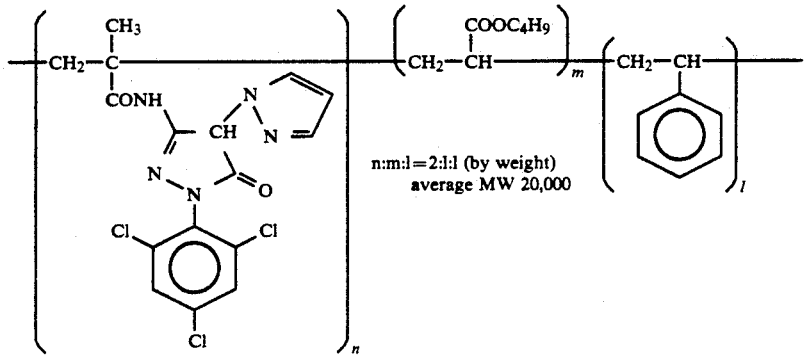

-continued
ExM-2
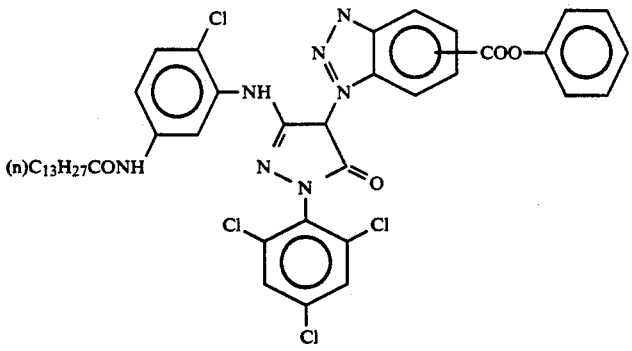
ExM-3
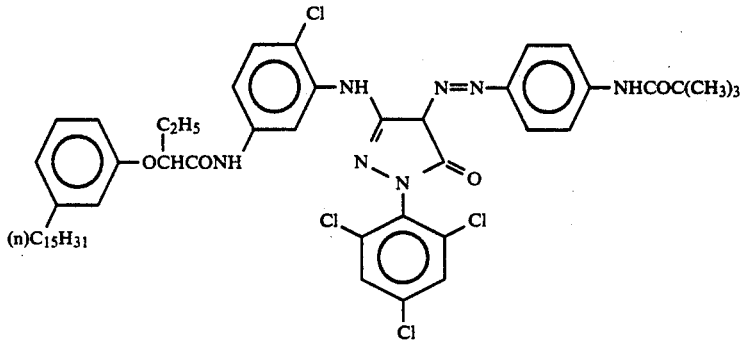
ExM-4
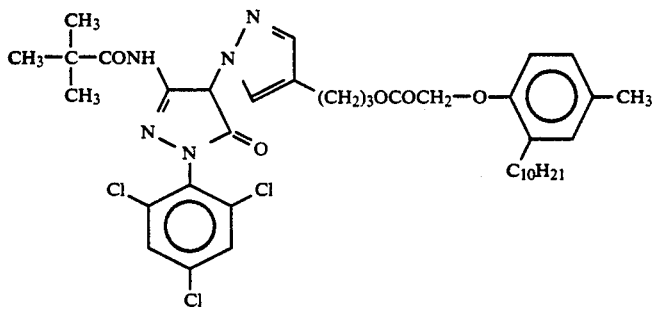
ExM-5
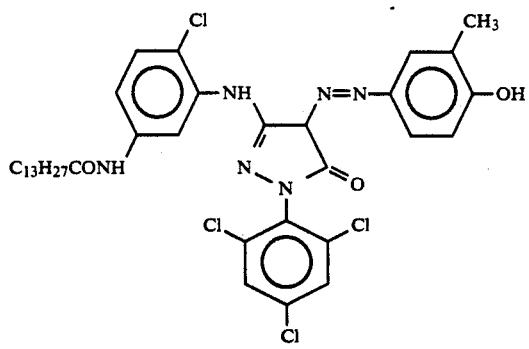
ExM-6
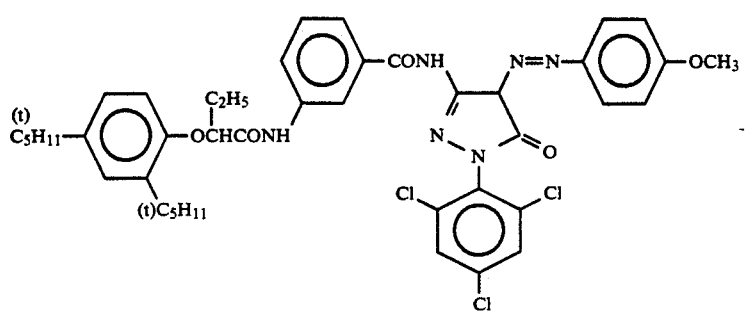

-continued
ExY-1
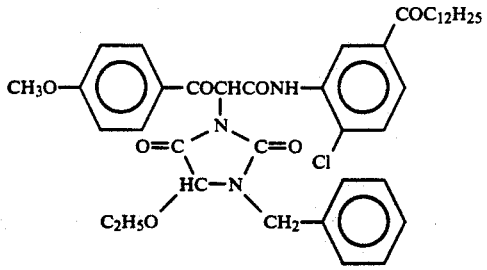
ExY-2
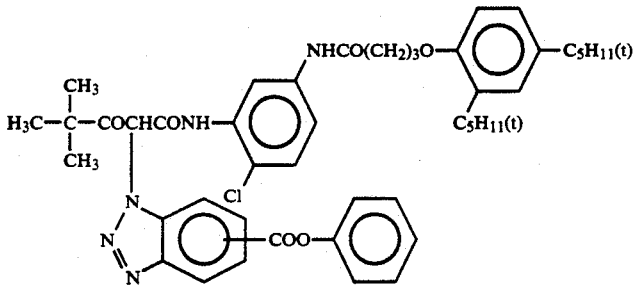
Cpd-1
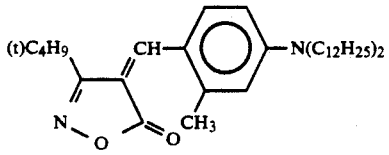
Cpd-2
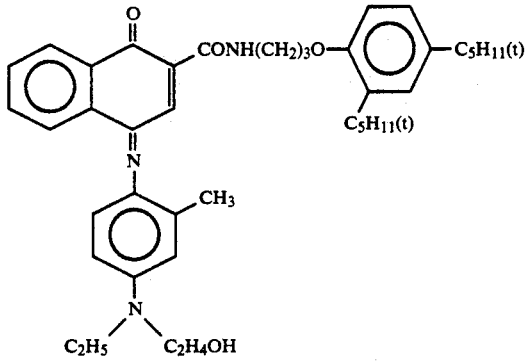
Cpd-3
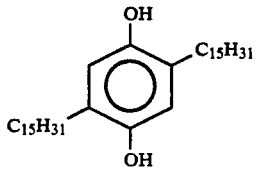
Cpd-4
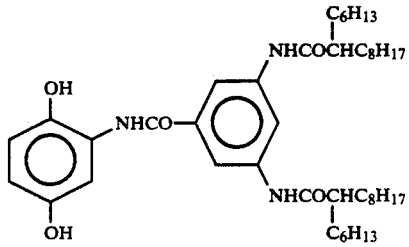

-continued
Cpd-5
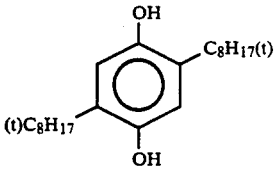
Cpd-6
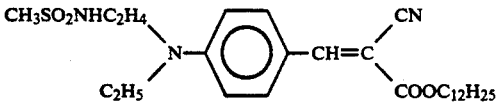
Cpd-7
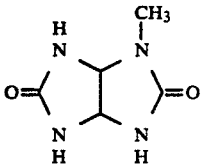
Solv-1
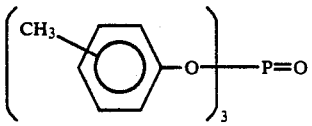
Solv-2
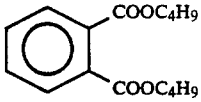
Solv-3
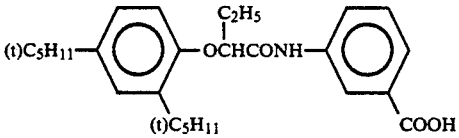
ExS-1
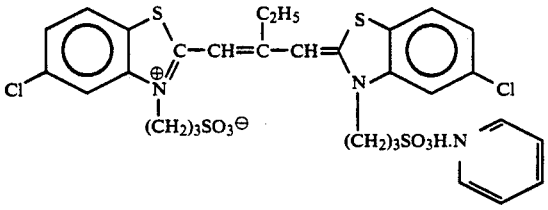
ExS-2
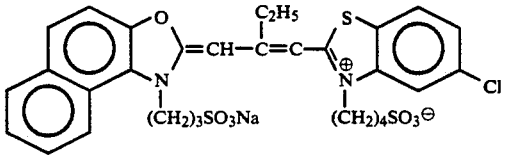
ExS-3
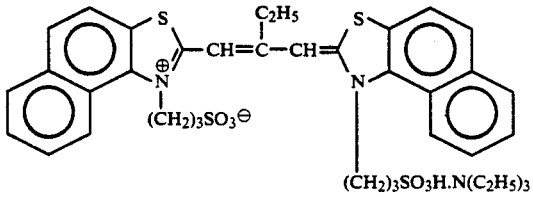

-continued
ExS-4
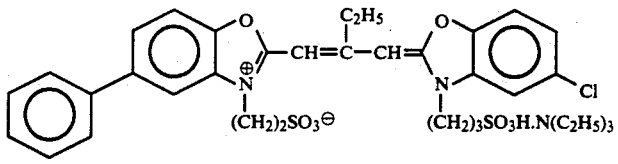
ExS-5
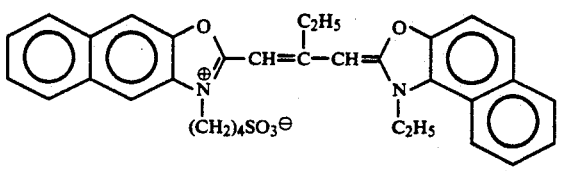
ExS-6
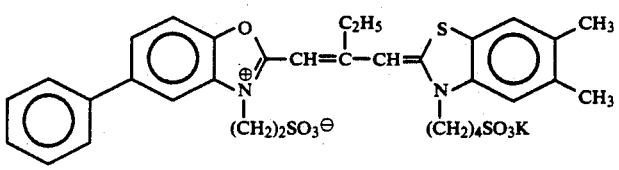
ExS-7
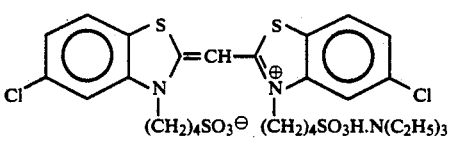
ExS-8
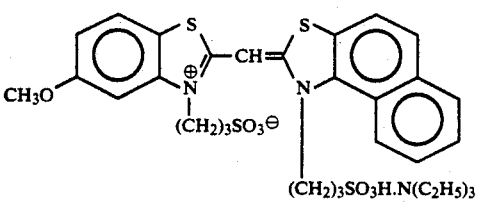
B-1
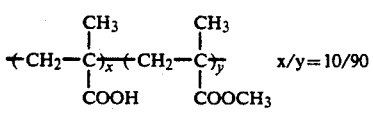
x/y=10/90
B-2
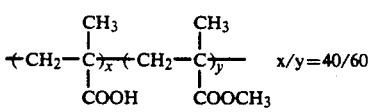
x/y=40/60
B-3
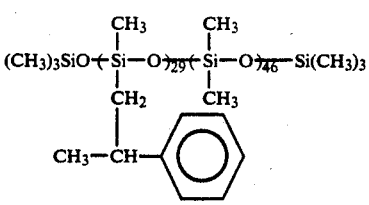
B-4
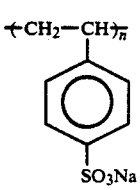
B-5
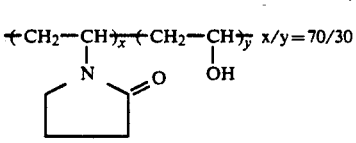
x/y=70/30

-continued
W-1
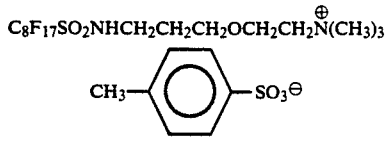
W-2
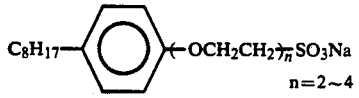
W-3
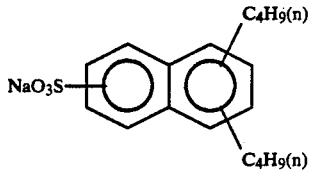
H-1
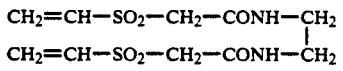
F-1
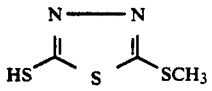
F-2
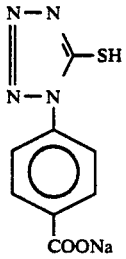
F-3
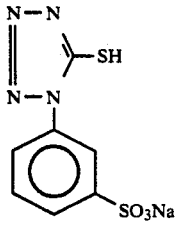
F-4
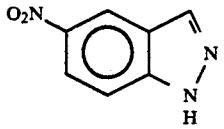
F-5
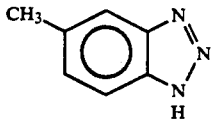
F-6
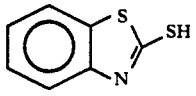

-continued

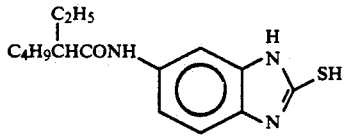

F-7

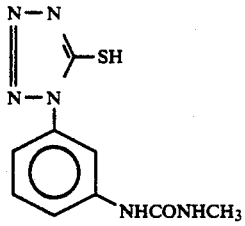

F-8

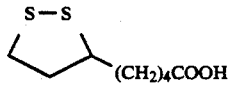

F-9

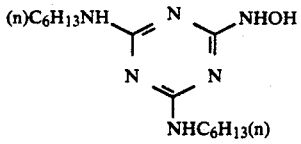

F-10

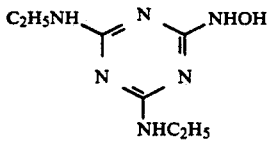

F-11

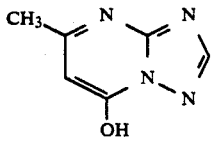

F-12

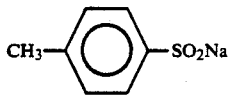

F-13

The photographic material thus prepared was exposed through an optical wedge and processed in the following steps. To evaluate rapid processing properties after the bleaching step, the rack of the automatic processor was replaced with a shortened rack such shorter processing times could be selected.

In the processing (1), the time of each of the bleaching, bleach-fixing and fixing was 50 seconds. In the processing (2), the time of each of the bleaching and bleach-fixing was shortened to 20 seconds, and the time of fixing was shortened to 30 seconds.

| Processing Step | | | | |
|---|---|---|---|---|
| Step | Processing Time | Processing Temperature | Replenishment Rate* | Tank Capacity |
| Color Development | 3 min 15 sec | 38.0° C. | 23 ml | 10 l |
| Bleaching | | | | |
| (1) | 50 sec | 38.0° C. | 5 ml | 5 l |
| (2) | 20 sec | | | |
| Bleach- | | | | |

-continued

| Processing Step | | | | |
|---|---|---|---|---|
| Step | Processing Time | Processing Temperature | Replenishment Rate* | Tank Capacity |
| Fixing | | | | |
| (1) | 50 sec | 38.0° C. | — | 5 l |
| (2) | 20 sec | | | |
| Fixing | | | | |
| (1) | 50 sec | 38.0° C. | 16 ml | 5 l |
| (2) | 30 sec | | | |
| Rinse (1) | 30 sec | 38.0° C. | — | 3 l |
| Rinse (2) | 20 sec | 38.0° C. | 34 ml | 3 l |
| Stabilization | 20 sec | 38.0° C. | 20 ml | 3 l |
| Drying | 1 min | 55° C. | | |

*Replenishment rate being per 35 mm wide by 1 m long strip of the photographic material.

Rinse was a countercurrent system of from (2) to (1), and all of the overflow of the rinsing water was introduced into the fixing bath. Replenishment to the bleach-fixing bath was carried out in the following manner. The upper part of the bleaching tank in the automatic processor was connected with the bottom of the bleach-fixing tank by means of a pipe, and the upper part of the fixing tank was connected with the bottom of the bleach-fixing tank by means of a pipe such that all of the overflow produced by the supply of replenisher to the bleaching tank and the fixing tank was allowed to flow into the bleach-fixing bath. The amount of the developing solution carried into the bleaching step, the amount of the bleaching solution carried into the fixing step and the amount of the fixing solution carried into the rinsing step were 2.5 ml, 2.0 ml and 2.0 ml, respectively, each amount being per 35 mm wide by 1 mm long strip of the photographic material. Cross-over time was 5 seconds in each case. The cross-over time was included in the processing time of the previous step.

The processing was started by using the following mother solution having the following composition. While the wash processing step was replenished with a replenisher in an amount corresponding to the processed amount of the photographic material, the processing was continuously carried out until the accumulated replenishment rate reached three times the tank capacity.

Each processing solution had the following composition.

Developing Solution

| | Mother Solution (g) | Replenisher (g) |
|---|---|---|
| Diethylenetriaminepentaacetic acid | 2.0 | 2.2 |
| 1-Hydroxyethylidene-1,1-diphosphonic acid | 3.3 | 3.3 |
| Sodium sulfite | 3.9 | 5.2 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino]aniline sulfate | 4.5 | 6.1 |
| Add water to make | 1.0 l | 1.0 l |
| pH | 10.05 | 10.15 |

Bleaching Solution

| | Mother Solution (g) | Replenisher (g) |
|---|---|---|
| Metal chelate compound indicated in Table I-5 | 0.3 mol | 0.43 mol |
| Ammonium bromide | 84.0 | 120.0 |
| Ammonium nitrate | 17.5 | 25.0 |
| Hydroxyacetic acid | 63.0 | 90.0 |
| Acetic acid | 33.2 | 47.4 |
| Add water to make | 1.0 l | 1.0 l |
| pH (adjusted with ammonia water) | 3.20 | 2.80 |

Mother Solution of Bleach-Fixing Solution

A mixed solution of the above-described mother solution of the bleaching solution and the following mother solution of the fixing solution of 15:85 (by volume).

Fixing Solution

| | Mother Solution (g) | Replenisher (g) |
|---|---|---|
| Ammonium sulfite | 19.0 | 57.0 |
| Aqueous ammonium thiosulfate solution (700 g/l) | 280 ml | 840 ml |
| Imidazole | 28.5 | 85.5 |
| Ethylenediaminetetraacetic acid | 12.5 | 37.5 |
| Add water to make | 1.0 l | 1.0 l |
| pH (adjusted with ammonia water and acetic acid) | 7.40 | 7.45 |

Rinsing Water

Mother solution and replenisher had the same composition.

Tap water was passed through a mixed bed column packed with H type strongly acidic cation exchange resin (Amberlite IR-120B, a product of Rohm & Haas Co.) and OH type strongly basic anion exchange resin (Amberlite IRA-400) to reduce the concentration of each of calcium ion and magnesium ion to not higher than 3 mg/l. Subsequently, sodium dichloroisocyanurate (20 mg/l) and sodium sulfate (150 mg/l) were added thereto. The pH of the solution was in the range of 6.7 to 7.5.

Stabilizing Solution

Mother solution and replenisher had the same composition.

| | |
|---|---|
| Formalin (37%) | 2.0 ml |
| Polyoxyethylene p-monononylphenyl ether (average degree of polymerization: 10) | 0.3 g |
| Disodium ethylenediaminetetraacetate | 0.05 g |
| Add water to make | 1.0 l |
| pH | 5.0–8.0 |

The processed sample was tested under the same conditions as those of Example I-1 to evaluate an increase in stain during the storage of image. The results are shown in Table I-5.

Furthermore, the sample was uniformly exposed to provide a gray density of 2.0, and the exposed sample was processed in the same manner as described above. The amount of silver remaining in the sample was determined by X-ray fluorometry. The results are shown in Table I-5.

TABLE I-5

| No. | Metal Chelate Compound | Processing | Amount of Residual Silver (μg/cm²) At the Time of Start*1 | Amount of Residual Silver (μg/cm²) After Running*2 | Increase of Stain ΔD(G) At the Time of Start*1 | Increase of Stain ΔD(G) After Running*2 | Remarks |
|---|---|---|---|---|---|---|---|
| 501 | Comparative Compound | (1) | 12 | 18 | 0.16 | 0.36 | Comp. Ex. |
| | A of Ex. I-4 | (2) | 20 | 75 | 0.22 | 0.44 | |
| 502 | Comparative Compound | (1) | 3.2 | 4.3 | 0.07 | 0.18 | Comp. Ex. |
| | B of Ex. I-4 | (2) | 6.5 | 7.1 | 0.12 | 0.25 | |
| 503 | Exemplary | (1) | 2.4 | 2.8 | 0.01 | 0.03 | Invention |
| | Compound K-1 | (2) | 2.8 | 3.1 | 0.02 | 0.03 | |

TABLE I-5-continued

| No. | Metal Chelate Compound | Processing | Amount of Residual Silver (μg/cm²) At the Time of Start*1 | Amount of Residual Silver (μg/cm²) After Running*2 | Increase of Stain ΔD(G) At the Time of Start*1 | Increase of Stain ΔD(G) After Running*2 | Remarks |
|---|---|---|---|---|---|---|---|
| 504 | Exemplary | (1) | 2.0 | 2.4 | 0.00 | 0.02 | Invention |
| | Compound K-3 | (2) | 2.6 | 2.8 | 0.01 | 0.03 | |
| 505 | Exemplary | (1) | 1.8 | 2.1 | 0.02 | 0.01 | Invention |
| | Compound K-6 | (2) | 2.2 | 2.4 | 0.01 | 0.02 | |
| 506 | Exemplary | (1) | 1.6 | 2.0 | 0.01 | 0.01 | Invention |
| | Compound K-7 | (2) | 2.0 | 2.1 | 0.02 | 0.02 | |
| 507 | Exemplary | (1) | 1.7 | 1.8 | 0.01 | 0.01 | Invention |
| | Compound K-8 | (2) | 2.0 | 2.0 | 0.01 | 0.02 | |

*1: At the start of processing
*2: After the accumulated replenishment rate reached three times the tank capacity.

It is clearly seen that when the compounds of the present invention are used, the amount of residual silver is reduced and the degree of increase in stain upon storage is low in comparison with the comparative compounds.

EXAMPLE I-6

The same photographic material as that of Example I-3 was prepared, and the following processing solutions were prepared.

Color Developing Solution

| | Mother Solution | Replenisher |
|---|---|---|
| Water | 700 ml | 700 ml |
| Diethylenetriaminepentaacetic acid | 0.4 g | 0.4 g |
| N,N,N-Tris(methylenephosphonic acid) | 4.0 g | 4.0 g |
| Disodium salt of 1,2-dihydroxybenzene-4,6-disulfonic acid | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightener (WHITEX 4B, a product of Sumitomo Chemical Co., Ltd.) | 1.0 g | 3.0 g |
| Sodium sulfite | 0.1 g | 0.1 g |
| N,N-Bis(sulfoethyl)hydroxylamine | 10.0 g | 13.0 g |
| N-Ethyl-N-(-methanesulfonamidoethyl)-3-methyl-4-aminoaniline sulfate | 5.0 g | 11.5 g |
| Add water to make | 1000 ml | 1000 ml |
| pH (25° C.) | 10.10 | 11.10 |

Bleaching-Fixing Solution

| | Mother Solution | Replenisher |
|---|---|---|
| Water | 600 ml | 600 ml |
| Ammonium thiosulfate (700 g/l) | 100 ml | 250 ml |
| Ammonium sulfite | 40 ml | 100 ml |
| Compound indicated in Table I-6 | 0.138 mol | 0.339 mol |
| Ethylenediaminetetraacetic acid | 5 g | 12.5 g |
| Ammonium bromide | 40 g | 75 g |
| Nitric acid (67 wt %) | 30 g | 65 g |

-continued

| | Mother Solution | Replenisher |
|---|---|---|
| Add water to make | 1000 ml | 1000 ml |
| pH (25° C.) (adjusted with acetic acid and ammonia water) | 5.8 | 5.6 |

The photographic material was uniformly exposed to provide a gray density of 2.2, and the exposed material was processed in the following manner to determine the amount of residual silver after processing. The amount of residual silver of the sample was determined by X-ray fluorometry.

The same was subjected to gradation exposure through a wedge and processed in the same manner as described above to examine an increase in stain upon storage after processing. The processed sample was stored at 80° C. and 70% RH for one week, and an increase in stain before and after storage was evaluated.

The processing was carried out in the following steps by using the above-described processing solutions. The processing was started by introducing each tank solution into each processing tank and continuously carried out while adding each replenisher in an amount corresponding to the amount of sample processed in each tank.

The processing was carried out until the accumulated replenishment rate reached three times the tank capacity. The results obtained at this time of the processing are shown in Table I-6.

| Step | Temperature | Time | Replenishment Rate | Tank Capacity |
|---|---|---|---|---|
| Color Development | 39° C. | 45 sec | 70 ml | 20 l |
| Bleach-Fixing** | 35° C. | (a) 45 sec<br>(b) 20 sec | 60 ml | 20 l |
| Rinse (1) | 35° C. | 20 sec | — | 10 l |
| Rinse (2) | 35° C. | 20 sec | — | 10 l |
| Rinse (3) | 35° C. | 20 sec | 360 ml | 10 l |
| Drying | 80° C. | 60 sec | | |

(*Replenishment rate per m² of photographic material)
(Three tank countercurrent system of from rinse (3) to (1))
(**In addition to 60 ml described above, 120 ml per m² of photographic material processed from rinse (1) was introduced into the bleach-fixing).

Rinsing water of Example I-1 was used for the rinse.

TABLE I-6

| No. | Metal Chelate Compound | Bleaching-Fixing Time | Amount of Residual Silver (μg/cm²) | Increase of Stain ΔD | Remarks |
|---|---|---|---|---|---|
| 601 | Comparative Compound A of Ex. I-4 | 45 sec | 2.6 | 0.11 | Comp. Ex. 1 |
| | | 20 sec | 8.0 | 0.20 | |

TABLE I-6-continued

| No. | Metal Chelate Compound | Bleaching-Fixing Time | Amount of Residual Silver ($\mu g/cm^2$) | Increase of Stain ΔD | Remarks |
|---|---|---|---|---|---|
| 602 | Comparative Compound | 45 sec | 10.0 | 0.03 | Comp. Ex. 2 |
| | B of Ex. I-4 | 20 sec | 20.2 | 0.04 | |
| 603 | Exemplary | 45 sec | 0.6 | 0.05 | Invention |
| | Compound K-1 | 20 sec | 2.0 | 0.08 | |
| 604 | Exemplary | 45 sec | 0.4 | 0.03 | Invention |
| | Compound K-3 | 20 sec | 1.2 | 0.04 | |
| 605 | Exemplary | 45 sec | 0.3 | 0.02 | Invention |
| | Compound K-6 | 20 sec | 0.8 | 0.03 | |
| 606 | Exemplary | 45 sec | 0.3 | 0.01 | Invention |
| | Compound K-7 | 20 sec | 0.6 | 0.03 | |

It is clearly seen from Table I-6 that the bleaching agents of the present invention are superior in properties with regard to desilverization as well as stain upon storage after processing as compared to the bleaching agents of the Comparative Examples. The effect of the present invention is particularly remarkable wherein the bleach-fixing time is shortened. Namely, even when the bleach-fixing time is reduced by ½ or less, the amount of residual silver is small and staining upon storage is superior before and after running. In Comparative Example 2 wherein comparative compound B is used, there is little residual silver when processing is carried out immediately after the preparation of the processing solution, but the desilverization property is greatly reduced and precipitates are formed as the running proceeds.

EXAMPLE I-7

Fuji color SUPER HG400 (the manufacturer's serial number 311130) and Fuji color REALA (the manufacturer's serial number 861016) were processed by processing Nos. 201 to 211 of Example I-2, similar effects to those of Example I-2 were obtained.

It is clearly seen from the above disclosures that when the compositions having a bleaching ability according to the present invention are used, rapid processing is achieved with the formation of bleach fog, staining substantially does not form upon storage after processing, and a high degree of desilverization is achieved.

EXAMPLE II-1

The same photographic material as that of Example I-3 was prepared, and the following processing solutions were prepared. Each processing solution had the following composition.

Color Developing Solution

| | |
|---|---|
| Water | 600 ml |
| Potassium bromide | 0.015 g |
| Potassium chloride | 3.1 g |
| Triethanolamine | 10.0 g |
| Potassium carbonate | 27 g |
| Fluorescent brightener (WHITEX 4B, a product of Sumitomo Chemical Co., Ltd.) | 1.0 g |
| Preservative (A) | 45 mmol |
| N-Ethyl-N-(β-methanesulfonamidoethyl)-3-methyl-4-aminoaniline sulfonate | 5.0 g |
| Add water to make | 1000 ml |
| pH (25° C.) | 10.05 |

The above developing solution is referred to as sample 1101. Samples 1102 to 1112 were prepared by adding the compounds of formula (I) of the present invention and comparative compounds in the amounts indicated in Table II-1 below.

Preservative (A)

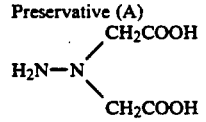

Bleach-Fixing Solution

| | |
|---|---|
| Water | 400 ml |
| Ammonium thiosulfate (70 wt %) | 100 ml |
| Sodium sulfite | 17 g |
| Iron(III) ammonium salt of ethylenediaminetetraacetic acid | 55 g |
| Disodium ethylenediaminetetraacetate | 5 g |
| Ammonium bromide | 40 g |
| Add water to make | 1000 ml |
| pH (25° C.) | 6.0 |

Rinsing Solution

Ion-exchanged water (the concentration of each of calcium ion and magnesium ion being not higher than 3 ppm).

5 ppm of ferric ion and 150 ppm of calcium ion were added to each of the above color developing solutions, and each solution was stored in a beaker having an opening ratio of 0.10 $cm^{-1}$ at 38° C. for 20 days.

The above-described photographic material was subjected to gradation exposure through three-color separation filter for sensitometry by using a sensitometer (FWH type, manufactured by Fuji Photo Film Co., Ltd.). Exposure time was 0.1 second and exposure was conducted to provide an exposure amount of 250 CMS.

After exposure, processing was carried out in the following steps by using the fresh solutions (the above color developing solutions immediately after the preparation thereof) and the stored solutions (the color developing solutions which were stored for a given period of time after preparation).

| Processing Step | Temp. | Time |
|---|---|---|
| Color development | 38° C. | 45 sec |
| Bleach-fixing | 35° C. | 45 sec |
| Rinse (1) | 35° C. | 20 sec |
| Rinse (2) | 35° C. | 20 sec |
| Rinse (3) | 35° C. | 20 sec |
| Drying | 80° C. | 60 sec |

The sample was processed with each of the fresh color developing solution (the fresh solution) and the stored color developing solution (the stored solution). The minimum density (Dmin) of the yellow and the sensitivity of the magenta (logarithmic value log E of an exposure amount giving a density of 0.5) images were measured. The increase (ΔDmin) in the minimum density of the yellow image and the change (ΔS) in the sensitivity of magenta image were measured. Furthermore, the residual amount of the developing agent in the stored solution was determined by means of high speed liquid chromatography to determine whether a precipitate was formed in the developing solution with the passage of time. The results are shown in Table II-1.

It is clearly seen that the processing in accordance with the present invention results in small ΔDmin and ΔS values such that variation in photographic characteristics is minimal.

With regard to the residual amount of the developing agent, the developing agent remains unchanged in an amount sufficient to exhibit effective performance when the compounds of formula (I) of the present invention is used.

Furthermore, the formation of precipitates is greatly reduced in comparison with Comparative Examples.

Conventional compounds effective for preventing the formation of precipitates are poor in the preservability of the developing agents, while conventional compounds which do not decompose the developing agent are not effective for preventing the formation of a precipitate.

The compounds of formula (I) of the present invention provide stable developing solutions without the formation of a precipitate.

TABLE II-1

| No. | Chelating Agent (Amount Added) | Yellow Dmin | Magenta (ΔS) | Residual Amount of Developing Agent (%) | Formation of Precipitate* | Remarks |
|---|---|---|---|---|---|---|
| 1101 | Not added | +0.08 | −0.10 | 60 | BBB | Comp. Ex. |
| 1102 | Sodium hexametaphosphate (1 g/l) | +0.04 | −0.06 | 80 | BB | " |
| 1103 | 1-Hydroxyethylidene-1,1-diphosphonic acid (60%) (1.6 g/l) | +0.04 | −0.05 | 80 | BB | " |
| 1104 | Ethylenediaminetetra-acetic acid (1 g/l) | +0.06 | −0.08 | 65 | G | " |
| 1105 | Nitrilotrimethylene- (1 g/l) phosphonic acid | +0.05 | −0.07 | 75 | B | " |
| 1106 | Exemplary Compound 1 (1 g/l) | +0.01 | −0.01 | 95 | G | Invention |
| 1107 | Exemplary Compound 4 (1 g/l) | +0.01 | ±0 | 93 | G | " |
| 1108 | Exemplary Compound 7 (1 g/l) | ±0 | ±0 | 94 | G | " |
| 1109 | Exemplary Compound 8 (1 g/l) | +0.01 | ±0 | 98 | G | " |
| 1110 | Exemplary Compound 9 (1 g/l) | ±0 | −0.01 | 98 | G | " |
| 1111 | Exemplary Compound 11 (1 g/l) | ±0 | −0.01 | 96 | G | " |
| 1112 | Exemplary Compound 12 (1 g/l) | +0.01 | −0.01 | 95 | G | " |

EXAMPLE II-2

An undercoated cellulose triacetate film support was coated with the following layers having the following compositions to prepare a multi-layer color photographic material as a sample.

Composition of Sensitive Layer

Each layer had the following composition. Numerals represent coating weight (g/m$^2$). The amounts of silver halide and colloidal silver are represented by coating weight (g/m$^2$) in terms of silver. The amounts of sensitizing dyes are represented by moles per one mole of silver halide in the same layer.

| | |
|---|---|
| First Layer: Antihalation Layer | |
| Black colloidal silver | 0.2 (as silver) |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Second Layer: Interlayer | |
| Fine silver bromide grains (Grain size: 0.07 μm in terms of a diameter of a sphere) | 0.15 (as silver) |
| Gelatin | 1.0 |
| Cpd-2 | 0.2 |
| Third Layer: First Red-Sensitive Emulsion Layer | |
| Silver iodobromide emulsion (AgI content: 10.0 mol %, internal high AgI type, grain size: 0.7 μm (in terms of a diameter of a sphere), a coefficient of variation in grain size (in terms of a diameter of a sphere): 14%, tetradecahedral grains) | 0.26 (as silver) |
| Silver iodobromide emulsion (AgI content: 4.0 mol %, internal high AgI type, grain size: 0.4 μm (in terms of a diameter of a sphere), a coefficient of variation in grain size (in terms of a diameter of a sphere): 22%, tetradecahedral grains) | 0.2 (as silver) |
| Gelatin | 1.0 |
| ExS-1 | $4.5 \times 10^{-4}$ |
| ExS-2 | $1.5 \times 10^{-4}$ |
| ExS-3 | $0.4 \times 10^{-4}$ |
| ExS-4 | $0.3 \times 10^{-4}$ |
| ExC-1 | 0.15 |
| ExC-7 | 0.15 |
| ExC-2 | 0.009 |
| ExC-3 | 0.023 |
| ExC-6 | 0.14 |
| Fourth Layer: Second Red-Sensitive Emulsion Layer | |
| Silver iodobromide emulsion (AgI content: 16 mol %, internal high AgI type, grain size: 1.0 μm (in terms of a diameter of a sphere), a coefficient of variation | 0.55 (as silver) |

-continued

| | |
|---|---|
| in grain size (in terms of a diameter of a sphere): 25%, plate-shaped grains, ratio of diameter/thickness: 4.0) | |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-3 | 0.05 |
| ExC-4 | 0.10 |
| ExC-6 | 0.08 |
| Fifth Layer: Third Red-Sensitive Emulsion Layer | |
| Silver iodobromide emulsion (AgI content: 10.0 mol %, internal high AgI type, grain size: 1.2 μm (in terms of a diameter of a sphere), a coefficient of variation in grain size (in terms of a diameter of a sphere): 28%, plate-shaped grains, ratio of diameter/thickness: 6.0) | 0.9 (as silver) |
| Gelatin | 0.6 |
| ExS-1 | $2 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| Sixth Layer: Interlayer | |
| Gelatin | 1.0 |
| Cpd-4 | 0.1 |
| Seventh Layer: First Green-Sensitive Emulsion Layer | |
| Silver iodobromide emulsion (AgI content: 10.0 mol %, internal high AgI type, grain size: 0.7 μm (in terms of a diameter of a sphere), a coefficient of variation in grain size (in terms of a diameter of a sphere): 14%, tetradecahedral grains) | 0.2 (as silver) |
| Silver iodobromide emulsion (AgI content: 14.0 mol %, internal high AgI type, grain size: 0.4 μm (in terms of a diameter of a sphere), a coefficient of variation in grain size (in terms of a diameter of a sphere): 22%, tetradecahedral grains) | 0.1 (as silver) |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.20 |
| ExM-6 | 0.25 |
| ExM-2 | 0.10 |
| ExM-5 | 0.03 |
| Solv-1 | 0.40 |
| Solv-4 | 0.03 |
| Eighth Layer: Second Green-Sensitive Emulsion Layer | |
| Silver iodobromide emulsion (AgI content: 10 mol %, internal high AgI type, grain size: 1.0 μm (in terms of a diameter of a sphere), a coefficient of variation in grain size (in terms of a diameter of a sphere): 25%, plate-shaped grains, ratio of diameter/thickness: 3.0) | 0.4 (as silver) |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |

-continued

| | |
|---|---|
| Solv-4 | 0.03 |
| Ninth Layer: Interlayer | |
| Gelatin | 0.5 |
| Tenth Layer: Third Green-Sensitive Emulsion Layer | |
| Silver iodobromide emulsion (AgI content: 10.0 mol %, internal high AgI type, grain size: 1.2 μm (in terms of a diameter of a sphere), a coefficient of variation in grain size (in terms of a diameter of a sphere): 28%, plate-shaped grains, ratio of diameter/thickness: 6.0) | 1.0 (as silver) |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |
| ExC-4 | 0.005 |
| Solv-1 | 0.2 |
| Eleventh Layer: Yellow Filter Layer | |
| Cpd-3 | 0.05 |
| Gelatin | 0.5 |
| Solv-1 | 0.1 |
| Twelfth Layer: Interlayer | |
| Gelatin | 0.5 |
| Cpd-2 | 0.1 |
| Thirteenth Layer: First Blue-Sensitive Emulsion Layer | |
| Silver iodobromide emulsion (AgI content: 10 mol %, internal high AgI type, grain size: 0.7 μm (in terms of a diameter of a sphere), a coefficient of variation in grain size (in terms of a diameter of a sphere): 14%, tetradecahedral grains) | 0.1 (as silver) |
| Silver iodobromide emulsion (AgI content: 4.0 mol %, internal high AgI type, grain size: 0.4 μm (in terms of a diameter of a sphere), a coefficient of variation in grain size (in terms of a diameter of a sphere): 22%, tetradecahedral grains) | 0.05 (as silver) |
| Gelatin | 1.0 |
| ExS-8 | $3 \times 10^{-4}$ |
| ExY-1 | 0.25 |
| ExY-3 | 0.32 |
| ExY-2 | 0.02 |
| Solv-1 | 0.20 |
| Fourteenth Layer: Second Blue-Sensitive Emulsion Layer | |
| Silver iodobromide emulsion (AgI content: 19.0 mol %, internal high AgI type, grain size: 1.0 μm (in terms of a diameter of a sphere), a coefficient of variation in grain size (in terms of a diameter of a sphere): 16%, tetradecahedral grains) | 0.19 (as silver) |
| Gelatin | 0.3 |
| ExS-8 | $2 \times 10^{-4}$ |
| ExY-1 | 0.22 |
| Solv-1 | 0.07 |
| Fifteenth Layer: Interlayer | |
| Fine silver iodobromide grains AgI content: 2 mol %, uniform type, grain size: 0.13 μm in terms of a diameter of a sphere) | 0.2 (as silver) |
| Gelatin | 0.36 |
| Sixteenth Layer: Third Blue-Sensitive Emulsion Layer | |
| Silver iodobromide emulsion (AgI content: 14.0 mol %, internal high AgI type, grain size: 1.5 μm (in terms | 1.0 (as silver) |

-continued

| | |
|---|---|
| of a diameter of a sphere), a coefficient of variation in grain size (in terms of a diameter of a sphere): 28%, plate-shaped grains, ratio of diameter/thickness: 5.0) | |
| Gelatin | 0.5 |
| ExS-8 | $1.5 \times 10^{-4}$ |
| ExY-1 | 0.2 |
| Solv-1 | 0.07 |
| Seventeenth Layer: First Protective Layer | |
| Gelatin | 1.8 |
| UV-1 | 0.1 |

-continued

| | |
|---|---|
| UV-2 | 0.2 |
| Solv-1 | 0.01 |
| Solv-2 | 0.01 |
| Eighteenth Layer: Second Protective Layer | |
| Fine silver iodobromide grains grain size: 0.07 μm in terms of a diameter of a sphere) | 0.18 (as silver) |
| Gelatin | 0.7 |
| Polymethyl methacrylate particles (particle diameter: 1.5 μm) | 0.2 |
| W-1 | 0.02 |
| H-1 | 0.4 |
| Cpd-5 | 1.0 |

UV-1

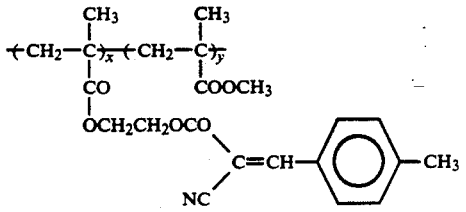

x/y = 7/3 (by weight)

UV-2

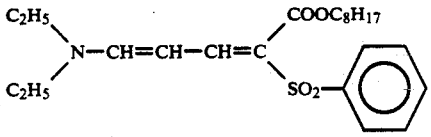

ExM-3

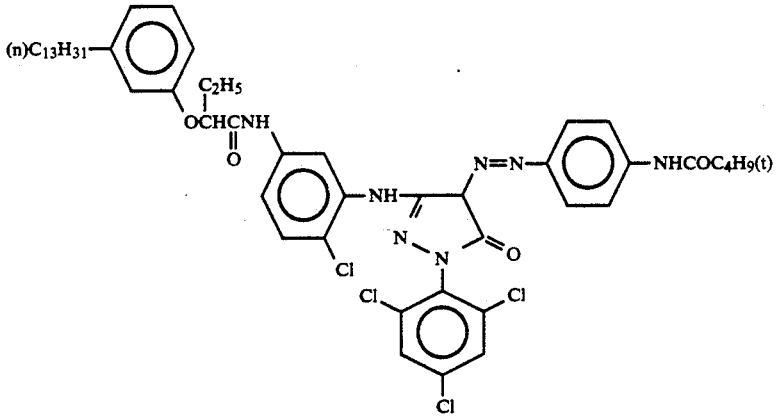

ExC-1

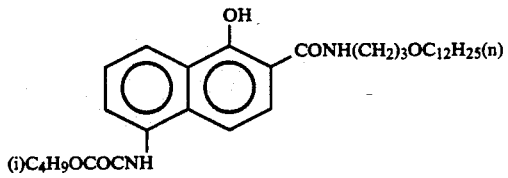

ExC-2

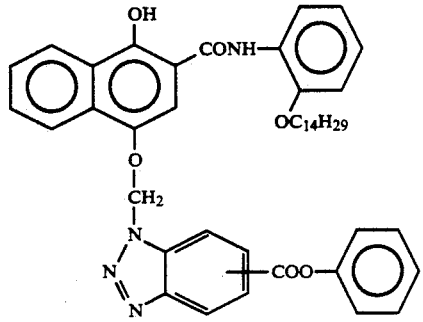

-continued
ExC-3
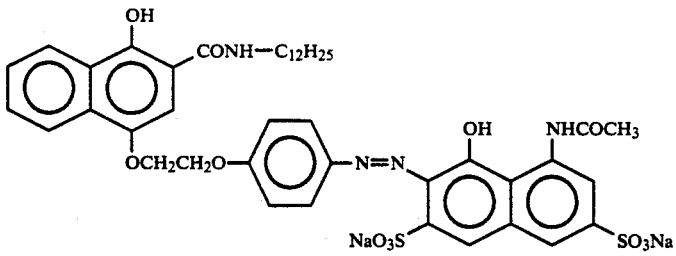
ExC-6
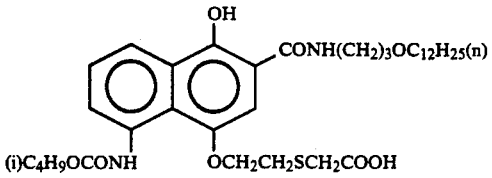
ExC-7
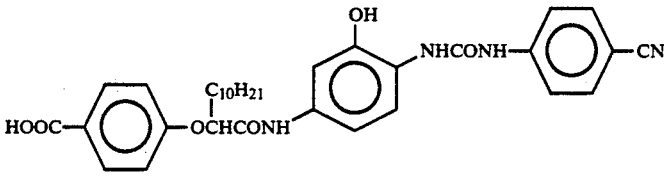
ExC-4
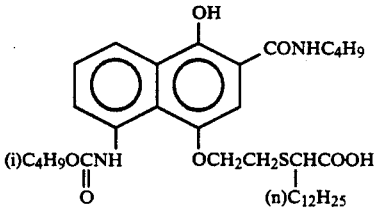
ExC-5
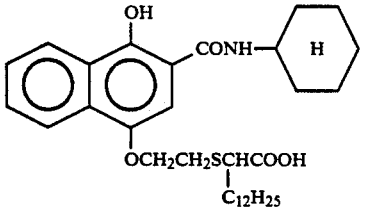
ExM-1
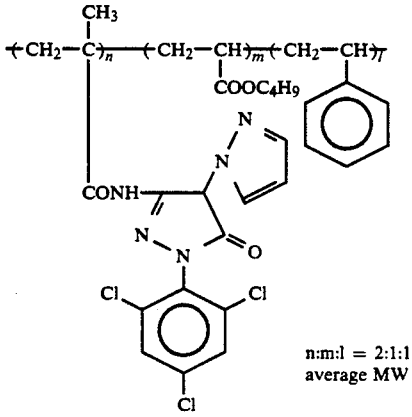
n:m:l = 2:1:1 (by weight)
average MW 40,000

-continued
ExM-2
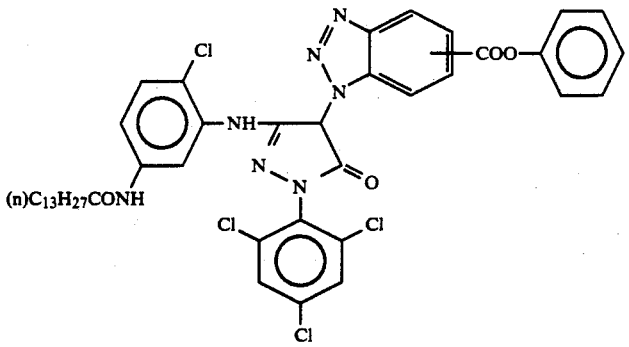
ExM-4
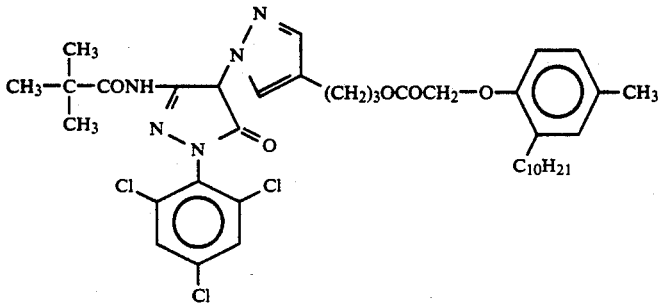
ExM-5
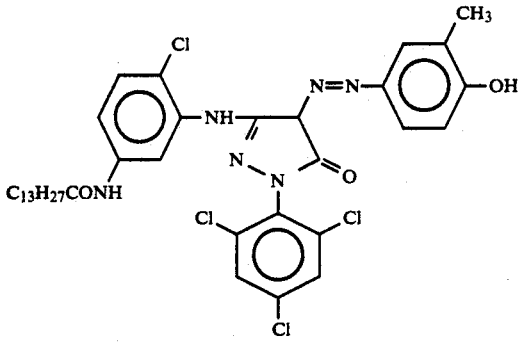
ExM-6
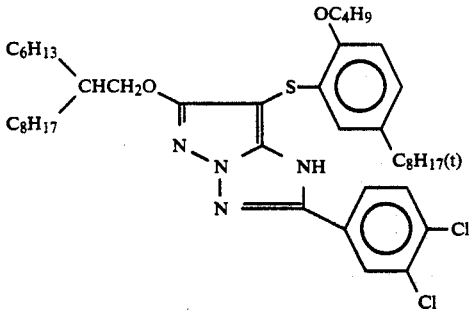
ExY-1
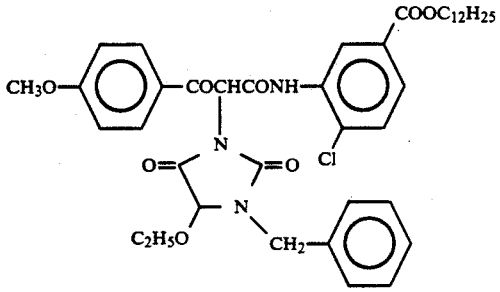

-continued
ExY-2
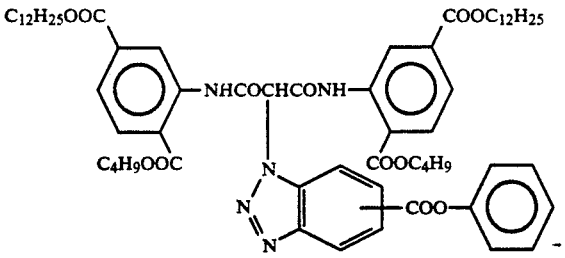
ExY-3
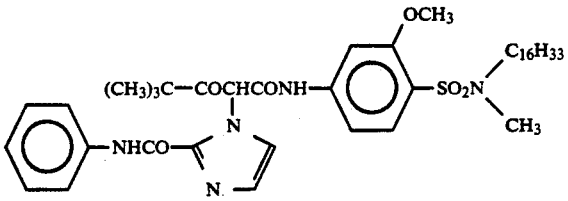
ExS-1
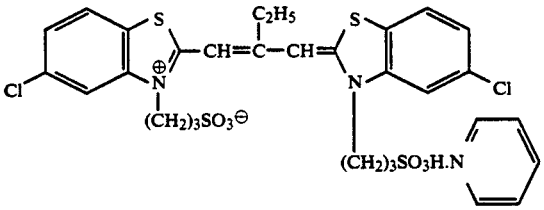
ExS-2
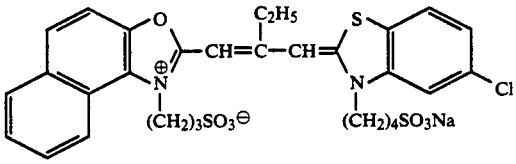
ExS-3
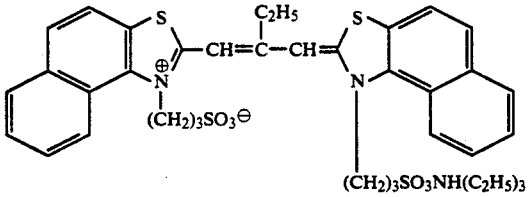
ExS-4
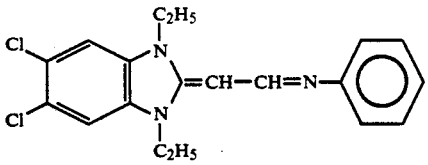
ExS-5
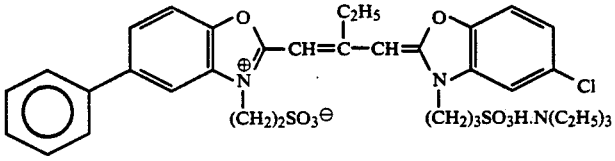
ExS-6
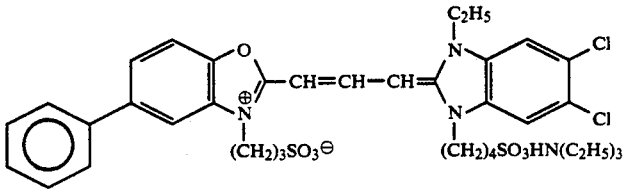

-continued
ExS-8
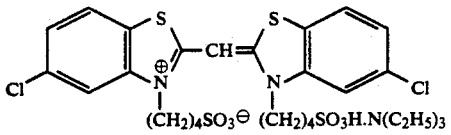
ExS-7
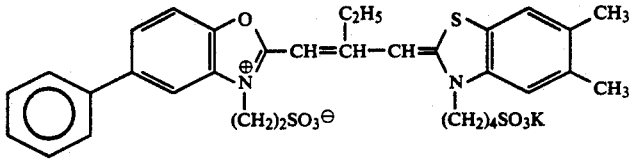
Solv-1
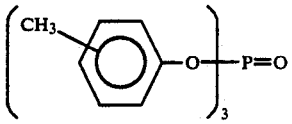
Solv-2
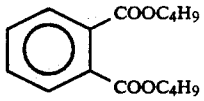
Solv-3
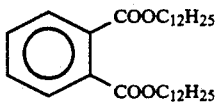
Solv-4
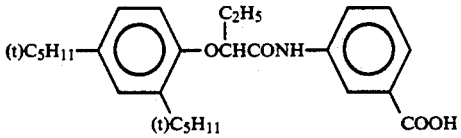
Cpd-1
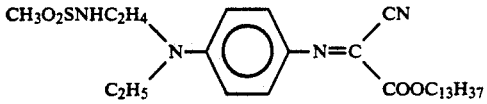
Cpd-2
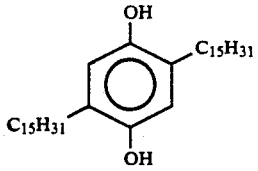
Cpd-3
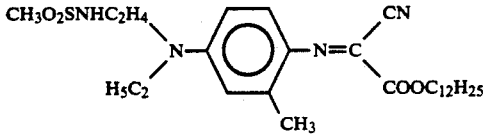
Cpd-4
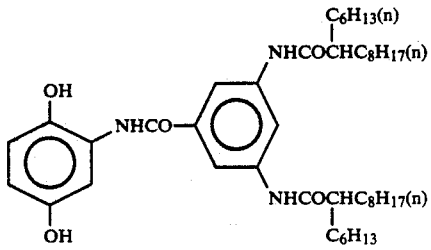

-continued

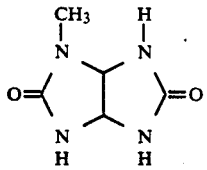

Cpd-5

$C_8H_{17}SO_2NHCH_2CH_2CH_2OCH_2CH_2N^{\ominus}(CH_3)_3$

W-1

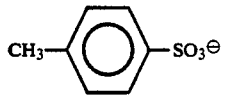

$CH_3=CHSO_2CH_2CONH-CH_2$
$CH_3=CHSO_2CH_2CONH-CH_2$

H-1

The following processing solutions were prepared.

Color Developing Solution

| | Mother Solution (g) | Replenisher (g) |
|---|---|---|
| Diethylenetriaminepentaacetic acid | 1.0 | 1.0 |
| Compound indicated in Table II-2 | 0.01 mol | The same amount as that of mother solution |
| Sodium sulfite | 4.0 | 4.9 |
| Potassium carbonate | 30.0 | 30.0 |
| Potassium bromide | 1.4 | — |
| Potassium iodide | 1.5 mg | |
| Hydroxylamine sulfate | 2.4 | 3.6 |
| 4-(N-Ethyl-N-β-hydroxyethyl-amino)-2-methylaniline sulfate | 4.5 | 6.4 |
| Add water to make | 1.0 l | 1.0 l |
| pH | 10.05 | 10.05 |

Bleaching Solution

| | Mother Solution | Replenisher |
|---|---|---|
| Iron(III) ammonium salt of 1,3-propanediaminetetraacetic acid | 0.55 mol | 0.83 mol |
| Ammonium bromide | 85 g | 125 g |
| Ammonium nitrate | 20 g | 30 g |
| Glycolic acid | 55 g | 83 g |
| Add water to make | 1.0 l | 1.0 l |
| pH | 4.0 | 3.8 |

Fixing Solution

Mother solution and replenisher had the same composition.

| | |
|---|---|
| Iron(III) ammonium salt of ethylenediaminetetraacetic acid | 1.7 g |
| Ammonium sulfite | 14.0 g |
| Aqueous ammonium thiosulfate solution (700 g/l) | 260.0 ml |
| Add water to make | 1.0 l |
| pH | 7.0 |

Rinsing Water

Mother solution and replenisher had the same composition.

Tap water was passed through a mixed bed column packed with H type strongly acidic cation exchange resin (Amberlite IR-120B, a product of Rohm & Haas Co.) and OH type strongly basic anion exchange resin (Amberlite IRA-400) to reduce the concentration of each of calcium ion and magnesium ion to not higher than 3 mg/l. Subsequently, sodium dichloroisocyanurate (20 mg/l) and sodium sulfate (150 mg/l) were added thereto. The pH of the solution was in the range of 6.5 to 7.5.

Fixing Solution

Mother solution and replenisher being the same.

| | |
|---|---|
| Formalin (37 wt %) | 1.2 ml |
| Surfactant $[C_{10}H_{21}-O-(CH_2CH_2O)_{10}-H]$ | 0.4 g |
| Ethylene glycol | 1.0 g |
| Add water to make | 1.0 l |
| pH | 5.0–7.0 |

5 ppm of ferric ion and 150 ppm of calcium ion were added to each of the above color developing solutions to prepare samples 1201 to 1207. Each solution was stored in a circulation type solution-storing testing machine having an opening ratio of 0.11 cm at −38° C. for 30 days.

The sample prepared above was cut to from pieces of 35 mm in width and exposed to white light (color temperature of light source: 4800° K.) through a wedge.

After exposure, the exposed sample was processed in the following steps by using the color developing solutions (samples 1201 to 1207) immediately after the preparation thereof and the color developing solutions (samples 1201 to 1207) which had been stored for a given period of time.

| Processing Step | Processing Time | Processing Temp. |
|---|---|---|
| Color development | 3 min 15 sec | 37.8° C. |
| Bleaching | 50 sec | 38° C. |
| Fixing | 1 min 40 sec | 38° C. |
| Rinse (1) | 30 sec | 38° C. |
| Rinse (2) | 20 sec | 38° C. |

-continued

| Processing Step | Processing Time | Processing Temp. |
|---|---|---|
| Stabilization | 20 sec | 38° C. |

A lowering in density (ΔDmax) of the G (green) density resulting from the use of the stored developing solution was determined on the basis of the maximum density obtained when the sample was processed with the fresh color developing solution (fresh solution). The residue ratios of the developing agents and hydroxylamine after storage were determined by analysis. Furthermore, the color developing solutions were visually examined for the formation of precipitates upon storage. The results are shown in Table II-2.

It is clearly seen from Table II-2 that the remarkable effects of the present invention are obtained only by adding a compound of formula (I) of the present invention to the developing solution. When no chelate compound is added or a conventional chelate compound is added, precipitates are formed or the stability of the solution is unsatisfactory.

TABLE II-2

| No. | Chelating Agent | ΔDmax | Residue Ratio of Developing Agent (%) | Residue Ratio of Hydroxylamine** (%) | Precipitate* |
|---|---|---|---|---|---|
| 1201 | Not added | −0.5 | 61 | 20 | BBB |
| 1202 | Ethylenediaminetetra-acetic acid | −0.4 | 63 | 31 | G |
| 1203 | Ethylenediaminetetra-methylenephosphonic acid | −0.05 | 89 | 70 | B |
| 1204 | Exemplary Compound 7 | −0.04 | 92 | 75 | G |
| 1205 | Exemplary Compound 8 | −0.04 | 90 | 81 | G |
| 1206 | Exemplary Compound 9 | −0.04 | 85 | 75 | G |
| 1207 | Exemplary Compound 12 | −0.02 | 95 | 85 | G |

*G indicates that no precipitate was formed.
B indicates the formation of precipitates (multiple B's indicate the formation of a larger amount of precipitate).
**After oxidation with iodine, sulfanylic acid and α-naphthylamine are added to form red color, and the ratio is determined by spectrophotometry. The residue ratio represents the content of the developing agent or hydroxylamine remaining in the color developing solution after storage of a mol percentage of the content of the original developing solution.

EXAMPLE II-3

Each of compounds 7, 8, 9 and 12 of formula (I) of the present invention in an amount of 3 g/l was added to the fixing solution of Example II-2. Furthermore, ferric ion in an amount corresponding to the amount of ferric ion carried over from the bleaching solution of the prebath was added thereto to prepare sample solutions 1301 to 1304. These sample solutions were stored in a beaker having an opening ratio of 0.1 $cm^{-1}$ at 38° C. for 30 days, and the turbidity of the solutions was observed. The solution not containing a compound of formula (I) became greatly turbid. The fixing solutions containing a compound of formula (I) of the present invention remained clear and did not form a precipitate.

EXAMPLE II-4

The stabilizing solution of Example II-2 was used as such for the purpose of comparison. Each of compounds 7, 8, 9 and 12 in an amount of 100 ml/l was added thereto to prepare sample solutions 1401 to 1405. Processing was carried out in the same manner as in Example II-2 by using these stabilizing solutions and the fresh solutions of Example II-2. After processing, films were stored under wet heat conditions at 45° C. and 70% RH for one week. An increase in stain of the magenta image (ΔDmin) was determined before and after storage.

The results are shown in Table II-4. It is clearly seen that when the stabilizing solution contains a compound of formula (I) of the present invention, staining is reduced and the preservability of image is improved.

TABLE II-4

| No. | Chelate Compound | ΔDmin | |
|---|---|---|---|
| 1401 | Not added | 0.25 | Comp. Ex. |
| 1402 | Compound 7 | 0.06 | Invention |
| 1403 | Compound 8 | 0.04 | " |
| 1404 | Compound 9 | 0.05 | " |
| 1405 | Compound 12 | 0.08 | " |

EXAMPLE II-5

The following bleaching solution was prepared.

| | |
|---|---|
| Hydrogen peroxide (30 wt %) | 50 ml |
| KBr | 28 g |
| Potassium hydrogenphosphate | 10 g |
| Add water to make | 1 l |
| pH | 3.5 |

The above bleaching solution was used for the purpose of comparison. Each of the compounds 7 to 9 of the present invention was added thereto to prepare sample solutions 1501 to 1505.

To examine bleaching performance, the same photographic material as that of Example II-2 was used. The color developing solution used was the sample solution 1201 of Example II-2 and the fixing solution, the stabilizing solution and the rinsing solution were the same as those used in Example II-2.

The following processing was carried out by using the sample solutions 1501 to 1505 (fresh solution) immediately after the preparation thereof and the sample solutions (stored solutions) which were stored at 40° C. for 3 days. The amount of residual silver in the maximum density part was analyzed by X-ray fluorometry. At the same time, the amount of residual hydrogen peroxide was analyzed.

| Processing Step | Processing Time | Processing Temp. |
|---|---|---|
| Color development | 3 min 15 sec | 38° C. |
| Bleaching | 5 min | 40° C. |
| Fixing | 1 min 40 sec | 38° C. |
| Rinse (1) | 30 sec | 38° C. |
| Rinse (2) | 20 sec | 38° C. |
| Stabilization | 20 sec | 38° C. |

| No. | Chelate Compound | Amount of Residual Silver ($\mu g/cm^2$) Fresh Solution | After Storage | Residue Ratio of $H_2O_2$* After the Lapse of Time (%) |
|---|---|---|---|---|
| 1501 | Not added | 2 | 30 | 40 |
| 1502 | Ethylenediamine-tetraacetic acid | 3 | 16 | 61 |
| 1503 | Compound 7 | 3 | 7 | 80 |
| 1504 | Compound 8 | 4 | 8 | 85 |
| 1505 | Compound 9 | 4 | 6 | 83 |

*Titration with potassium permanganate solution under sulfuric acidic conditions.

It is clearly seen that the stability of the bleaching solution is improved by adding thereto a compound of formula (I) of the present invention, even when a bleaching solution containing hydrogen peroxide as the oxidizing agent is used.

EXAMPLE II-6

The sample 201 of Example 2 of JP-A-2-90151, the photographic material 9 of Example 3 of JP-A-2-93641 and the photographic material of Example II-1 were used, and evaluation was made in the same manner as in Example II-2. A similar effect was obtained.

EXAMPLE II-7

The sample 1 of Example 1 of JP-A-2-58041 was used, and disodium ethylenediaminetetraacetate in the developing solution (A) thereof was replaced with an equal amount of compound 8 to prepare a developing solution (B). The developing solution was stored at 40° C. for 4 days and then subjected to running processing. It was found that precipitation was reduced.

The processing compositions of the present invention have the following excellent effects.

(1) Ingredients in the processing solution are inhibited from being oxidized or decomposed by the action of metal ions, and the performance of the processing solution is maintained over a long period of time.

(2) No precipitate is formed in the processing solution even when metal ions are accumulated therein. Accordingly, the staining of film, the clogging of filters in the automatic processors, etc. is prevented.

(3) The image preservability of the processed photographic material is improved.

While the invention has been described in detail and with reference to specific embodiments thereof, it will be apparent to one skilled in the art that various changes and modifications can be made therein without departing from the spirit and scope thereof.

What is claimed is:

1. A photographic processing composition for processing an imagewise exposed silver halide color photographic material, said processing composition containing a metal chelate compound formed from a compound represented by formula (I) and a metal salt selected from the group consisting of the salts of Fe(III), Mn(III), Co(III), Rh(II), Rh(III), Au(III), Au(II) and Ce(IV) in an amount of from 0.05 to 1 mol/liter:

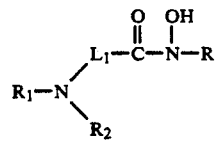

(I)

wherein R, $R_1$ and $R_2$ each represent a hydrogen atom, a substituted or unsubstituted alkyl group or a substituted or unsubstituted aryl group; $L_1$ represents a substituted or unsubstituted alkylene group or a substituted or unsubstituted arylene group.

2. A photographic processing composition as in claim 1, wherein said processing composition is a bleaching solution or a bleach-fixing solution containing said metal chelate compound in an amount of from 0.05 to 1 mol/liter of the processing composition.

3. A photographic processing composition as in claim 1, wherein said metal chelate compound is formed from a compound represented by formula (I) and a metal salt selected from the group consisting of the salts of Fe(III), Mn(III) and Ce(IV).

4. A photographic processing composition as in claim 1, wherein said metal chelate compound is formed from a compound represented by formula (I) and a metal salt of Fe(III).

5. A photographic processing composition as in claim 1, wherein said compound represented by formula (I) is represented by the formula (II) or (III):

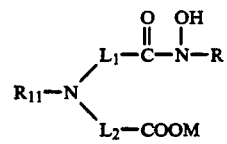

(II)

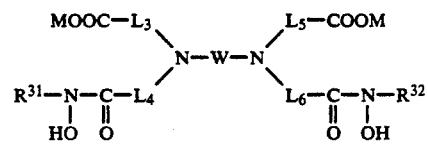

(III)

wherein R, $R_{11}$, $R^{31}$ and $R^{32}$ each represent a hydrogen atom, a substituted or unsubstituted alkyl group or a substituted or unsubstituted aryl group; $L_1$ represents a substituted or unsubstituted alkylene group or a substituted or unsubstituted arylene group; $L_2$, $L_3$, $L_4$, $L_5$ and $L_6$ each represent a substituted or unsubstituted arylene group; M represents a hydrogen atom, an alkali metal or ammonium; and W represents a divalent bonding group which may be substituted by one or more substituent groups connecting to

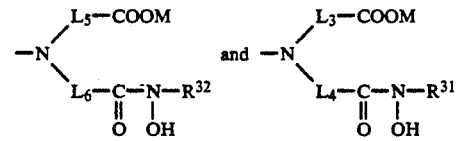

via a substituted or unsubstituted alkylene group (including a cyclohexylene group) or a substituted or unsubstituted arylene group.

6. A photographic processing composition as in claim 5, wherein said metal chelate compound is formed from a compound represented by formula (III) and a metal salt of Fe(III).

7. A photographic processing composition as in claim 1, wherein said processing compositions is a bleach-fixing solution containing said metal chelate compound and a fixing agent.

8. A method for processing an imagewise exposed silver halide color photographic material comprising a support having provided thereon at least one photosensitive silver halide emulsion layer, comprising first processing the silver halide color photographic material in a color developing solution and then in a second processing composition selected from a bleaching or bleach-fixing solution containing a metal chelate compound formed from a compound represented by formula (I) and a metal salt selected from the group consisting of the salts of Fe(III), Mn(III), Co(III), Rh(II), Rh(III), Au(III), Au(II) and Ce(IV) in an amount of from 0.05 to 1 mol/liter:

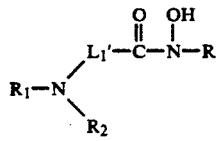

(I)

wherein R, $R_1$ and $R_2$ each represent a hydrogen atom a substituted or unsubstituted alkyl group or a substituted or unsubstituted aryl group; and $L_1$ represents a substituted or unsubstituted alkylene group or a substituted or unsubstituted arylene group.

9. A method for processing a silver halide color photographic material as in claim 8, wherein said at least one photosensitive silver halide emulsion layer comprises a silver halide emulsion having an iodide content of from 0.1 to 30 mol %, and said color photographic material is processed with said second processing composition for a period of from 10 to 60 seconds.

10. A method for processing a silver halide color photographic material as in claim 8, wherein said at least one photosensitive silver halide emulsion layer comprises silver chloride or silver chlorobromide, and said color photographic material is processed with said second processing composition for a period of from 5 to 30 seconds.

11. A photographic processing composition as in claim 1, wherein the substituent groups for the substituted alkyl group and the substituted aryl group represented by R, $R_1$ and $R_2$ and the substituent groups for the substituted alkylene group and the substituted arylene group represented by $L_1$ are selected from the group consisting of an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, a phosphono group, an aryloxycarbonyl group, an acyl group, an alkoxycarbonyl group, an acyloxy group, a carbonamido group, a sulfonamido group, a nitro group and a group of

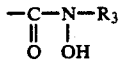

wherein $R_3$ is hydrogen atom, an alkyl group which may be substituted or an aryl group which may be substituted).

12. A method for processing a silver halide color photographic material as in claim 8, wherein the substituent groups for the substituted alkyl group and the substituted aryl group represented by R, $R_1$ and $R_2$ and the substituent groups for the substituted alkylene group and the substituted arylene group represented by $L_1$ are selected from the group consisting of an alkyl group, an aralkyl group, an alkenyl group, an alkynl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arythio group, a sulfonyl group, a sulfinyl group, a hydroxyl group, a halogen atom, a cyano group, a sulfo group, a carboxyl group, a phosphono group, an aryloxycarbonyl group, an acyl group, an alkoxycarbonyl group, an acyloxy group, a carbonamido group, a sulfonamido group, a nitro group and a group of

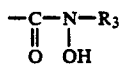

(wherein $R_3$ is hydrogen atom, an alkyl group which may be substituted or an aryl group which may be substituted).

13. A photographic processing composition as in claim 5, wherein the substituents for the substituted alkyl group and the substituted aryl group represented by R, $R_{11}$, $R^{31}$ and $R^{32}$, the substituent groups for the substituted alkylene group and the substituted arylene group represented by $L_2$, $L_3$, $L_4$, $L_5$ and $L_6$ and the substuent groups for the substituted divalent bonding group represeted by W are selected from the group consisting of a carboxyl group, a group of

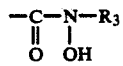

(wherein $R_3$ is a hydrogen atom, an alkyl group which may be substituted or an aryl group which may be substituted), a hydroxyl group, an alkyl group, an aryl group, a sulfo group and a phosphono group.

14. A method for processing a silver halide color photographic material as in claim 8, wherein said compound represented by formula (I) is represented by the formula (II) or (III):

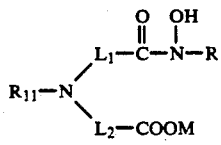

(II)

-continued

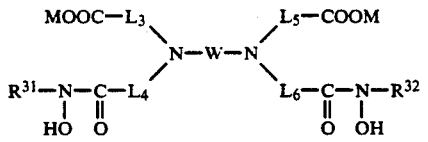

(III)

wherein R, $R_{11}$, $R^{31}$ and $R^{32}$ each represent a hydrogen atom, a substituted or unsubstituted alkyl group or a substituted or unsubstituted aryl group; $L_1$ represents a substituted or unsubstituted alkylene group or a substituted or unsubstituted arylene group; $L_2$, $L_3$, $L_4$, $L_5$ and $L_6$ each represent a substituted or unsubstituted arylene group; M represents a hydrogen atom, an alkali metal or ammonium; and W represents a divalent bonding group which may be substituted by one or more substituent groups connecting to

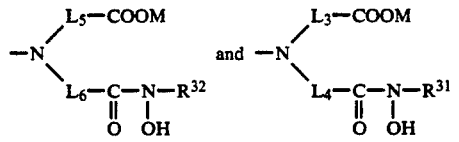

via a substituted or unsubstituted alkylene group (including a cyclohexylene group) or a substituted or unsubstituted arylene group.

15. A method for processing a silver halide color photographic material as in claim 14 wherein the substituents for the substituted alkyl group and the substituted aryl group represented by R, $R_{11}$, $R^{31}$ and $R^{32}$, the substituent groups for the substituted alkylene group and the substituted arylene group represented by $L_2$, $L_3$, $L_4$, $L_5$ and $L_6$ and the substuent groups for the substituted divalent bonding group represeted by W are selected from the group consisting of a carboxyl group, a group of

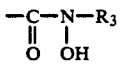

(wherein $R_3$ is a hydrogen atom, an alkyl group which may be substituted or an aryl group which may be substituted), a hydroxyl group, an alkyl group, an aryl group, a sulfo group and a phosphono group.

16. A method for processing a silver halide color photographic material as in claim 14, wherein W is selected from the group consisting of an alkylene group having from 2 to 8 carbon atoms which may be substituted by one or more substituted groups, an arylene group having from 6 to 10 carbon atoms which may be substituted by one or more substituent groups,

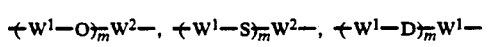

(wherein $W^1$ and $W^2$ each represent an alkylene group having 1 to 8 carbon atoms or an arylene group having 6 to 10 carbon atoms; m represents an integer of 1 to 3; and D represents a 5- to 7-membered divalent heterocyclic group containing at least one atom or N, O and S) and

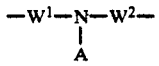

wherein A represents a hydrogen atom, a hydrocarbon, $L_A$-$COOM^1$, $L_A$—$PO_3M^2M^3$, —$L_A$—OH or $L_A$—$SO_3M^4$ wherein $L_A$ is an alkylene group having 1 to 8 carbon atoms or an arylene group having 6 to 10 carbon atoms; and $M^1$ to $M^4$ each represent a hydrogen atom or a cation).

17. A method for processing a silver halide color photographic material as in claim 16, wherein W is selected from the group consisting of

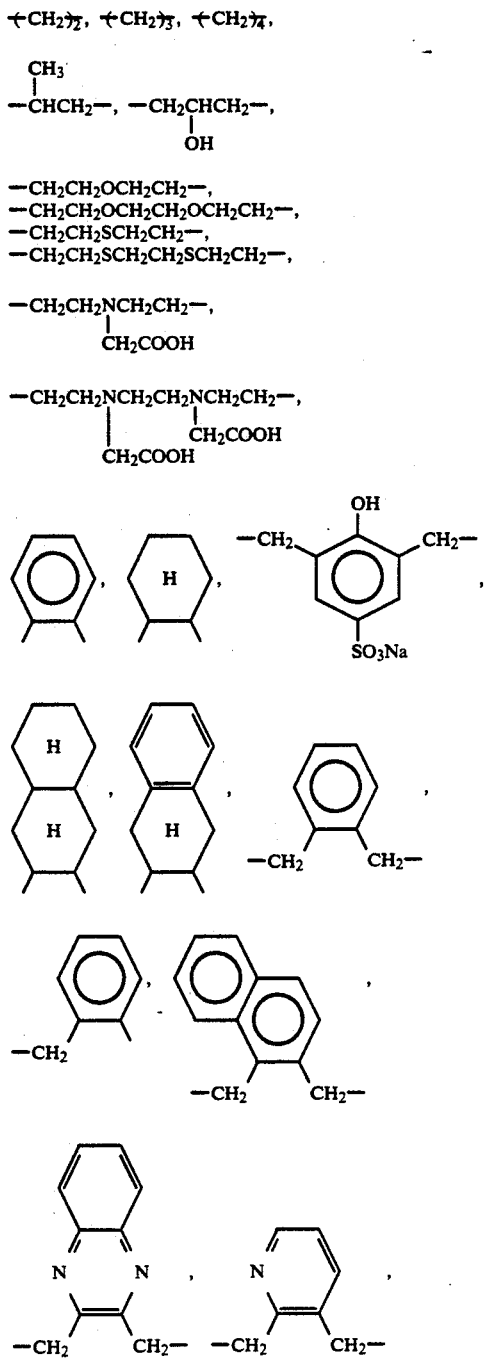

-continued

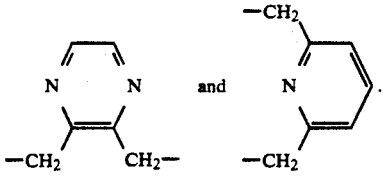

18. A method for processing a silver halide color photographic material as in claim 8, wherein the compound represented by formula (I) is selected from the group consisting of

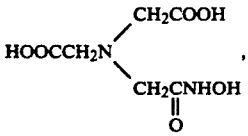

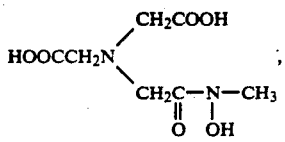

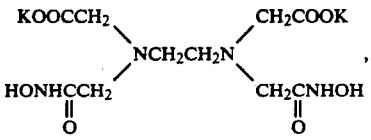

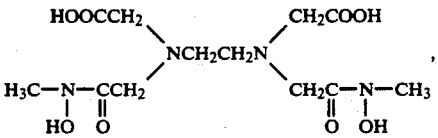

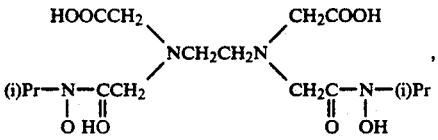

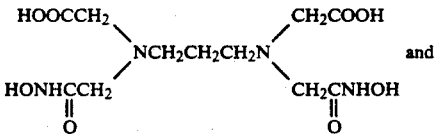

and

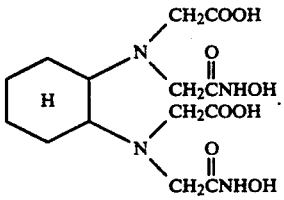

19. A method for processing a silver halide color photographic material as in claim 8, wherein the metal chelate compound is selected from the group consisting of

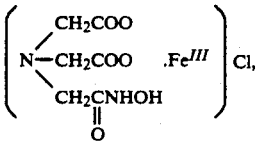

-continued

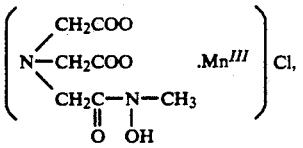

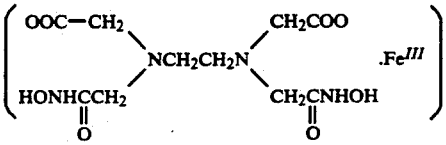

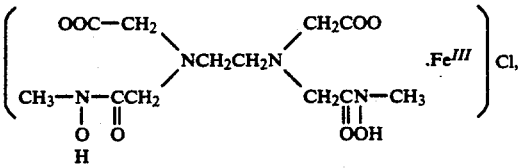

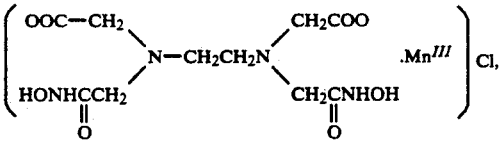

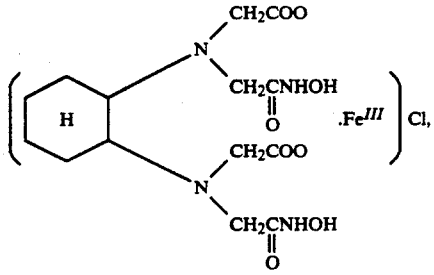

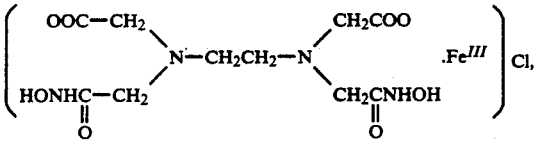

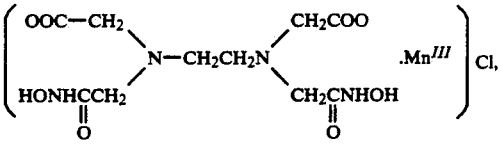

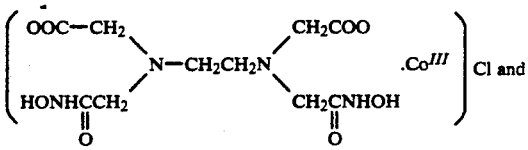

Cl and

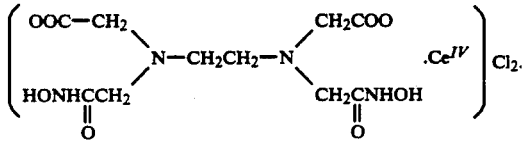

20. A method for processing a silver halide color photographic material as in claim 8, wherein said metal chelate compound is formed from a compound represented by formula (III) and a metal salt of Fe (III).

* * * * *